US011527252B2

(12) United States Patent
Markovic et al.

(10) Patent No.: US 11,527,252 B2
(45) Date of Patent: Dec. 13, 2022

(54) MDCT M/S STEREO

(71) Applicant: Fraunhofer-Gesellschaft zur Förderung der angewandten Forschung e.V., Munich (DE)

(72) Inventors: Goran Markovic, Erlangen (DE); Sascha Dick, Erlangen (DE); Eleni Fotopoulou, Erlangen (DE); Stefan Bayer, Erlangen (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

(21) Appl. No.: 17/005,417

(22) Filed: Aug. 28, 2020

(65) Prior Publication Data

US 2021/0065722 A1 Mar. 4, 2021

(30) Foreign Application Priority Data

Aug. 30, 2019 (EP) ..... 19194760

(51) Int. Cl.
*G10L 19/008* (2013.01)
*G10L 19/22* (2013.01)

(52) U.S. Cl.
CPC ..... *G10L 19/008* (2013.01)

(58) Field of Classification Search
CPC ..... G10L 19/008; G10L 19/02; G10L 19/22; G10L 19/0208; G10L 19/002; G10L 19/028

(Continued)

(56) References Cited

U.S. PATENT DOCUMENTS 8,655,670 B2 2/2014 Purnhagen et al.
2013/0028426 A1* 1/2013 Purnhagen ..... G10L 19/008 381/23
2018/0330740 A1* 11/2018 Ravelli ..... G10L 19/03

FOREIGN PATENT DOCUMENTS

EP 2676266 B1 12/2013
JP 2011182142 A * 9/2011 ..... G10L 19/00

(Continued)

OTHER PUBLICATIONS

J. D. Johnston and A. J. Ferreira, "Sum-difference stereo transform coding," in Proc. ICASSP, 1992, pp. 569-572.

(Continued)

*Primary Examiner* — Leshui Zhang
(74) *Attorney, Agent, or Firm* — McClure, Qualey & Rodack, LLP

(57) ABSTRACT

The invention refers to audio encoders, audio decoders, and audio encoding methods and audio decoding methods. In some examples, the invention refers to improved stereo coding. An encoder provides an encoded representation of an audio signal. The encoder applies a spectral whitening to a separate-channel representation of the input audio signal, to obtain a whitened separate-channel representation of the signal. The audio encoder applies a spectral whitening to a mid-side representation of the signal, to obtain a whitened mid-side representation of the signal. The audio encoder decides whether to encode the whitened separate-channel representation of the signal, to obtain the encoded representation of the signal, or to encode the whitened mid-side representation of the signal, to obtain the encoded representation of the signal.

18 Claims, 12 Drawing Sheets

(58) Field of Classification Search
USPC ..... 704/500–504; 381/1–23
See application file for complete search history.

(56) References Cited

FOREIGN PATENT DOCUMENTS

| | | | |
|---|---|---|---|
| WO | 2015010947 | A1 | 1/2015 |
| WO | 2017125544 | A1 | 7/2017 |
| WO | 2019091904 | A1 | 5/2019 |

OTHER PUBLICATIONS

ISO/IEC 11172-3, Information technology—Coding of moving pictures and associated audio for digital storage media at up to about 1,5 Mbit/s—Part 3: Audio, 1993.
ISO/IEC 13818-7, Information technology—Generic coding of moving pictures and associated audio information—Part 7: Advanced Audio Coding (AAC), 2003.
J-M. Valin, G. Maxwell, T. B. Terriberry and K. Vos, "High-Quality, Low-Delay Music Coding in the Opus Codec," in Proc. AES 135th Convention, New York, 2013 pp. 1-10.
C. Helmrich, P. Carlsson, S. Disch, B. Edler, J. Hilpert, M. Neusinger, H. Purnhagen, N. Rettelbach, J. Robilliard and L. Villemoes, "Efficient Transform Coding of Two-channel Audio Signals by Means of Complex-valued Stereo Prediction," in Acoustics, Speech and Signal Processing (ICASSP), 2011 IEEE International Conference on, Prague, 2011, pp. 1-11 plus drawings.
J. Herre, E. Eberlein and K. Brandenburg, "Combined Stereo Coding," in 93rd AES Convention, San Francisco, 1992, pp. 1-10.
3GPP TS 26.445, Codec for Enhanced Voice Services (EVS); Detailed algorithmic description(Release 16). Jun. 2019. The version for is 16.0.0., pp. 1-661.
C. R. Helmrich, A. Niedermeier, S. Bayer and B. Edler, "Low-complexity semi-parametric joint-stereo audio transform coding," in Signal Processing Conference (EUSIPCO), 2015 23rd European, 2015, pp. 794-798.
R. G. van der Waal and R. N. Veldhuis, "Subband Coding of Stereophonic Digital Audio Signals," in ICASSP, Toronto, 1991, pp. 3601-3606.

* cited by examiner (Part 1)

(Part 2)

(Part 1)

(Part 2)

MDCT M/S STEREO

CROSS-REFERENCE TO RELATED APPLICATION

This application claims priority from European Patent Application No. EP 19 194 760.5, which was filed on Aug. 30, 2019, and is incorporated herein in its entirety by reference.

BACKGROUND OF THE INVENTION

The present invention regards the field of audio coding. The invention refers to audio encoders, audio decoders, and audio encoding methods and audio decoding methods. In some examples, the invention refers to improved MDCT or MDST M/S stereo coding.

Band-wise mid side (M/S) processing in MDCT-based coders is known and effective method for stereo processing. Yet it has been found that it is not sufficient for panned signals and additional processing like complex prediction or coding of angle between mid and side channel is required. We present a new method that is able to deal with panned signals.

M/S processing on windowed and transformed non-normalized (not whitened) signal. [1] [2] [3]

Extended using prediction between the mid and the side channels: "An encoder, based on a combination of two audio channels, obtains a first combination signal as a mid-signal and a residual signal derivable using a predicted side signal derived from the mid signal. The first combination signal and the prediction residual signal are encoded and written into a data stream together with the prediction information. A decoder generates decoded first and second channel signals using the prediction residual signal, the first combination signal and the prediction information." [4]

"We apply MS stereo coupling separately on each band, after normalization . . . Opus encodes the mid and side as normalized signals m=M/||M|| and s=S||S||. To recover M and S from m and s . . . we encode the angle $\theta_s$=arctan (||S||/||M||) . . . . Let N be the size of the band and a be the total number of bits available for m and s. Then the optimal allocation for m is $a_{mid}=(a-(N-1)\log_2 \tan \theta_s)/2$." [5]

In [6] is proposed a system which uses a single ILD parameter on the FDNS-whitened spectrum followed by the band-wise M/S vs L/R decision with the bitrate distribution among the band-wise M/S processed channels based on the energy.

In most known approaches complicate rate/distortion loop is combined with the decision in which bands of the channels are transformed (e.g. using M/S followed by M to S prediction residual calculation) in order to reduce the correlation between channels. This complicate structure has high computational cost. This was addressed in [6] together with the efficient coding for panned channels with the global ILD.

However, it has been found that if there is different panning in different frequencies, the approach with prediction [7] may be advantageous. Even though there is a method described in [6] how to do the complex prediction in the whitened domain, it doesn't address the need for special whitening of the M/S as described in [8].

On the other hand, it has been found that keeping the global ILD concept it may be advantageous to use perceptual criteria for shaping the noise in the M/S coded channels as described in [8].

Introduction of the perceptual criteria for shaping the noise in the M/S coded channel in a coder where the whitening and the quantization are separated is not trivial and is presented in the following technical description.

Examples here below permit to increase efficiency and reduce bits needed for signaling.

SUMMARY

An embodiment may have a multi-channel audio encoder for providing an encoded representation of a multi-channel input audio signal, wherein the multi-channel audio encoder is configured to apply a spectral whitening to a separate-channel representation of the multi-channel input audio signal, to obtain a whitened separate-channel representation of the multi-channel input audio signal; wherein the multi-channel audio encoder is configured to apply a spectral whitening to a mid-side representation of the multi-channel input audio signal, to obtain a whitened mid-side representation of the multi-channel input audio signal; wherein the multi-channel audio encoder is configured to make a decision whether to encode the whitened separate-channel representation of the multi-channel input audio signal, to obtain the encoded representation of the multi-channel input audio signal, or to encode the whitened mid-side representation of the multi-channel input audio signal, to obtain the encoded representation of the multi-channel input audio signal, in dependence on the whitened separate-channel representation and in dependence on the whitened mid-side representation.

Another embodiment may have a multi-channel audio encoder for providing an encoded representation of a multi-channel input audio signal, wherein the multi-channel audio encoder is configured to apply a real prediction or a complex prediction to a whitened mid-side representation of the multi-channel input audio signal, in order to obtain one or more prediction parameters and a prediction residual signal; and wherein the multi-channel audio encoder is configured to encode one of the whitened mid signal representation and of the whitened side signal representation, and the one or more prediction parameters and a prediction residual of the real prediction or of the complex prediction, in order to obtain the encoded representation of the multi-channel input audio signal.

Another embodiment may have a multi-channel audio encoder for providing an encoded representation of a multi-channel input audio signal, wherein the multi-channel audio encoder is configured to determine a number of bits needed for a transparent encoding of a plurality of channels to be encoded, and wherein the multi-channel audio encoder is configured to allocate portions of an actually available bit budget for the encoding of the channels to be encoded on the basis of the numbers of bits needed for a transparent encoding of the plurality of channels of the representation selected to be encoded.

Another embodiment may have a multi-channel audio decoder for providing a decoded representation of a multi-channel audio signal on the basis of an encoded representation, wherein the multi-channel audio decoder is configured to derive a mid-side representation of the multi-channel audio signal from the encoded representation; wherein the multi-channel audio decoder is configured to apply a spectral de-whitening to the mid-side representation of the multi-channel audio signal, to obtain a dewhitened mid-side representation of the multi-channel input audio signal; wherein the multi-channel audio decoder is configured to derive a separate-channel representation of the multi-channel audio signal on the basis of the dewhitened mid-side representation of the multi-channel audio signal.

Another embodiment may have a method for providing an encoded representation of a multi-channel input audio signal, wherein the method includes applying a spectral whitening to a separate-channel representation of the multi-channel input audio signal, to obtain a whitened separate-channel representation of the multi-channel input audio signal; wherein the method includes applying a spectral whitening to a mid-side representation of the multi-channel input audio signal, to obtain a whitened mid-side representation of the multi-channel input audio signal; wherein the method includes making a decision whether to encode the whitened separate-channel representation of the multi-channel input audio signal, to obtain the encoded representation of the multi-channel input audio signal, or to encode the whitened mid-side representation of the multi-channel input audio signal, to obtain the encoded representation of the multi-channel input audio signal, in dependence on the whitened separate-channel representation and in dependence on the whitened mid-side representation.

Another embodiment may have a method for providing an encoded representation of a multi-channel input audio signal, wherein the method includes applying a real prediction or a complex prediction to a whitened mid-side representation of the multi-channel input audio signal, in order to obtain one or more prediction parameters and a prediction residual signal; and wherein the method includes encoding one of the whitened mid signal representation and of the whitened side signal representation, and the one or more prediction parameters and a prediction residual of the real prediction or of the complex prediction, in order to obtain the encoded representation of the multi-channel input audio signal; wherein the method includes making a decision which representation, out of a plurality of different representations of the multi-channel input audio signal, is encoded, in order to obtain the encoded representation of the multi-channel input audio signal, in dependence on a result of the real prediction or of the complex prediction.

Another embodiment may have a method for providing an encoded representation of a multi-channel input audio signal, wherein the method includes determining numbers of bits needed for a transparent encoding of a plurality of channels to be encoded, and wherein the method includes allocating portions of an actually available bit budget for the encoding of the channels to be encoded on the basis of the numbers of bits needed for a transparent encoding of the plurality of channels of the whitened representation selected to be encoded.

Another embodiment may have a method for providing a decoded representation of a multi-channel audio signal on the basis of an encoded representation, wherein the method includes deriving a mid-side representation of the multi-channel audio signal from the encoded representation; wherein the method includes applying a spectral de-whitening to the mid-side representation of the multi-channel audio signal, to obtain a dewhitened mid-side representation of the multi-channel input audio signal; wherein the method includes deriving a separate-channel representation of the multi-channel audio signal on the basis of the dewhitened mid-side representation of the multi-channel audio signal.

Another embodiment may have a non-transitory digital storage medium having a computer program stored thereon to perform the methods according to the invention when said computer program is run by a computer.

In accordance to an aspect, there is provided a multi-channel [e.g. stereo] audio encoder for providing an encoded representation [e.g. a bitstream] of a multi-channel input audio signal [e.g. of a pair channels of the multi-channel input audio signal, or of channel pairs of the multi-channel input audio signal], wherein the multi-channel audio encoder is configured to apply a spectral whitening [whitening] to a separate-channel representation [e.g. normalized Left, normalized Right; e.g. to a pair of channels] of the multi-channel input audio signal, to obtain a whitened separate-channel representation [e.g. whitened Left and whitened Right] of the multi-channel input audio signal;

wherein the multi-channel audio decoder is configured to apply a spectral whitening [whitening] to a [non-whitened] mid-side representation [e.g. Mid, Side] of the multi-channel input audio signal [e.g. to a mid-side representation of a pair of channels of the multi-channel input audio signal], to obtain a whitened mid-side representation [e.g. Whitened Mid, Whitened Side] of the multi-channel input audio signal;

wherein the multi-channel audio encoder is configured to make a decision [e.g. stereo decision] whether to encode the whitened separate-channel representation [e.g. whitened Left, whitened Right] of the multi-channel input audio signal, to obtain the encoded representation of the multi-channel input audio signal, or to encode the whitened mid-side representation [e.g. whitened Mid, whitened Side] of the multi-channel input audio signal, to obtain the encoded representation of the multi-channel input audio signal, in dependence on the whitened separate-channel representation and in dependence on the whitened mid-side representation [e.g. before a quantization of the whitened separate-channel representation and before a quantization of the whitened mid-side representation].

In accordance to an aspect, the multi-channel audio encoder is configured to obtain a plurality of whitening parameters [e.g. WP Left, WP right] [wherein, for example, the whitening parameters may be associated with separate channels, e.g. a left channel and a right channel, of the multi-channel input audio signal] [e.g. LPC parameters, or LSP parameters] [e.g. parameters which represent a spectral envelope of a channel or of multiple channels of the multi-channel input audio signal, or parameters which represent an envelope derived from a spectral envelope, e.g. masking curve] [wherein, for example, there may be a plurality of whitening parameters, e.g. WP left, associated with a first, e.g. left, channel of the multi-channel input audio signal, and wherein there may be a plurality of whitening parameters, e.g. WP right, associated with a second, e.g. right, channel of the multi-channel input audio signal].

In accordance to an aspect, the multi-channel audio encoder is configured to derive a plurality of whitening coefficients [e.g. frequency-domain whitening coefficients] [e.g. a plurality of whitening coefficients associated with individual channels of the multi-channel input audio signals; e.g. WC Left, WC right] from the whitening parameters [e.g. from coded whitening parameters] [for example, to derive a plurality of whitening coefficients, e.g. WC Left, associated with a first, e.g. left, channel of the multi-channel input audio signal from a plurality of whitening parameters, e.g. WP Left, associated with the first channel of the multi-channel input audio signal, and to derive a plurality of whitening coefficients, e.g. WC Right, associated with a second, e.g. right, channel of the multi-channel input audio signal from a plurality of whitening parameters, e.g. WP Right, associated with the second channel of the multi-channel input audio signal] [e.g. such that at least one whitening parameter influences more than one whitening coefficient, and such that at least one whitening coefficient is derived from more than one whitening parameter] [e.g. using ODFT from LPC, or using an interpolator and a linear domain converter]

In accordance to an aspect, the multi-channel audio encoder is configured to derive whitening coefficients associated with signals of the mid-side representation [e.g. WC Mid and WC Side] from whitening coefficients [e.g. WC Left, WC Right] associated with individual channels of the multi-channel input audio signal.

In accordance to an aspect, the multi-channel audio encoder is configured to derive the whitening coefficients associated with signals of the mid-side representation [e.g. WC Mid and WC Side] from the whitening coefficients [e.g. WC Left, WC Right] associated with individual channels of the multi-channel input audio signal using a non-linear derivation rule.

In accordance to an aspect, the multi-channel audio encoder is configured to determine an element-wise minimum, to derive the whitening coefficients associated with signals of the mid-side representation [e.g. WC Mid and WC Side] from the whitening coefficients [e.g. WC Left, WC Right] associated with individual channels of the multi-channel input audio signal. [For example, whitening coefficients WC Mid(t,f) for the mid channel and WC Side(t,f) for the side channel can be obtained on the basis of whitening coefficients WC Left(t,f) for the left channel and WC Right(t,f) for the right channel as follows (wherein t is a time index and f is a frequency index): WC Mid(t,f)=WC Side (t,f)=min(WC Left(t,f), WC Right(t,f)). In this case WC Mid and WC Side are identical, but this is not necessary as there could be some other better derivation where WC Mid is not equal to WC Side]

In accordance to an aspect, the multi-channel audio encoder is configured to apply an inter-channel level difference compensation [ILD compensation] to two or more channels of the input audio representation, in order to obtain level-compensated channels [e.g. Normalized Left and Normalized Right], and wherein the multi-channel audio encoder is configured to use the level-compensated channels as the separate-channel representation [e.g. normalized Left, normalized Right] of the multi-channel input audio signal

[e.g. such that a first spectral whitening is applied to the level-compensated channels, to derive the whitened separate-channel representation, and such that a mid-side derivation is also applied to the level-compensated channels, in order to obtain the non-whitened mid-side representation, to which a second spectral whitening is applied to derive the whitened mid-side representation]

[wherein the inter-channel level difference compensation may, for example, be configured to determine an information or a parameter or a value, e.g. ILD, describing a relationship, e.g. a ratio, between intensities, e.g. energies, of two or more channels of the input audio representation, and wherein the inter-channel level difference compensation may, for example, be configured to scale one or more of the channels of the input audio representation, to at least partially compensate energy differences between the channels of the input audio representation, in dependence on the information or parameter or value describing the relationship between intensities of two or more channels of the input audio representation]

[e.g. using an intermediate value $ratio_{ILD}$, which is derived from ILD, and which may, for example, consider a quantization of ILD]

[wherein, for example in the case of stereo it is enough to scale 1 channel]

[wherein, for example, the inter-channel-level-difference processing (ILD-processing) may be performed as described in the patent application "Apparatus and Method for MDCT M/S Stereo with Global ILD with improved MID/SIDE DECISION"].

In accordance to an aspect, the multi-channel audio decoder is configured to derive the mid-side representation [e.g. Normalized Left, Normalized Right] from a non-spectrally-whitened version of the separate-channel representation.

In accordance to an aspect, the multi-channel audio encoder is configured to apply channel-specific whitening coefficients [which are different for different channels] to different channels of the separate-channel representation [e.g. normalized Left, normalized Right] of the multi-channel input audio signal [e.g. apply WC Left to a left channel, e.g. Normalized Left; e.g. apply WC Right to a right channel, e.g. Normalized Right], in order to obtain the whitened separate-channel representation, and wherein the multi-channel audio encoder is configured to apply whitening coefficients [e.g. WC M, WC S] to a [non-whitened] mid signal [e.g. Mid] and to a [non-whitened] side signal [e.g. Side], in order to obtain a the whitened mid-side representation [e.g. Whitened Mid, Whitened Side]. (The whitening coefficients may be common whitening coefficients in some examples.)

In accordance to an aspect, the multi-channel audio encoder is configured to determine or estimate a number of bits needed to encode the whitened separate-channel representation [e.g. $b_{LR}$ and/or $b_{bwLR}{}^{i}$], and wherein the multi-channel audio encoder is configured to determine or estimate a number of bits needed to encode the whitened mid-side representation [e.g. $b_{MS}$ and/or $b_{bwMS}{}^{i}$], and wherein the multi-channel audio encoder is configured to make the decision [e.g. stereo decision] whether to encode the whitened separate-channel representation [e.g. whitened Left, whitened Right] of the multi-channel input audio signal, to obtain the encoded representation of the multi-channel input audio signal, or to encode the whitened separate-channel representation [e.g. whitened Mid, whitened Side] of the multi-channel input audio signal, to obtain the encoded representation of the multi-channel input audio signal, in dependence on the determined or estimated number of bits needed to encode the whitened separate-channel representation and in dependence on the determined or estimated number of bits needed to encode the whitened mid-side representation

[wherein, for example, a determined or estimated total number of bits, e.g. $b_{LR}$, needed for encoding the whitened separate-channel representation for all spectral bands, a determined or estimated total number of bits, e.g. bMs, needed to encode the whitened mid-side representation for all spectral bands, and a determined or estimated total number of bits, e.g. $b_{BW}$, needed for encoding the whitened separate-channel representation of one or more spectral bands and for encoding the whitened mid-side representation of one or more spectral bands, and for encoding an information signaling whether the whitened separate-channel representation or the whitened mid-side information is encoded, may be evaluated when making the decision.]

In accordance to an aspect, the multi-channel audio encoder is configured to determine an allocation of bits [e.g. a distribution of bits or a splitting of bits] to two or more channels of the whitened separate-channel representation [e.g. Whitened Left and Whitened Right] and/or to two or more channels of the whitened mid-side representation [e.g. Whitened Mid and Whitened Side, or Downmix, e.g. $D_{R,k}$, and Residual, e.g. $E_{R,k}$] separately from the decision [which may, for example, be a band-wise decision] whether to encode the whitened separate-channel representation [e.g. whitened Left, whitened Right] of the multi-channel input audio signal, to obtain the encoded representation of the multi-channel input audio signal, or to encode the whitened separate-channel representation [e.g. whitened Mid, whitened Side] of the multi-channel input audio signal, to obtain the encoded representation of the multi-channel input audio signal.

In accordance to an aspect, the multi-channel audio encoder is configured to determine numbers of bits needed for a transparent encoding [e.g., 96 kbps per channel may be used in an implementation; alternatively, one could use here the highest supported bitrate] of a plurality of channels of a whitened representation selected to be encoded [e.g. $\text{Bits}_{JointChn0}$, $\text{Bits}_{JointChn1}$], and wherein the multi-channel audio encoder is configured to allocate portions of an actually available bit budget [totalBitsAvailable−stereoBits] for the encoding of the channels of the whitened representation selected to be encoded on the basis of the numbers of bits needed for a transparent encoding of the plurality of channels of the whitened representation selected to be encoded.

[For example, a fine quantization with a fixed number of bits can be assumed, and it can be determined, how many bits are needed to encode the values resulting from said fine quantization using an entropy coding; the fixed fine quantization may, for example, be chosen such that a hearing impression is "transparent", for example, by choosing the fixed fine quantization such that a quantization noise is below a predetermined hearing threshold; the number of bits needed varies with the statistics of the quantized values, wherein, for example, the number of bits needed may be particularly small if many of the quantized values are small (close to zero) or if many of the quantized values are similar (because context-based entropy coding is efficient in this case); to conclude, so far we have assumed fine quantization with fixed number of bits, but it is believed that some elaborate psychoacoustics which would give signal dependent bitrate would be even better]

[wherein the multi-channel audio encoder is configured to determine a number of bits needed for encoding (e.g. entropy-encoding) values obtained using a predetermined (e.g. sufficiently fine, such that quantization noise is below a hearing threshold) quantization of the channels of the whitened representation selected to be encoded, as the number of bits needed for a transparent encoding]

In accordance to an aspect, the multi-channel audio encoder is configured to allocate portions of the actually available bit budget [totalBitsAvailable-stereoBits] for the encoding of the channels of the whitened representation selected to be encoded [to the channels of the whitened representation selected] in dependence on a ratio [e.g. $r_{split}$] between a number of bits needed for a transparent encoding of a given channel of the whitened representation selected to be encoded [e.g. $\text{Bits}_{JointChn0}$] and a number of bits needed for a transparent encoding of all channels of the whitened representation selected to be encoded [e.g. $\text{Bits}_{JointChn0}+\text{Bits}_{JointChn1}$]

[e.g. considering a quantization of said ratio,

In accordance to an aspect, the multi-channel audio encoder is configured to determine a ratio value $r_{split}$ according to $$r_{split} = \frac{\text{Bits}_{JointChn0}}{\text{Bits}_{JointChn0} + Bits_{JointChn1}},$$

wherein $\text{Bits}_{JointChn0}$ is a number of bits needed for a transparent encoding of a first channel of a whitened representation selected to be encoded, and wherein $\text{Bits}_{JointChn1}$ is a number of bits needed for a transparent encoding of a second channel of a whitened representation selected to be encoded, and wherein the multi-channel audio encoder is configured to determine a quantized ratio value $\widehat{ILD}$, and wherein the multi-channel audio encoder is configured to determine a number of bits allocated to one of the channels of the whitened representation selected to be encoded according to $$\text{bits}_{LM} = \left\lfloor \frac{\widehat{r_{split}}}{\text{rsplit}_{range}} (\text{totalBitsAvailable} - \text{otherwiseUsedBits}) \right\rfloor,$$

wherein the multi-channel audio encoder is configured to determine a number of bits allocated to another one of the channels of the whitened representation selected to be encoded according to $$\text{bits}_{RS}=(\text{totalBitsAvailable}-\text{otherwiseUsedBits})-\text{bits}_{LM}$$

wherein $\text{rsplit}_{range}$ is a predetermined value [which may, for example, describe a number of different values which the quantized ratio value can take];

wherein (totalBitsAvailable−otherwiseUsedBits) describes a number of Bits which are available for the encoding of the channels of the whitened representation selected to be encoded [e.g. a total number of bits available minus a number of bits used for side information].

In accordance to an aspect, the multi-channel audio encoder is configured to apply the spectral whitening [whitening] to the separate-channel representation [e.g. normalized Left, normalized Right] of the multi-channel input audio signal in a frequency domain [e.g. using a scaling of transform domain coefficients, like MDCT coefficients or Fourier coefficients]; and/or wherein the multi-channel audio encoder is configured to apply a spectral whitening [whitening] to a [non-whitened] mid-side representation [e.g. Mid, Side] of the multi-channel input audio signal in a frequency domain [e.g. using a scaling of transform domain coefficients, like MDCT coefficients or Fourier coefficients].

In accordance to an aspect, the multi-channel audio encoder is configured to make a band-wise decision [e.g. stereo decision] whether to encode the whitened separate-channel representation [e.g. whitened Left, whitened Right] of the multi-channel input audio signal, to obtain the encoded representation of the multi-channel input audio signal, or to encode the whitened mid-side representation [e.g. whitened Mid, whitened Side, or Downmix, Residual] of the multi-channel input audio signal, to obtain the encoded representation of the multi-channel input audio signal, for a plurality of frequency bands

[such that, for example, within a single audio frame, the whitened separate-channel representation is encoded for one or more frequency bands, and the whitened mid-side representation is encoded for one or more other frequency bands] ["mixed L/R and M/S spectral bands within a frame"].

In accordance to an aspect, the multi-channel audio encoder is configured to make a decision [e.g. stereo decision] whether to encode the whitened separate-channel representation [e.g. whitened Left, whitened Right] of the multi-channel input audio signal for all frequency bands out of a given range of frequency bands [e.g. for all frequency bands], to obtain the encoded representation of the multi-channel input audio signal, or to encode the whitened mid-side representation [e.g. whitened Mid, whitened Side] of the multi-channel input audio signal for all frequency bands out of the given range of frequency bands, to obtain the encoded representation of the multi-channel input audio signal, or to encode the whitened separate-channel representation [e.g. whitened Left, whitened Right] of the multi-channel input audio signal for one or more frequency bands out of a given range of frequency bands and to encode the whitened mid-side representation [e.g. whitened Mid, whitened Side, or Downmix, Residual] of the multi-channel input audio signal [e.g. with or without prediction] for one or more frequency bands out of the given range of frequency bands, to obtain the encoded representation of the multi-channel input audio signal [e.g. in accordance with a band-wise decision].

In accordance to an aspect, there is provided a multi-channel [e.g. stereo] audio encoder for providing an encoded representation [e.g. a bitstream] of a multi-channel input audio signal, wherein the multi-channel audio encoder is configured to apply a real prediction [wherein, for example, a parameter $\alpha_{R,k}$ is estimated] or a complex prediction [wherein, for example, parameters $\alpha_{R,k}$ and $\alpha_{I,k}$ are estimated] to a whitened mid-side representation of the multi-channel input audio signal, in order to obtain one or more prediction parameters [e.g. $\alpha_{R,k}$ and $\alpha_{I,k}$] and a prediction residual signal [e.g. $E_{R,k}$]; and wherein the multi-channel audio encoder is configured to encode [at least] one of the whitened mid signal representation [$MDCT_{M,k}$] and of the whitened side signal representation [$MDCT_{S,k}$], and the one or more prediction parameters [$\alpha_{R,k}$ and also $\alpha_{I,k}$ in the case of complex prediction] and a prediction residual [or prediction residual signal, or prediction residual channel] [e.g. $E_{R,k}$] of the real prediction or of the complex prediction, in order to obtain the encoded representation of the multi-channel input audio signal;

wherein the multi-channel audio encoder is configured to make a decision [e.g. stereo decision] which representation, out of a plurality of different representations of the multi-channel input audio signal [e.g. out of two or more of a separate-channel representation, a mid-side-representation in the form of a mid channel and a side channel, and a mid-side representation in the form of a downmix channel and a residual channel and one or more prediction parameters], is encoded, in order to obtain the encoded representation of the multi-channel input audio signal, in dependence on a result of the real prediction or of the complex prediction.

In accordance to an aspect, the multi-channel audio encoder is configured to make a decision [e.g. stereo decision] whether to encode the whitened mid-side representation [e.g. whitened Mid, whitened Side] of the multi-channel input audio signal [e.g. using an encoding of a downmix signal and an encoding of a residual signal and an encoding of one or more prediction parameters] [or, alternatively, a separate-channel representation (e.g. a whitened separate-channel representation; e.g. whitened Left, whitened Right) of the multi-channel input audio signal], to obtain the encoded representation of the multi-channel input audio signal, in dependence on a result of the real prediction or of the complex prediction.

In accordance to an aspect, the multi-channel audio encoder is configured to make a decision [e.g. stereo decision] whether to encode the whitened mid-side representation [e.g. whitened Mid, whitened Side] of the multi-channel input audio signal [e.g. using an encoding of a downmix signal and an encoding of a residual signal and an encoding of one or more prediction parameters] or to encode a separate-channel representation [e.g. a whitened separate-channel representation; e.g. whitened Left, whitened Right] of the multi-channel input audio signal, to obtain the encoded representation of the multi-channel input audio signal, in dependence on a result of the real prediction or of the complex prediction; and/or wherein the multi-channel audio encoder is configured to make a decision [e.g. stereo decision] whether to encode the whitened mid-side representation [e.g. whitened Mid, whitened Side] of the multi-channel input audio signal using an encoding of a downmix signal and an encoding of a residual signal and an encoding of one or more prediction parameters or to encode a separate-channel representation (e.g. a whitened separate-channel representation; e.g. whitened Left, whitened Right) of the multi-channel input audio signal], to obtain the encoded representation of the multi-channel input audio signal, in dependence on a result of the real prediction or of the complex prediction; and/or wherein the multi-channel audio encoder is configured to make a decision [e.g. stereo decision] whether to encode the whitened mid-side representation [e.g. whitened Mid, whitened Side] of the multi-channel input audio signal using an encoding of a downmix signal and an encoding of a residual signal and an encoding of one or more prediction parameters or to encode the whitened mid-side representation of the input audio signal without using a prediction, to obtain the encoded representation of the multi-channel input audio signal, in dependence on a result of the real prediction or of the complex prediction.

In accordance to an aspect, the multi-channel audio encoder is configured to quantize [at least] one of the whitened mid signal representation [$MDCT_{M,k}$] and of the whitened side signal representation [$MDCT_{S,k}$] using a single [e.g. fixed] quantization step size [which may, for example, be identical for different frequency bins or frequency ranges], and/or wherein the multi-channel audio encoder is configured to quantize the prediction residual [or prediction residual channel] [e.g. $E_{R,k}$] of the real prediction or of the complex prediction using a single [e.g. fixed] quantization step size [which may, for example, be identical for different frequency bins or frequency ranges, or which may be identical for bins across the complete frequency range].

In accordance to an aspect, the multi-channel audio encoder is configured to choose a downmix channel $D_{R,k}$ among a spectral representation $MDCT_{M,k}$ of a mid channel [designated by index M] and a spectral representation $MDCT_{S,k}$ of a side channel [designated by index S], wherein the multi-channel audio encoder is configured to determine prediction parameters $\alpha_{R,k}$ [for example, to minimize an intensity or an energy of the residual signal $E_{R,k}$], and wherein the multi-channel audio encoder is configured to determine the prediction residual [or prediction residual signal, or prediction residual channel] $E_{R,k}$ according to:

$$E_{R,k} = \begin{cases} MDCT_{S,k} - \alpha_{R,k} D_{R,k} & \text{if } D_{R,k} = MDCT_{M,k} \\ MDCT_{M,k} - \alpha_{R,k} D_{R,k} & \text{if } D_{R,k} = MDCT_{S,k} \end{cases};$$

or wherein the multi-channel audio encoder is configured to choose a downmix channel $D_{R,k}$ among a spectral representation $MDCT_{M,k}$ of a mid channel and a spectral representation $MDCT_{S,k}$ of a side channel, wherein the multi-channel audio encoder is configured to determine prediction parameters $\alpha_{R,k}$ and $\alpha_{I,k}$ [for example, to minimize an intensity or an energy of the residual signal $E_{R,k}$], and wherein the multi-channel audio encoder is configured to determine the prediction residual [or prediction residual signal, or prediction residual channel] $E_{R,k}$ according to:

$$E_{R,k} = \begin{cases} MDCT_{S,k} - \alpha_{R,k} D_{R,k} - \alpha_{I,k} D_{I,k} & \text{if } D_{R,k} = MDCT_{M,k} \\ MDCT_{M,k} - \alpha_{R,k} D_{R,k} - \alpha_{I,k} D_{I,k} & \text{if } D_{R,k} = MDCT_{S,k} \end{cases};$$

wherein k is a spectral index. [wherein there is more complex derivation of the Dl,k; e.g. the same as in the original complex prediction]

In accordance to an aspect, the multi-channel audio decoder is configured to apply a spectral whitening [whitening] to a mid-side representation [e.g. Mid, Side] of the multi-channel input audio signal, to obtain the whitened mid-side representation [e.g. Whitened Mid, Whitened Side] of the multi-channel input audio signal;

In accordance to an aspect, the multi-channel audio encoder is configured to apply a spectral whitening [whitening] to a separate-channel representation [e.g. normalized Left, normalized Right] of the multi-channel input audio signal, to obtain a whitened separate-channel representation [e.g. whitened Left and whitened Right] of the multi-channel input audio signal; and wherein the multi-channel audio encoder is configured to make a decision [e.g. stereo decision] whether to encode the whitened separate-channel representation [e.g. whitened Left, whitened Right] of the multi-channel input audio signal, to obtain the encoded representation of the multi-channel input audio signal, or to encode the whitened mid-side representation [e.g. whitened Mid, whitened Side] of the multi-channel input audio signal, to obtain the encoded representation of the multi-channel input audio signal, in dependence on the whitened separate-channel representation and in dependence on the whitened mid-side representation [e.g. before a quantization of the whitened separate-channel representation and before a quantization of the whitened mid-side representation].

In accordance to an aspect, there is provided a multi-channel [e.g. stereo] audio encoder for providing an encoded representation [e.g. a bitstream] of a multi-channel input audio signal, wherein the multi-channel audio encoder is configured to determine numbers of bits needed for a transparent encoding [e.g., 96 kbps per channel may be used in an implementation; alternatively, one could use here the highest supported bitrate] of a plurality of channels [e.g. of a [e.g. whitened] representation selected] to be encoded [e.g. $Bits_{JointChn0}$, $Bits_{JointChn1}$], and wherein the multi-channel audio encoder is configured to allocate portions of an actually available bit budget [totalBitsAvailable-stereoBits] for the encoding of the channels [e.g. of the whitened representation selected] to be encoded on the basis of the numbers of bits needed for a transparent encoding of the plurality of channels of the whitened representation selected to be encoded.

[For example, a fine quantization with a fixed number of bits can be assumed, and it can be determined, how many bits are needed to encode the values resulting from said fine quantization using an entropy coding; the fixed fine quantization may, for example, be chosen such that a hearing impression is "transparent", for example, by choosing the fixed fine quantization such that a quantization noise is below a predetermined hearing threshold; the number of bits needed varies with the statistics of the quantized values, wherein, for example, the number of bits needed may be particularly small if many of the quantized values are small (close to zero) or if many of the quantized values are similar (because context-based entropy coding is efficient in this case); to conclude, so far we have assumed fine quantization with fixed number of bits, but it is believed that some elaborate psychoacoustics which would give signal dependent bitrate would be even better]

In accordance to an aspect, the multi-channel audio encoder is configured to determine a number of bits needed for encoding [e.g. entropy-encoding] values obtained using a predetermined [e.g. sufficiently fine, such that quantization noise is below a hearing threshold] quantization of the channels to be encoded, as the number of bits needed for a transparent encoding.

In accordance to an aspect, the multi-channel audio encoder is configured to allocate portions of the actually available bit budget [totalBitsAvailable-stereoBits] for the encoding of the channels [of the whitened representation selected] to be encoded [to the channels to be encoded] in dependence on a ratio [e.g. $r_{split}$] between a number of bits needed for a transparent encoding of a given channel [of the whitened representation selected] to be encoded [e.g. $Bits_{JointChn0}$] and a number of bits needed for a transparent encoding of all channels [of the whitened representation selected] to be encoded [e.g. $Bits_{JointChn0}+Bits_{JointChn1}$] using the given [actually available] bit budget.

[e.g. considering a quantization of said ratio,

In accordance to an aspect, the multi-channel audio encoder is configured to determine a ratio value rsplit according to $$r_{split} = \frac{Bits_{JointChn0}}{Bits_{JointChn0} + Bits_{JointChn1}},$$

wherein $Bits_{JointChn0}$ is a number of bits needed for a transparent encoding of a first channel [of a whitened representation selected] to be encoded, and Wherein $Bits_{JointChn1}$ is a number of bits needed for a transparent encoding of a second channel [of a whitened representation selected] to be encoded, and Wherein the multi-channel audio encoder is configured to determine a quantized ratio value $\widehat{ILD}$, and Wherein the multi-channel audio encoder is configured to determine a number of bits allocated to one of the channels [of the whitened representation selected] to be encoded according to $$\text{bits}_{LM} = \left\lfloor \frac{\tilde{r}_{split}}{\text{rsplit}_{range}} (\text{totalBitsAvailable} - \text{otherwiseUsedBits}) \right\rfloor,$$

and

Wherein the multi-channel audio encoder is configured to determine a number of bits allocated to another one of the channels [of the whitened representation selected] to be encoded according to $$\text{bits}_{RS} = (\text{totalBitsAvailable} - \text{otherwiseUsedBits}) - \text{bits}_{LM}$$

Wherein $\text{rsplit}_{range}$ is a predetermined value [which may, for example, describe a number of different values which the quantized ratio value can take];

Wherein (totalBitsAvailable−otherwiseUsedBits) describes a number of Bits which are available for the encoding of the channels [of the whitened representation selected] to be encoded [e.g. a total number of bits available minus a number of bits used for side information].

In accordance to an aspect, there is provided a multi-channel [e.g. stereo] audio decoder for providing a decoded representation [e.g. a time-domain signal or a waveform] of a multi-channel audio signal on the basis of an encoded representation, wherein the multi-channel audio decoder is configured to derive a mid-side representation of the multi-channel audio signal [e.g. Whitened Joint Chn 0 and Whitened Joint Chn1] from the encoded representation [e.g. using a decoding and an inverse quantization $Q^{-1}$ and optionally a noise filling, and optionally using a multi-channel IGF or stereo IGF];

wherein the multi-channel audio decoder is configured to apply a spectral de-whitening [dewhitening] to the [encoder-sided whitened] mid-side representation [e.g. Whitened Joint Chn 0, Whitened Joint Chn 1] of the multi-channel audio signal, to obtain a dewhitened mid-side representation [e.g. Joint Chn 0, Joint Chn 1] of the multi-channel input audio signal;

wherein the multi-channel audio decoder is configured to derive a separate-channel representation of the multi-channel audio signal on the basis of the dewhitened mid-side representation of the multi-channel audio signal [e.g. using an "Inverse Stereo Processing"].

In accordance to an aspect, the multi-channel audio decoder is configured to obtain a plurality of whitening parameters [e.g. frequency-domain whitening parameters or "dewhitening parameters"][e.g. WP Left, WP right] [wherein, for example, the whitening parameters may be associated with separate channels, e.g. a left channel and a right channel, of the multi-channel audio signal] [e.g. LPC parameters, or LSP parameters] [e.g. parameters which represent a spectral envelope of a channel or of multiple channels of the multi-channel audio signal] [wherein, for example, there may be a plurality of whitening parameters, e.g. WP left, associated with a first, e.g. left, channel of the multi-channel input audio signal, and wherein there may be a plurality of whitening parameters, e.g. WP right, associated with a second, e.g. right, channel of the multi-channel input audio signal], wherein the multi-channel audio decoder is configured to derive a plurality of whitening coefficients [e.g. a plurality of whitening coefficients associated with individual channels of the multi-channel audio signals; e.g. WC Left, WC right] from the whitening parameters [e.g. from coded whitening parameters] [for example, to derive a plurality of whitening coefficients, e.g. WC Left, associated with a first, e.g. left, channel of the multi-channel audio signal from a plurality of whitening parameters, e.g. WP Left, associated with the first channel of the multi-channel audio signal, and to derive a plurality of whitening coefficients, e.g. WC Right, associated with a second, e.g. right, channel of the multi-channel audio signal from a plurality of whitening parameters, e.g. WP Right, associated with the second channel of the multi-channel input audio signal] [e.g. such that at least one whitening parameter influences more than one whitening coefficient, and such that at least one whitening coefficient is derived from more than one whitening parameter] [e.g. using ODFT from LPC, or using an interpolator and a linear domain converter], and wherein the multi-channel audio decoder is configured to derive whitening coefficients associated with signals of the mid-side representation [e.g. WC Mid and WC Side] from whitening coefficients [e.g. WC Left, WC Right] associated with individual channels of the multi-channel audio signal.

In accordance to an aspect, the multi-channel audio decoder is configured to derive the whitening coefficients associated with signals of the mid-side representation [e.g. WC Mid and WC Side] from the whitening coefficients [e.g. WC Left, WC Right] associated with individual channels of the multi-channel audio signal using a non-linear derivation rule.

In accordance to an aspect, the multi-channel audio decoder is configured to determine an element-wise minimum, to derive the whitening coefficients associated with signals of the mid-side representation [e.g. WC Mid and WC Side] from the whitening coefficients [e.g. WC Left, WC Right] associated with individual channels of the multi-channel audio signal.

[For example, whitening coefficients WC Mid(t,f) for the mid channel and WC Side(t,f) for the side channel can be obtained on the basis of whitening coefficients WC Left(t,f) for the left channel and WC Right(t,f) for the right channel as follows (wherein t is a time index and f is a frequency index): WC Mid(t,f)=WC Side(t,f)=min(WC Left(t,f), WC Right(t,f)). In this case WC Mid and WC Side are identical, but this is not necessary as there could be some other better derivation where WC Mid is not equal to WC Side]

In accordance to an aspect, the multi-channel audio decoder is configured to apply an inter-channel level difference compensation [ILD compensation] to two or more channels of a dewhitened separate-channel representation of the multi-channel audio signal [which is, for example, derived on the basis of the mid-side representation of the multi-channel audio signal], in order to obtain a level-compensated representation of channels [e.g. Normalized Left and Normalized Right] [and wherein the multi-channel audio decoder is configured to perform a transform-domain-to-time-domain conversion [e.g. IMDCT] on the basis of the level-compensated representation of channels].

In accordance to an aspect, the multi-channel audio decoder is configured to apply a gap filling [e.g. IGF][which may, for example, fill spectral lines quantized to zero in a target range of a spectrum with content from a different range of the spectrum, which is a source range][wherein, for example, the content of the source range is adapted to the content of the target range] to a whitened representation of the multi-channel audio signal [before applying a de-whitening].

In accordance to an aspect, the multi-channel audio decoder is configured to obtain [at least] one of a whitened mid signal representation [$MDCT_{M,k}$; e.g. represented by Whitened Joint Chn 0] and of a whitened side signal representation[$MDCT_{S,k}$; e.g. represented by Whitened Joint Chn 0], and one or more prediction parameters [$\alpha_{R,k}$ and also $\alpha_{I,k}$ in the case of complex prediction] and a prediction residual [or prediction residual signal, or prediction residual channel] [e.g. $E_{R,k}$; e.g. represented by Whitened Joint Chn 1] of a real prediction or of the complex prediction [e.g. on the basis of the encoded representation];

wherein the multi-channel audio decoder is configured to apply a real prediction [wherein, for example, a parameter $\alpha_{R,k}$ is applied] or a complex prediction [wherein, for example, parameters $\alpha_{R,k}$ and $\alpha_{I,k}$ are applied], in order to determine a whitened side signal representation [e.g. in case that the whitened mid signal representation is directly decodable from the encoded representation, and available as an input signal] or a whitened mid signal representation [e.g. in case that the whitened side signal representation is directly decodable from the encoded representation, and available as an input signal to the prediction] on the basis of the obtained one of the whitened mid signal representation and the whitened side signal representation, on the basis of the prediction residual and on the basis of the prediction parameters; and wherein the multi-channel audio decoder is configured to apply a spectral de-whitening [dewhitening] to the [encoder-sided whitened] mid-side representation [e.g. Whitened Joint Chn 0, Whitened Joint Chn 1] of the multi-channel audio signal obtained using the real prediction or using the complex prediction, to obtain the dewhitened mid-side representation [e.g. Joint Chn 0, Joint Chn 1] of the multi-channel input audio signal.

In accordance to an aspect, the multi-channel audio decoder is configured to control a decoding and/or a determination of whitening parameters and/or a determination of whitening coefficients and/or a prediction and/or a derivation of a separate-channel representation of the multi-channel audio signal on the basis of the dewhitened mid-side representation of the multi-channel audio signal in dependence on one or more parameters which are included in the encoded representation [e.g. "Stereo Parameters"].

In accordance to an aspect, the multi-channel audio decoder is configured to apply the spectral de-whitening [dewhitening] to the [encoder-sided whitened] mid-side representation [e.g. Whitened Joint Chn 0, Whitened Joint Chn 1] of the multi-channel audio signal in a frequency domain [e.g. using a scaling of transform domain coefficients, like MDCT coefficients or Fourier coefficients], to obtain a dewhitened mid-side representation [e.g. Joint Chn 0, Joint Chn 1] of the multi-channel input audio signal.

In accordance to an aspect, the multi-channel audio decoder is configured to make a band-wise decision [e.g. stereo decision] whether to decode a whitened separate-channel representation [e.g. whitened Left, whitened Right, represented by Whitened Joint Chn 0 and Whitened Joint Chn 1] of the multi-channel audio signal, to obtain the decoded representation of the multi-channel input audio signal, or to decode the whitened mid-side representation [e.g. whitened Mid, whitened Side, or Downmix, Residual, represented by Whitened Joint Chn 0 and Whitened Joint Chn 1] of the multi-channel audio signal, to obtain the decoded representation of the multi-channel audio signal, for a plurality of frequency bands [such that, for example, within a single audio frame, a whitened separate-channel representation is decoded for one or more frequency bands, and a whitened mid-side representation is decoded for one or more other frequency bands]["mixed L/R and M/S spectral bands within a frame"].

In accordance to an aspect, the multi-channel audio decoder is configured to make a decision [e.g. stereo decision] whether to decode the whitened separate-channel representation [e.g. whitened Left, whitened Right, represented by Whitened Joint Chn 0 and Whitened Joint Chn 1] of the multi-channel audio signal for all frequency bands out of a given range of frequency bands [e.g. for all frequency bands], to obtain the decoded representation of the multi-channel input audio signal, or to decode the whitened mid-side representation [e.g. whitened Mid, whitened Side, represented by Whitened Joint Chn 0 and Whitened Joint Chn 1] of the multi-channel audio signal for all frequency bands out of the given range of frequency bands, to obtain the decoded representation of the multi-channel input audio signal, or to decode the whitened separate-channel representation [e.g. whitened Left, whitened Right, represented by Whitened Joint Chn 0 and Whitened Joint Chn 1] of the multi-channel input audio signal for one or more frequency bands out of a given range of frequency bands and to decode the whitened mid-side representation [e.g. whitened Mid, whitened Side, or Downmix, Residual, represented by Whitened Joint Chn 0 and Whitened Joint Chn 1] of the multi-channel audio signal [e.g. with or without prediction] for one or more frequency bands out of the given range of frequency bands, to obtain the decoded representation of the multi-channel input audio signal [e.g. in accordance with a band-wise decision, which may be made on the basis of a side information included in a bitstream].

In accordance to an aspect, there is provided a method for providing an encoded representation [e.g. a bitstream] of a multi-channel input audio signal [e.g. of a pair channels of the multi-channel input audio signal], wherein the method comprises applying a spectral whitening [whitening] to a separate-channel representation [e.g. normalized Left, normalized Right; e.g. to a pair of channels] of the multi-channel input audio signal, to obtain a whitened separate-channel representation [e.g. whitened Left and whitened Right] of the multi-channel input audio signal;

wherein the method comprises applying a spectral whitening [whitening] to a [non-whitened] mid-side representation [e.g. Mid, Side] of the multi-channel input audio signal [e.g. to a mid-side representation of a pair of channels of the multi-channel input audio signal], to obtain a whitened mid-side representation [e.g. Whitened Mid, Whitened Side] of the multi-channel input audio signal;

wherein the method comprises making a decision [e.g. stereo decision] whether to encode the whitened separate-channel representation [e.g. whitened Left, whitened Right] of the multi-channel input audio signal, to obtain the encoded representation of the multi-channel input audio signal, or to encode the whitened mid-side representation [e.g. whitened Mid, whitened Side] of the multi-channel input audio signal, to obtain the encoded representation of the multi-channel input audio signal, in dependence on the whitened separate-channel representation and in dependence on the whitened mid-side representation [e.g. before a quantization of the whitened separate-channel representation and before a quantization of the whitened mid-side representation].

In accordance to an aspect, there is provided a method for providing an encoded representation [e.g. a bitstream] of a multi-channel input audio signal, wherein the method comprises applying a real prediction [wherein, for example, a parameter $\alpha_{R,k}$ is estimated] or a complex prediction [wherein, for example, parameters $\alpha_{R,k}$ and $\alpha_{I,k}$ are estimated] to a whitened mid-side representation of the multi-channel input audio signal, in order to obtain one or more prediction parameters [e.g. $\alpha_{R,k}$ and $\alpha_{I,k}$] and a prediction residual signal [e.g. $E_{R,k}$]; and wherein the method comprises encoding [at least] one of the whitened mid signal representation [$MDCT_{M,k}$] and of the whitened side signal representation[$MDCT_{S,k}$], and the one or more prediction parameters [$\alpha_{R,k}$ and also $\alpha_{I,k}$ in the case of complex prediction] and a prediction residual [or prediction residual signal, or prediction residual channel] [e.g. $E_{R,k}$] of the real prediction or of the complex prediction, in order to obtain the encoded representation of the multi-channel input audio signal;

wherein the method comprises making a decision [e.g. stereo decision] which representation, out of a plurality of different representations of the multi-channel input audio signal [e.g. out of two or more of a separate-channel representation, a mid-side-representation in the form of a mid channel and a side channel, and a mid-side representation in the form of a downmix channel and a residual channel and one or more prediction parameters], is encoded, in order to obtain the encoded representation of the multi-channel input audio signal, in dependence on a result of the real prediction or of the complex prediction.

In accordance to an aspect, there is provided a method for providing an encoded representation [e.g. a bitstream] of a multi-channel input audio signal, wherein the method comprises determining numbers of bits needed for a transparent encoding [e.g., 96 kbps per channel may be used in an implementation; alternatively, one could use here the highest supported bitrate] of a plurality of channels [e.g. of a whitened representation selected] to be encoded [e.g. $Bits_{JointChn0}$, $Bits_{JointChn1}$], and wherein the method comprises allocating portions of an actually available bit budget [totalBitsAvailable−stereoBits] for the encoding of the channels [e.g. of the whitened representation selected] to be encoded on the basis of the numbers of bits needed for a transparent encoding of the plurality of channels of the whitened representation selected to be encoded.

In accordance to an aspect, there is provided a method for providing a decoded representation [e.g. a time-domain signal or a waveform] of a multi-channel audio signal on the basis of an encoded representation, Wherein the method comprises deriving a mid-side representation of the multi-channel audio signal [e.g. Whitened Joint Chn 0 and Whitened Joint Chn1] from the encoded representation [e.g. using a decoding and an inverse quantization $Q^{-1}$ and optionally a noise filling, and optionally using a multi-channel IGF or stereo IGF];

wherein the method comprises applying a spectral dewhitening [dewhitening] to the [encoder-sided whitened] mid-side representation [e.g. Whitened Joint Chn 0, Whitened Joint Chn 1] of the multi-channel audio signal, to obtain a dewhitened mid-side representation [e.g. Joint Chn 0, Joint Chn 1] of the multi-channel input audio signal;

wherein the method comprises deriving a separate-channel representation of the multi-channel audio signal on the basis of the dewhitened mid-side representation of the multi-channel audio signal [e.g. using an "Inverse Stereo Processing"].

In accordance to an aspect, there is provided a computer program for performing the method as above when the computer program runs on a computer.

BRIEF DESCRIPTION OF THE DRAWINGS

Embodiments of the present invention will be detailed subsequently referring to the appended drawings, in which.

DETAILED DESCRIPTION OF THE INVENTION

Use the rate-loop, for example, as described in [9] combined with whitening, whitening being, for example, the spectral envelope warping and FDNS as described in [10] or the SNS as described in [11]. Optionally, Band-wise M/S vs L/R decision is done before the whitening and the whitening on the M/S bands is done, for example, using the whitening coefficients derived from the left and the right whitening coefficients. Optionally, ILD compensation [6] or Prediction [7] is used to increase the effectiveness of the M/S. The M/S decision is, for example, based on the estimated bit saving. Optionally, Bitrate distribution among the stereo processed channels is based on the energy or on the bitrate ratio for the transparent coding.

Figure 1A:
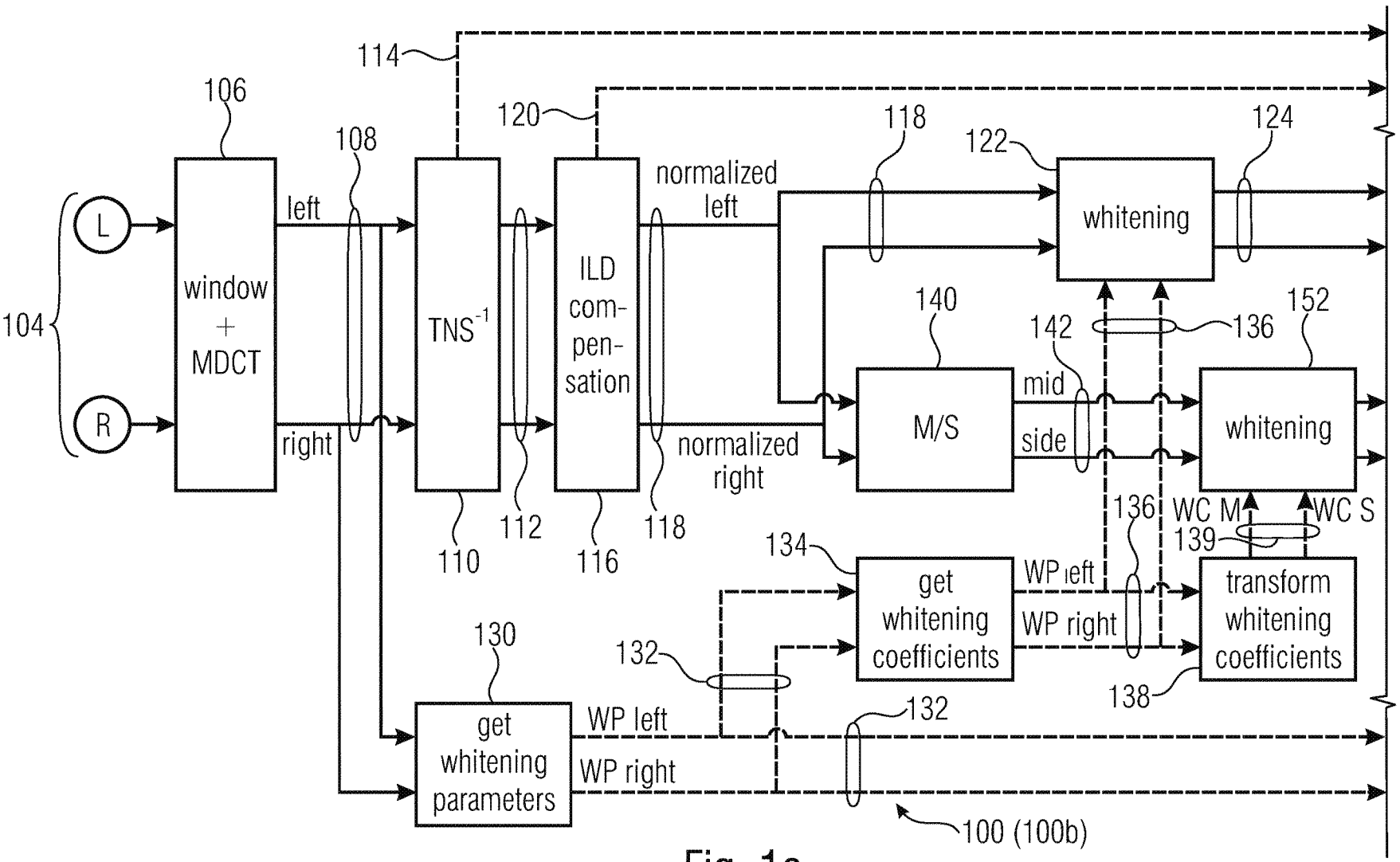
FIGS. 1*a*, 1*b*, 2*a*, 2*b*, and 2*c* show examples of audio encoders.
Figure 1A:
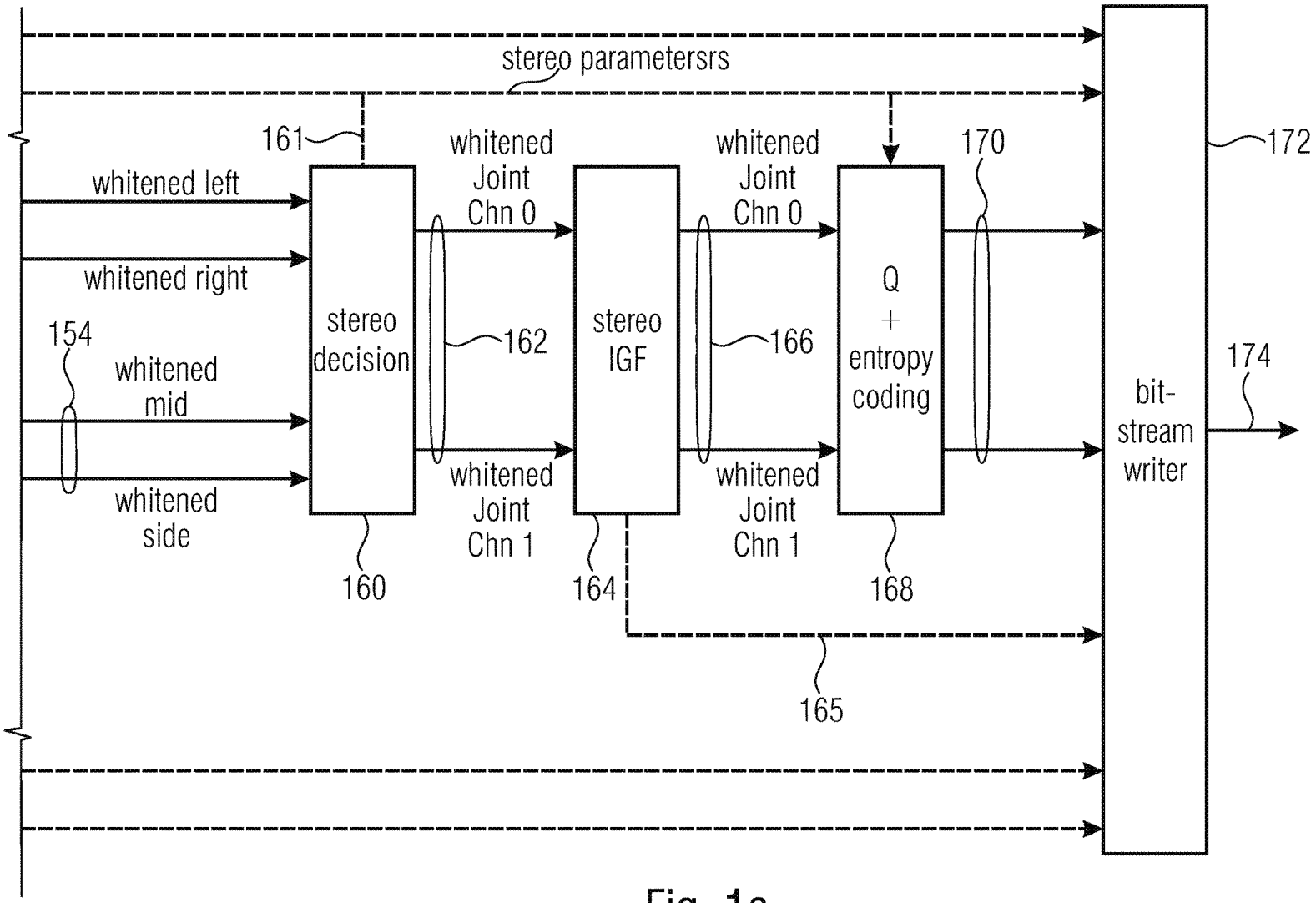
Figure 1B:
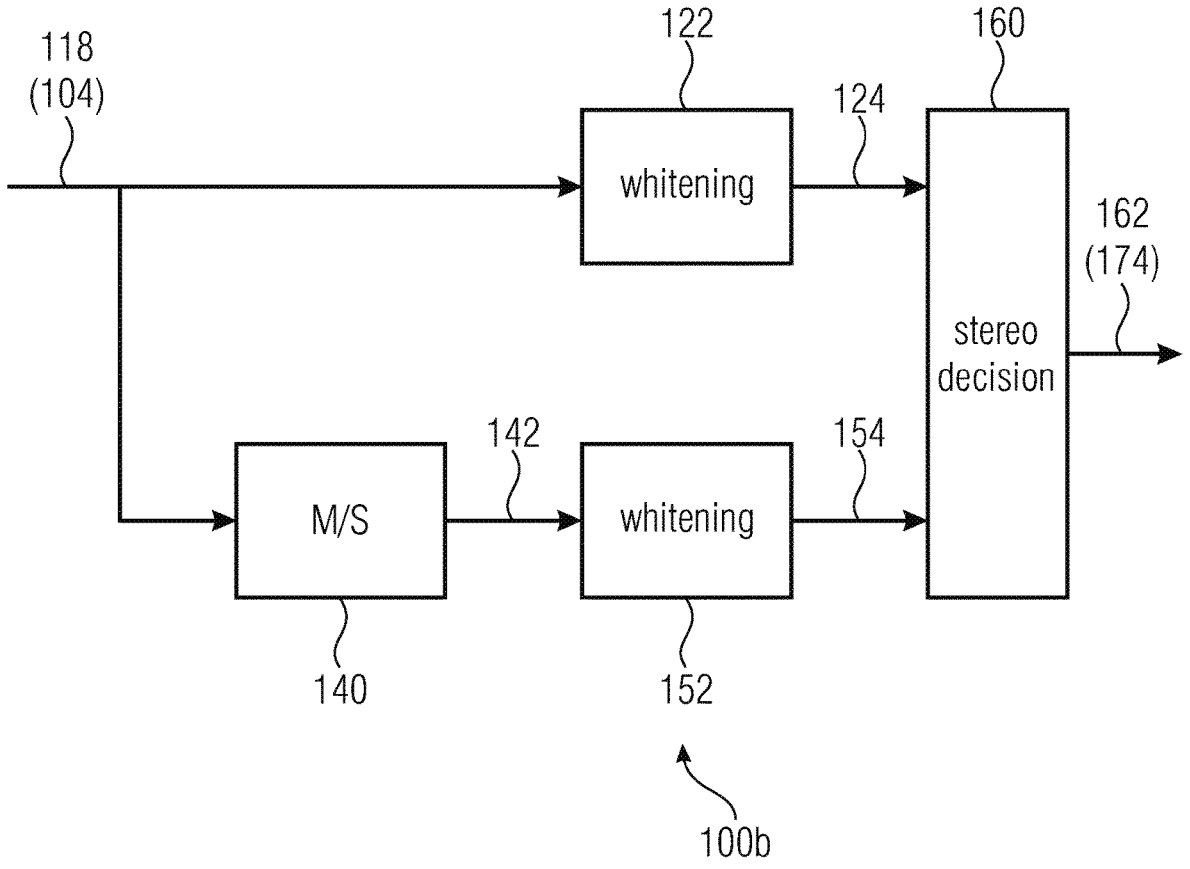

Encoder 100*b* (FIG. 1*b*)

FIG. 1*b* shows a general example of multi-channel [e.g. stereo] audio encoder 100*b*. The encoder 100*b* of FIG. 1*b* may include several components, some of which may be non-shown in FIG. 1*b*. An example of the encoder 100*b* of FIG. 1*b* is the encoder 100 of FIG. 1*a*. In FIG. 1*b*, multi-channel signals are shown with one single line, while in FIG. 1*a* they are shown in multiple lines. To maintain the schematization easy, parameter lines are not shown in FIG. 1*b*. It is noted that while the input signal and output signal of the encoder 100*b* appear to be 118 and 162, respectively, it may happen that some additional processing is performed upstream or downstream the signals 118 and 162, respectively. The original input signal of the encoder 100*b* is here indicated with 104, and the final signal (e.g. the version which is encoded in the bitstream) is indicated with 174.

The input signal 118 (104) may be understood as being subdivided into consecutive frames. The signal 104 may be subjected to a conversion to a frequency domain, FD, representation (e.g. MDCT, MDST, etc.), so that the separate-channel representation 118 may be in the FD. In some cases, two consecutive frames may at least partially overlap (as in lapped transformations). In some cases, each frame is divided into multiple bands (frequency ranges), each grouping at least one or more bins (often, here below, reference to a band is made with the index "k", and sometimes with index "i").

The encoder 100*b* may be configured to provide an encoded representation [e.g. a bitstream] 174 of a multi-channel input audio signal. The multi-channel input audio signal may include, for example, a pair of channels (e.g. Left, Right), or channel pairs of the multi-channel input audio signal. FIG. 1*b* shows a separate-channel representation 118 [e.g. normalized Left, normalized Right, or more in general two channels] of a multi-channel input audio signal 104. In case the normalization is performed, the louder channel, among Left and Right, may be scaled (an example will be provided below).

At a first whitening block 122, the encoder 100*b* may be configured to apply a spectral whitening [or more in general a whitening] to the separate-channel representation [e.g. normalized Left, normalized Right; or more in general to the pair of channels] 118 of the multi-channel input audio signal 104, to obtain a whitened separate-channel representation [e.g. whitened Left and whitened Right] 124 of the multi-channel input audio signal 104. In examples, while the signal representation 118 of the multi-channel input audio signal 104 is non-whitened, the signal representation 124 of the multi-channel input audio signal 104 is whitened.

At a second whitening block 152, the encoder 100*b* may be configured to apply a spectral whitening [or more in general a whitening] to a mid-side representation [e.g. Mid, Side] 142 of the multi-channel input audio signal 104 [e.g. to a mid-side representation of a pair of channels of the multi-channel input audio signal, as obtained from the M/S block 140; see below]. Hence, a whitened mid-side representation 154 [e.g. Whitened Mid, Whitened Side] of the multi-channel input audio signal is obtained. In examples, while the signal representation 142 of the multi-channel input audio signal 104 is non-whitened, the signal representation 152 of the multi-channel input audio signal 104 is whitened.

The first and the second whitening blocks 122 and 152 may operate so as to flatten the spectral envelope of their input signals (respectively 118 and 142).

In examples, the encoder 100*b* may be configured, at stereo decision block 160, to make a decision [e.g. stereo decision]. The decision may be a decision on whether to encode (e.g. in the bitstream 174):

- the whitened separate-channel representation [e.g. whitened Left, whitened Right] 124 of the multi-channel input audio signal 104, to obtain the encoded representation 174 of the multi-channel input audio signal 104 as encoding the whitened separate-channel representation, or
- the whitened mid-side representation [e.g. whitened Mid, whitened Side] 154 of the multi-channel input audio signal 104, to obtain the encoded representation 174 of the multi-channel input audio signal 104 as encoding the whitened mid-side representation 154.

The stereo decision block 160 may perform the decision in dependence on the whitened separate-channel representation 124 and in dependence on the whitened mid-side representation 154. For example, the stereo decision block 160 may estimate the number of bits needed to encode each of the signal representations 124 and 154, and decide for encoding the band representation which requires less bits.

The stereo decision 160 may be performed for each frame (or group of subsequent frames) of the signal representation 118 of the input signal 104.

The stereo decision 160 may be performed in a band-by-band fashion: while one band may occur to be encoded using the whitened mid-side representation 154, another band (even in the same frame) may occur to be encoded using the whitened separate-channel representation 124. In other examples, the stereo decision 160 may be performed globally for the whole frame (e.g. all the bands of the frame). In some examples, the stereo decision 160 may comprise, for each frame, a decision among:

- a full whitened separate-channel representation for all the bands of the signal ("full dual mono mode" or "full L/R mode", from "L" for "left" and "R" for "right"); a full whitened mid-side representation for all the bands of the signal ("full M/S mode");
- bandwise representation, in which for some band(s) a whitened separate-channel representation is encoded, and for other band(s) a full whitened mid-side representation is encoded ("band-wise M/S mode").

It is noted that, besides the signal representations 124, 154, and 162, other parameters may be taken into considerations by any of blocks 122, 140, 152, and 160, and/or signaled in the bitstream 174. However, they are not represented in FIG. 1*b* for simplicity (see FIG. 1*a* for examples thereof).

The invention is advantageous over the conventional technology (e.g., [6]). In the conventional technology, M/S is performed on the whitened left and right channels. Stereo decision in the conventional technology also needs whitened L/R and M/S signals. However, the M/S processing is processed in the conventional technology after whitening L/R and it is done on the whitened L/R signal.

With the present solution, the M/S processing (140) is performed on the non-whitened signal 118 and the whitening (152) is performed on the M/S signal 142 in a specific manner (see below, also in relationship to signals and parameters 136, 138, 139, 152, 338).

Figure 7:
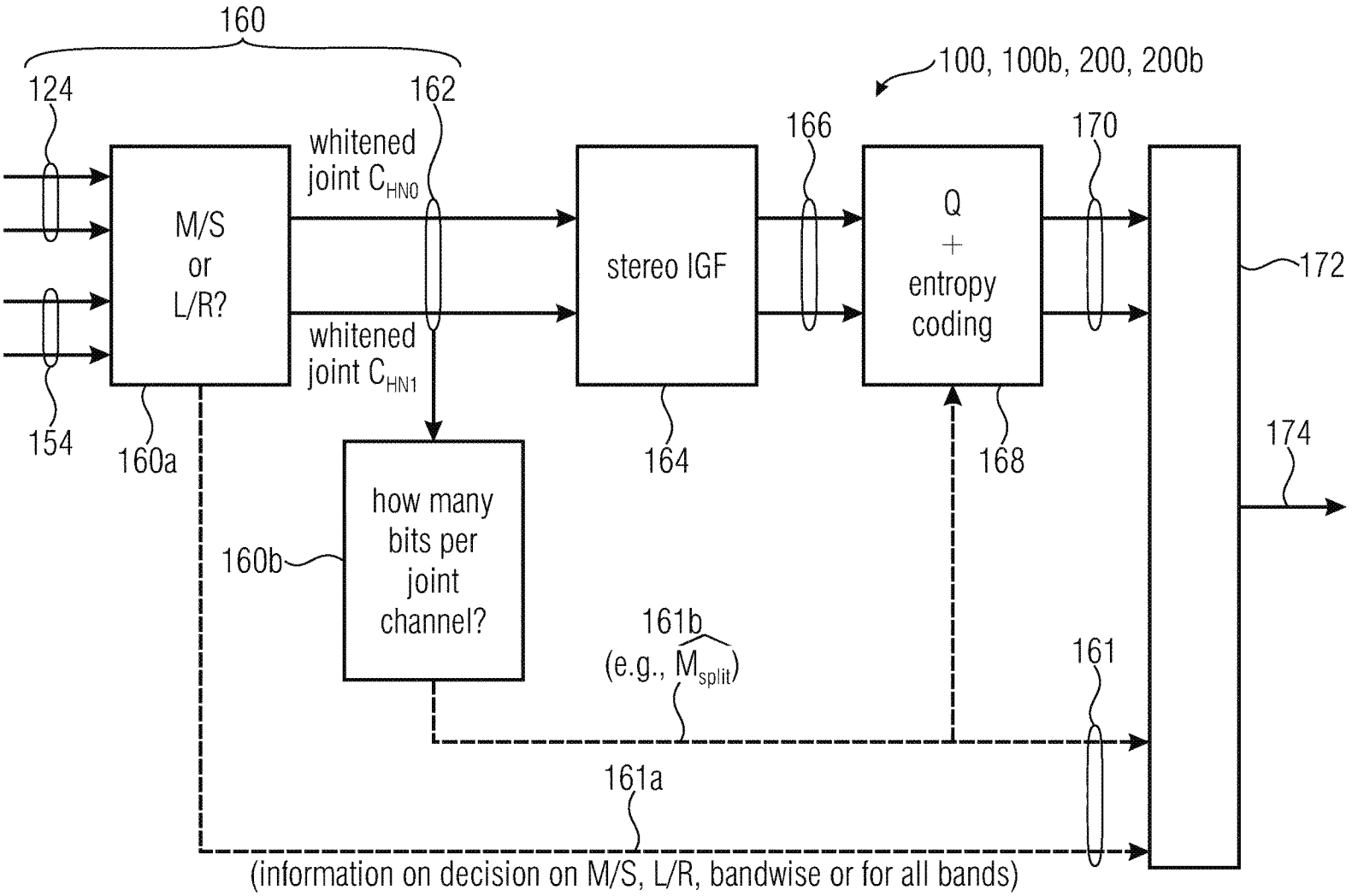
FIG. 7 shows a particular of an encoder of any of FIGS. 1*a*, 1*b*, 2*a*, and 2*b*.

FIG. 7 shows an example of decision block 160, outputting signal representation 162. Block 160 may include a subblock 160*a* deciding whether to encode the whitened separate-channel representation 124 or the whitened mid-side representation 154. The output of subblock 160*a* is the signal representation 162, constituted by channels Whitened Joint Chn0 and Whitened Joint Chn1. For each band (or for the whole spectrum), the Whitened Joint Chn0 and Whitened Joint Chn1 may be chosen from the channels of either the separate-channel representation 124 or the whitened mid-side representation 154.

In addition or alternative, block 160 may include a subblock 160*b*, deciding to allocate portions of a bit budget for encoding the channels (Whitened Joint Chn0 and Whitened Joint Chn1) of the signal representation 162 on the basis of the number of bits needed for a transparent encoding of the channels Whitened Joint Chn0 and Whitened Joint Chn1 of the signal representation 162.

Figure 2A:
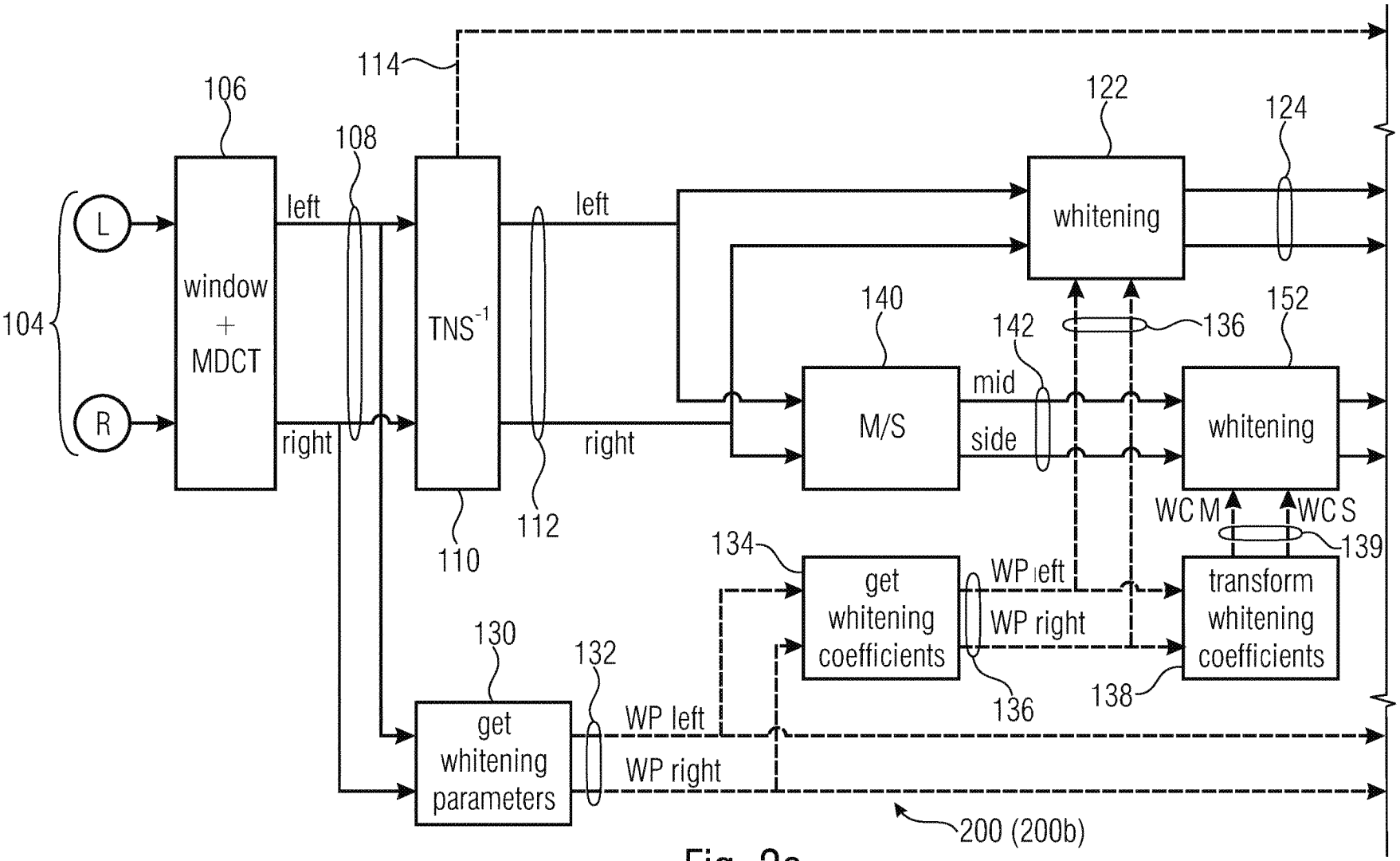
Figure 2A:
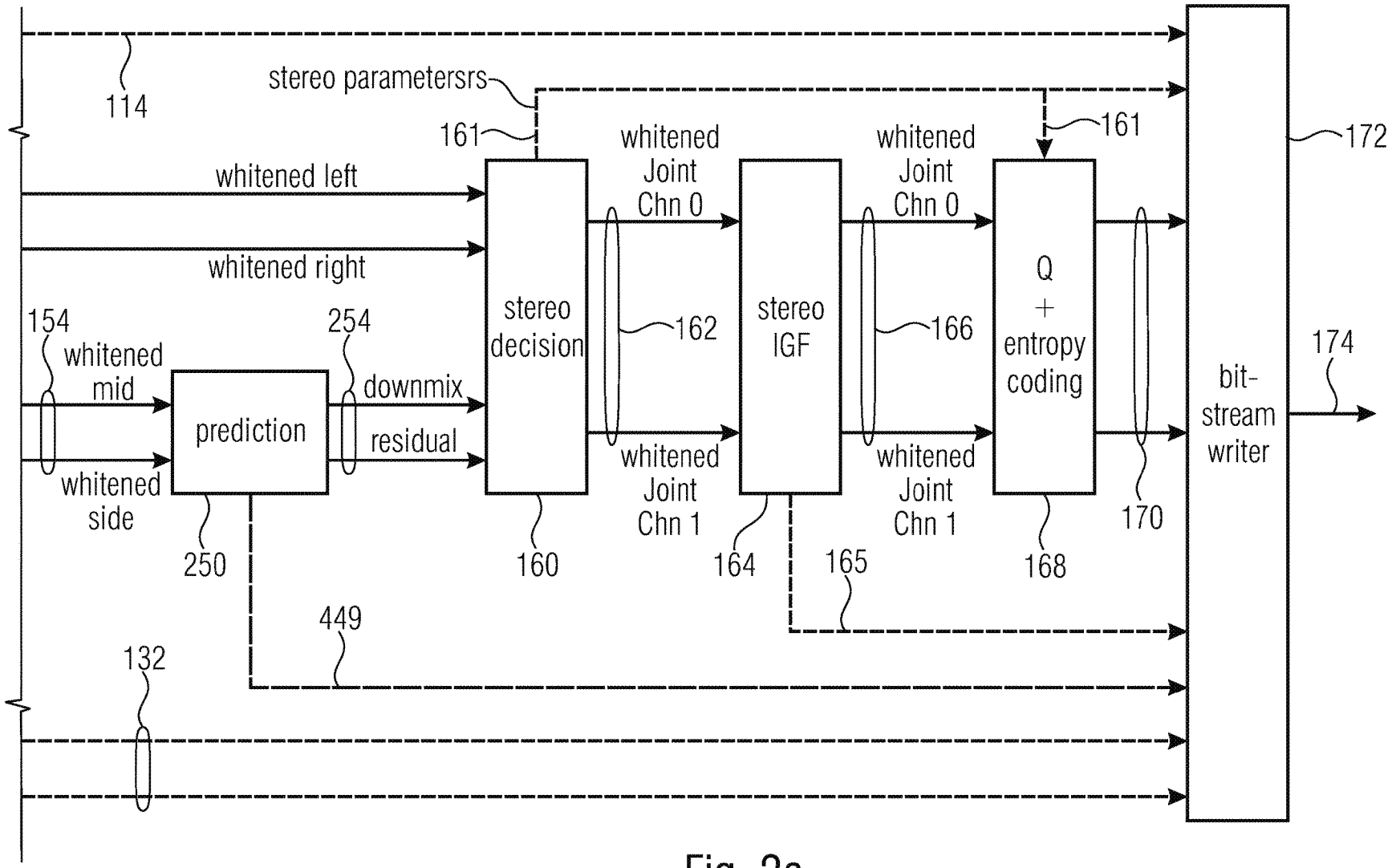
Figure 2B:
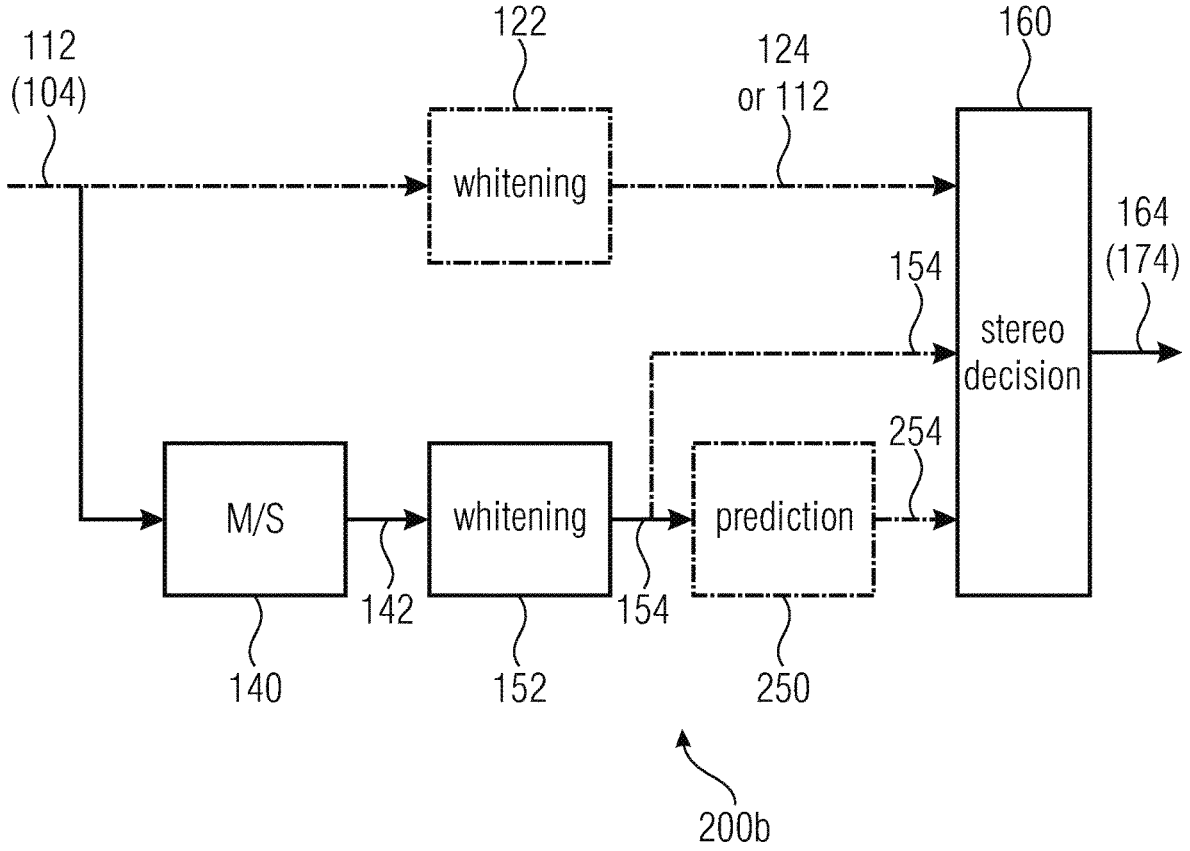
Figure 2C:
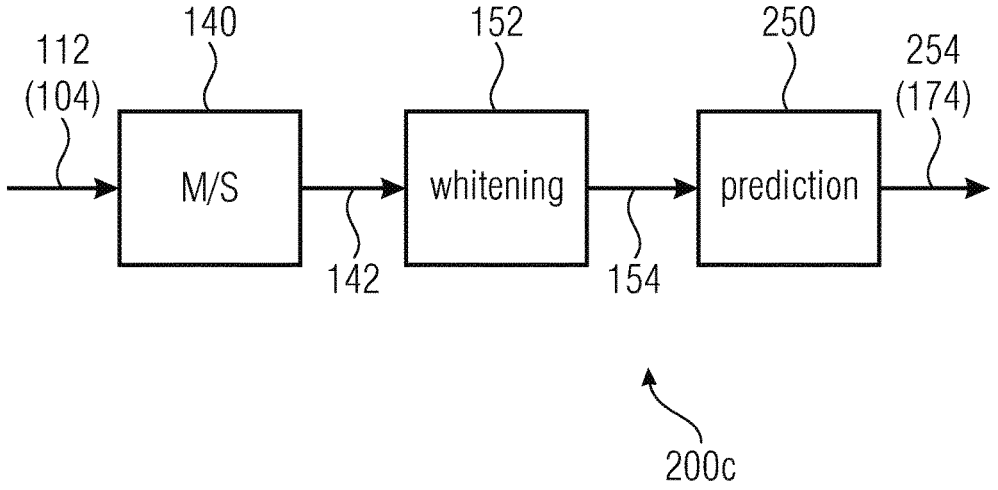

Encoders 200*b* and 200*c* (FIGS. 2*b* and 2*c*)

FIG. 2*b* shows a general example of multi-channel [e.g. stereo] audio encoder 200*b*, which may be understood as a variant of the encoder 100*b*. Therefore, the description and the explanations are not repeated for the features that can be common to that embodiment: any of the features, examples, variations, possibilities, and assumptions made for the encoder 100*b* may be valid for any of the blocks of the encoder 200*b* (or for the encoder 200*b* as a whole). A more complete detailed of an embodiment of FIG. 2*b* is shown in FIG. 2*a*.

In FIG. 2*b* some elements are represented in dot-and-line (e.g., the first whitening block 122; the line "124 or 112" connecting the first whitening block 122; the line 154 bypassing the prediction block 250; the prediction block 250; and the connection 254 between the prediction block 250 and the stereo decision block 160) are elements which are used in some examples, and are skipped in some other examples.

The encoder 200*b* the first whitening block 122 may be skipped in some examples (hence, the stereo decision block 160 may take into consideration a non-whitened representation 112, in those cases, or block 160 may even be avoided).

The encoder 200*b* may include a prediction block 250 to perform a prediction providing a downmix channel and a residual channel, thus obtaining a predictive representation of the input signal 104. In examples, the prediction may imply the calculation of at least one of:

- a whitened mid signal representation [subsequently also indicated with $MDCT_{M,k}$];
- a whitened side signal representation [subsequently also indicated with $MDCT_{S,k}$];
- one or more prediction parameters [subsequently also indicated with $\alpha_{R,k}$ and also $\alpha_{I,k}$ in the case of complex prediction]; and
- a prediction residual [or prediction residual signal, or prediction residual channel] [subsequently also indicated with $E_{R,k}$] of the real prediction or of the complex prediction.

The whitened mid signal representation $MDCT_{M,k}$ and the whitened side signal representation $MDCT_{S,k}$ together form the mid side signal representation 154. The one or more prediction parameters (real or complex) form the predictive signal representation 254. It is noted that "k" refers to the particular band of the signal, since in examples different bands of the signal may be differently encoded (see below), even for the same frame.

Accordingly, a predictive encoded representation 254 of the multi-channel input audio signal 104 is obtained.

The encoder 200*b* may, at block 160, make a decision [e.g. stereo decision], which may include deciding which representation, out of a plurality of the different representations of the multi-channel input audio signal [e.g. out of two or more of a separate-channel representation, a mid-side-representation in the form of a mid channel and a side channel, and a mid-side representation in the form of a downmix channel and a residual channel and one or more prediction parameters] 104, is encoded.

In examples, the decision may be among at least two of the following representations of the signal 104:

- the whitened version 124 of the separate-channel representation 112 (or directly the separate-channel representation 112 in the examples which provide for this possibility) (this choice is not possible in the examples which lack both block 122 and the connection "124 or 112" in FIG. 2*b*);
- the whitened mid-side-representation 154 in the form of a mid-channel and a side channel (this choice is not possible in the examples which lack connection 154); and
- the mid-side representation 254 in the form of a downmix channel and a residual channel and one or more prediction parameters (this choice is not possible in the examples which lack the prediction block 250 and the connection 254).

Hence, the encoded representation of the multi-channel input audio signal 104 may be decided in dependence on a result of the real prediction or of the complex prediction.

It is noted that this decision may be performed, for example, band-by-band (see above for the encoder 100*b*) or for all the bands of the same frame. Also here the frames may be in the FD (e.g. MDCT, MDST, etc.) and may be at least partially overlapped.

FIG. 2*c* shows another example of encoder 200*c* in which blocks 122 and 160 are not present. The encoder 200*c* applies a real prediction 250 or a complex prediction 250 to a whitened mid-side representation 154 of the multi-channel input audio signal 104, in order to obtain one or more prediction parameters (not shown) and a prediction residual signal 254. The encoder 200*c* encodes one of the whitened mid signal representation 154 and of the whitened side signal representation 154, and the one or more prediction parameters (not shown) and a prediction residual 254 of the real prediction 250 or of the complex prediction 250. Accordingly, the encoded representation 174 of the multi-channel input audio signal 104 may be obtained.

Apart from the features associated to the decision block 160 and the possibility of encoding the whitened L/R representation 122, the encoder 200*c* may have any of the features of the embodiments discussed above and below.

Figure 3A:
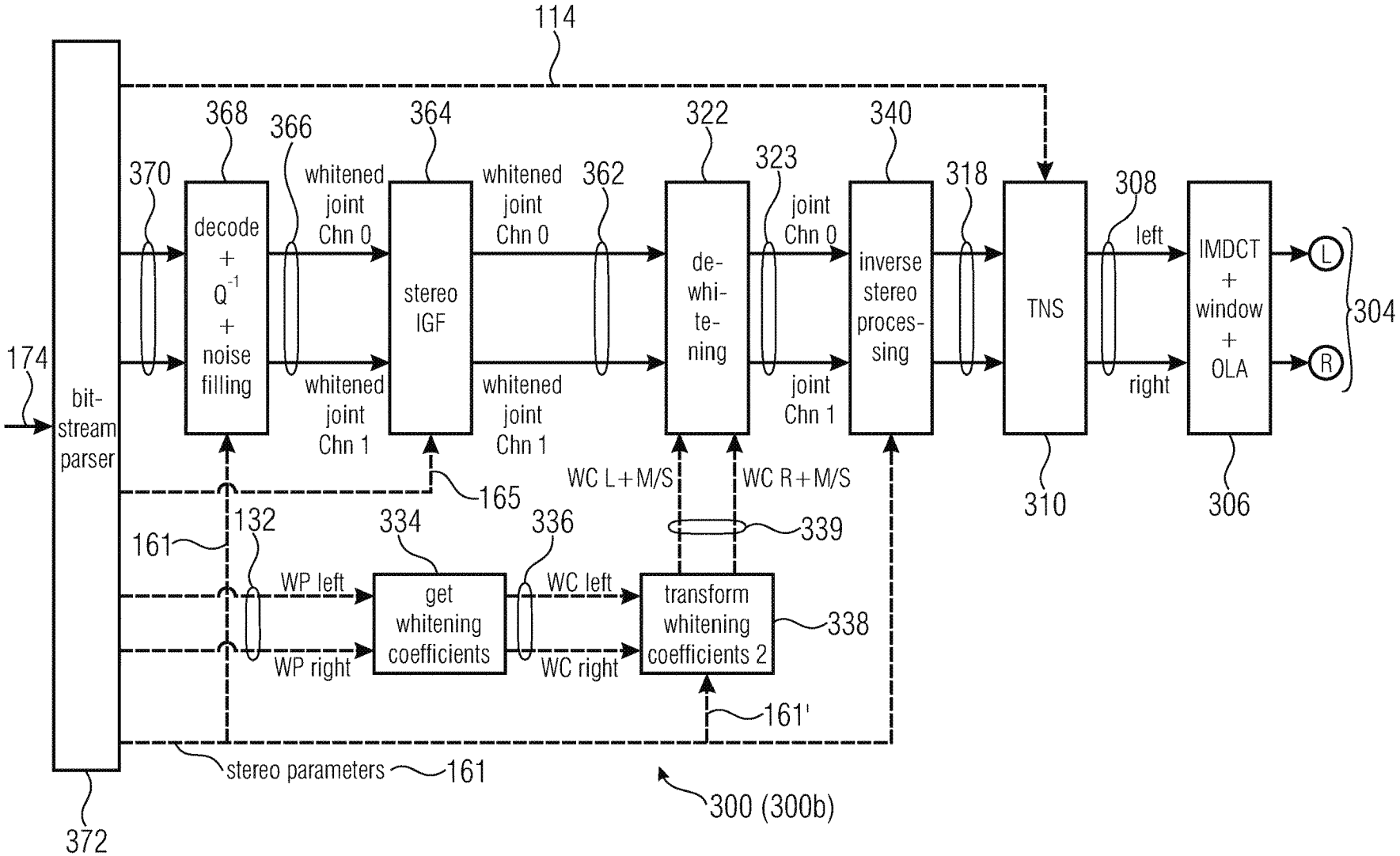
FIGS. 3*a*, 3*b*, and 4 show examples of audio decoders.
Figure 3B:
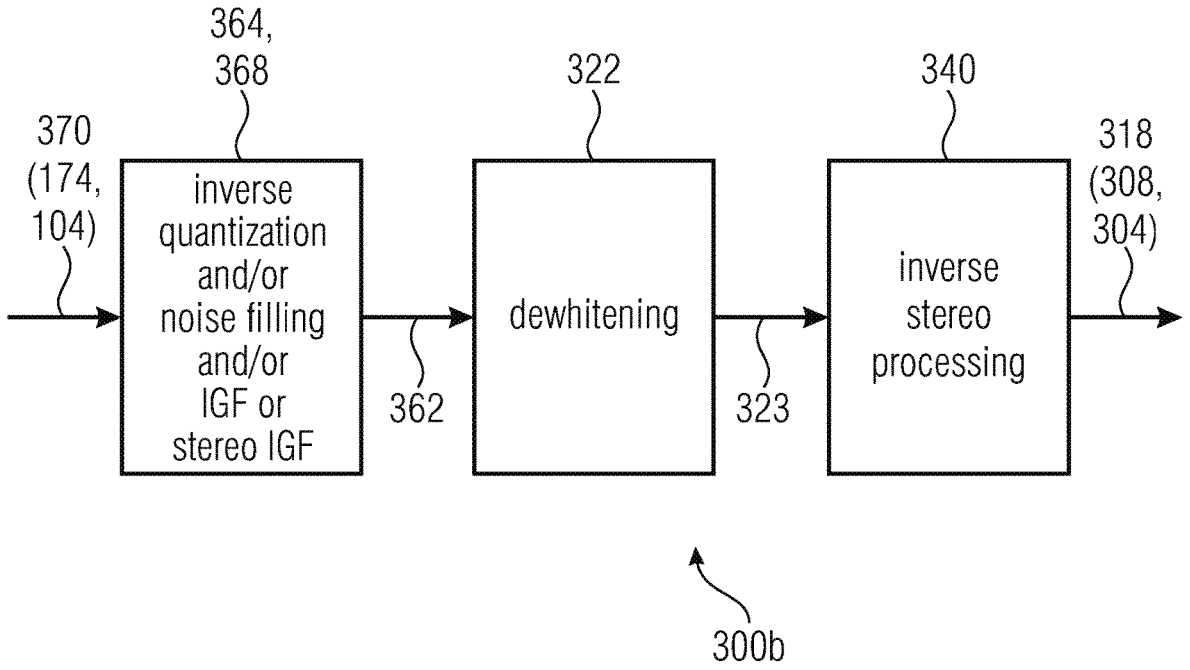

Decoder 300*b* (FIG. 3*b*)

FIG. 3*b* shows a general example of multi-channel [e.g. stereo] audio decoder 300*b*. The decoder 300*b* may include several components, some of which may be non-shown in FIG. 3*b*. An example of the decoder 300*b* is the decoder 300 of FIG. 3*a*. In FIG. 3*b*, multi-channel signals are shown with one single line, while in FIG. 3*a* they are shown in multiple lines. To maintain the schematization easy, parameter lines are not shown in FIG. 3*b*. The input signal is here indicated with 174, and may be the bitstream generated by any of the encoders 100 and 100*b*, for example, representing the original input signal 104. The output signal of the decoder 300*b* appears to be 308 or 318: it may happen that some additional processing is performed downstream to the signal 308 or 318, to obtain a final audio output signal 304 (which may be, for example, played back to a user).

The bitstream 174 may be subdivided into consecutive frames. For each frame, the signal 104 may be subjected to a conversion to a frequency domain, FD, representation (e.g. MDCT, MDST, MCLT etc.), so as to be in the FD. In some cases, two consecutive frames may at least partially overlap (as in lapped transformations). Each frame may be divided into multiple bands (frequency ranges), each grouping at least one or more bins.

The multi-channel [e.g. stereo] audio decoder 300*b* may provide a decoded representation [e.g. a time-domain signal or a waveform] 308 of a multi-channel audio signal 104 on the basis of an encoded representation (e.g. bitstream) 174.

At block 364, 368, the multi-channel audio decoder 300*b* may be configured to derive (e.g. obtain) a mid-side representation [e.g. Whitened Joint Chn 0 and Whitened Joint Chn1] 362 of the multi-channel audio signal 104 from the encoded representation 174. In order to achieve this goal, there may be used at least one of decoding and an inverse quantization $Q^{-1}$, a noise filling (e.g. optional), and using a multi-channel IGF or stereo IGF (e.g. also optional).

The decoder 300*b* may be configured, at the dewhitening block 322, to apply a spectral de-whitening [or more in general a dewhitening] to the [encoder-sided whitened] mid-side representation [e.g. Whitened Joint Chn 0, Whitened Joint Chn 1] 362 of the multi-channel audio signal 104, to obtain a dewhitened representation 323 of the multi-channel input audio signal 104. The dewhitened representation 323 may be a mid-side representation or a separate-channel representation. It is to be noted that the dewhitening is either a dewhitening for a "dual mono" signal representation or a dewhitening for a "mid side" signal representation, according to the signal representation chosen at block 160 of the encoder (and according to side information provided in the bitstream 174).

The decoder 300*b* may be configured to derive (e.g. obtain) a separate-channel representation 308 of the multi-channel audio signal 104 on the basis of the dewhitened mid-side representation 323 of the multi-channel audio signal 322 [e.g. using an "Inverse Stereo Processing" at block 340].

Encoder 100 (FIG. 1*a*)

FIG. 1*a* shows an encoder 100 which may be a particular example of the encoder 100*b* of FIG. 1*b*. In this figure, multiple channels are indicated by multiple lines. The encoder 100 may generate (e.g. at the bitstream writer 172) the bitstream 174.

The multi-channel input audio signal 104 may be provided, for example, from a multi-channel microphone, e.g. a microphone having a Left channel L and a Right channel R. The multi-channel input audio signal 104 may, notwithstanding, be provided from a storage unit (e.g., a flash memory, a hard disk, etc.) or through a communication means (e.g. a digital communication line, a telephonic line, a wireless connection, as Bluetooth, WiFi, etc.).

The multi-channel input audio signal 104 may be in the time domain (TD), and may include a plurality of samples acquired at subsequent discrete time instants.

At block 106, the multi-channel input audio signal 104 may be converted into the frequency domain (FD), to obtain a FD representation 108 of the input signal 104. Accordingly, the TD values of a plurality of samples may be converted into an FD spectrum, e.g. including a plurality of bins. The conversion may be, for example, a modified discrete cosine transform (MDCT) conversion, modified discrete sine transform (MDST) conversion, modulated complex lapped transform (MCLT), etc.

The conversion may be subjected to windowing. Windowing parameters (e.g. window length) may be signaled in the bitstream 174 (not shown in the figures for the sake of simplicity, and being as such well-known).

The FD representation 108 of the input signal 104 also includes a Left channel and a Right channel and is therefore a separate-channel representation of the input signal 104. The FD spectrum of each frame may be indicated with $MDCT_{L,k}$, referring to a k-th coefficient (bin or band) of the MDCT spectrum in the Left channel and $MDCT_{R,k}$ referring to a k-th coefficient (bin or band) of the MDCT spectrum in the Right channel (of course, analogous notation could be used for other FD representations, such as MDST, etc.). The spectrum may be, in some cases, divided into bands (each band grouping one or more bins). In some cases, the FD version 108 is already present (e.g., obtained from a storage unit) and does not need to be converted (hence, in some cases, block 106 is not necessary).

The encoder 100 may be configured, e.g. at TNS block 110, to perform a temporal noise shaping ($TNS^{-1}$) on the FD representation 108 of the input signal 104. The $TNS^{-1}$ may be, for example, like in [9]. A noise-shaped version 112 of the multi-channel input audio signal 104 may therefore be generated by TNS block 110. TNS parameter(s) 114 may be signaled in the bitstream 174, e.g. as side information. If TNS block 110 is not present, the signal representation 112 can be the same to the signal representation 108.

The encoder 100 may be configured, e.g. at ILD compensation block 116, to perform an inter-channel level difference compensation [ILD compensation] to the signal representation 108 or 112 of the input signal 104, which may provide a normalized version [e.g. including a normalized Left channel and a normalized Right channel] 118 of the input signal 104. The ILD compensation may be so that the louder channel between the Left channel and the Right channel of the signal representation 108 (or 112) is downscaled. A parameter 120 associated to the ILD compensation may be signaled (i.e. encoded in the bitstream 174).

An example of global ILD processing is used then single global ILD is calculated, for example, for a generic frame, as $$NRG_L = \sqrt{\sum MDCT_{L,k}^2}$$

$$NRG_R = \sqrt{\sum MDCT_{R,k}^2}$$

$$ILD = \frac{NRG_L}{NRG_L + NRG_R}$$

where $MDCT_{L,k}$ is the k-th coefficient of the MDCT spectrum in the left channel and $MDCT_{R,k}$ is the k-th coefficient of the MDCT spectrum in the right channel. The global ILD may be, for example, uniformly quantized:

$$\widehat{ILD} = \max(1, \min(ILD_{range} - 1, \lfloor ILD_{range} \cdot ILD + 0.5 \rfloor))$$

$$ILD_{range} = 1 \ll \mathrm{ILD}_{bits}$$

where $\mathrm{ILD}_{bits}$ is, for example, the number of bits used for coding the global ILD and [. . . ] is the floor (integer part of the argument). The expression $\mathrm{ILD}_{range}=1<<\mathrm{ILD}_{bits}$ refers to a bit-wise shift towards left and implies that $\mathrm{ILD}_{range}=2^{ILD_{bits}}$. $\widehat{r_{split}}$ may be, for example, stored in the bitstream 174 as the parameter 120, so as to permit the decoder to reconstruct the original value of the Right channel or Left channel. Energy ratio of channels is then, for example:

$$\mathrm{ratio}_{ILD} = \frac{ILD_{range}}{\widehat{ILD}} - 1 \approx \frac{NRG_R}{NRG_L}$$

If $\mathrm{ratio}_{ILD}>1$ then, for example, the right channel is scaled with (multiplied by)

$$\frac{1}{\mathrm{ratio}_{ILD}},$$

otherwise, for example, the left channel is scaled with (multiplied by) $\mathrm{ratio}_{ILD}$. This effectively means that the louder channel is downscaled by a scaling factor smaller than 1.

The signal representation 118 may therefore be obtained, the louder of the channels of the signal representation 112 (or 108) being downscaled. A parameter (e.g. $\widehat{r_{split}}$ ) may be signaled in the bitstream 174 as one of the stereo parameters 120.

In general terms, the inter-channel level difference compensation block 116 may be understood as determining an information (parameter, value . . . ) 120, e.g. ILD, describing a relationship, e.g. a ratio, between intensities, e.g. energies, of two or more channels of the input audio representation of the input signal 104 (the input audio representation may be the signal representation 108 and/or 112). Further, the inter-channel level difference compensation block 116 may be understood as scaling one or more of the channels of the input audio representation 108 or 112, to at least partially compensate energy differences between the channels of the input audio representation 108 or 112, in dependence on the information or parameter or value 120 describing the relationship between intensities of two or more channels of the input audio representation 108 or 112. The intermediate value $\mathrm{ratio}_{ILD}$ may be used (e.g. directly as $\mathrm{ratio}_{ILD}$ or reciprocated as $1/\text{ratio}_{ILD}$), which is derived from ILD, and may be considered a quantization of ILD.

In the case of two single channels, it is enough to scale one single channel (e.g. the louder one), while the other one may be maintained as it is, e.g. without modification respect to the same channel in the signal representation 112 (or 108 if the $TNS^{-1}$ block 110 is missing).

The encoder 100 may comprise a first whitening block [e.g. spectral whitening block] 122, which may be configured to whiten the normalized separate-channel representation 118 (or one of the signal representations 108 or 112), so as to obtain a whitened separate-channel representation [e.g. whitened Left and whitened Right] 124.

The first whitening block 122 may use whitening coefficients 136 (obtained from whitening parameters 132, which may be based on the FD representation 108 of the input signal 104, e.g., upstream to the TNS block 110 and/or the ILD compensation block 116). In examples, the coefficients 136 may be obtained from blocks such as blocks 130, 134 and/or 138 (see below). Hereinbelow, reference is made to coefficients 139 as the coefficients for whitening the mid side signal representation 142, and to coefficients 136 as the coefficients for whitening the left right signal representation 118 (the coefficients 139 being advantageously obtained from the coefficients 136 at block 138).

The encoder 100 may comprise a mid-side (M/S) generation block 140 to generate a mid-side representation [e.g. Mid, Side] 142 from the non-whitened separate-channel representation [e.g., Left, Right] 118 (or from any of the signal representations 108 and 112).

The channels of the mid-side representation 142 may be obtained, for example, as linear combinations of the channels of the normalized separate-channel representation 118 (or one of the signal representations 108 or 112). For example, the mid channel $MDCT_{M,k}$ and the side channel $MDCT_{S,k}$ of the k-th band (or bin) of the mid-side representation 142 may be obtained from the left channel $MDCT_{L,k}$ and right channel $MDCT_{R,k}$ of the k-th band (or bin) of the normalized separate-channel representation 118 by $$MDCT_{M,k} = 1/\sqrt{2}\,(MDCT_{L,k} + MDCT_{R,k})$$

$$MDCT_{S,k} = 1/\sqrt{2}\,(MDCT_{L,k} - MDCT_{R,k}).$$

It could also be possible to exchange $MDCT_{L,k}$ with $MDCT_{R,k}$. Other techniques are possible. In particular, it is possible to generalize this result when using the KLT (Karhunen-Loève Transform)

The encoder 100 may comprise a second whitening block 152 [e.g. spectral whitening block] 122, which may be configured to whiten the mid-side representation [e.g. Mid, Side], so as to obtain a whitened mid-side representation 154 [e.g. Whitened Mid, Whitened Side] of the signal 104.

The second whitening block 152 may use whitening coefficients 139 (obtained from the whitening parameters 132) which may be based on the FD representation 108 of the input signal 104 (e.g., upstream to the TNS block 110 and/or the ILD compensation block 116). In examples, the coefficients 139 may be obtained from blocks such as blocks 130 and 134 (see below).

At the stereo decision block 160, the encoder 100 (or 100*b*) may decide which representation of the input signal 104 is to be encoded in the bitstream 174. The output of the block 160 [Whitened Joint Chn0 and Whitened Joint Chn1] is the signal representation 162 (the signal representation 162 is also a "spectrum", and may comprise or consist of two spectra: one spectrum for Whitened Joint Chn0, and one other spectrum for Whitened Joint Chn1). The signal representation 162 may be a selection among the signal representation 124 and the signal representation 154. E.g.:

- while Whitened Joint Chn0 may be one of Whitened Left of the signal representation 124 and Whitened Mid of the signal representation 154,
- Whitened Joint Chn1 may, correspondently, be one of Whitened Right of the signal representation 124 and Whitened Side of the signal representation 154.

For example, the stereo decision block 160 may select (either bandwise or for the whole band) one among:

- the whitened separate-channel representation [e.g. whitened Left and whitened Right] 124 of the multi-channel input audio signal 104 (and the signal 162 may therefore be the same of the signal 124); and
- the whitened mid-side representation 154 [e.g. Whitened Mid, Whitened Side] of the multi-channel input audio signal is obtained (and the signal 162 may therefore be the same of the signal 154).

For example, the stereo decision block 160 may determine and/or estimate:

- a total number of bits, e.g. $b_{LR}$ which would be needed for encoding the whitened separate-channel representation 124 for all spectral bands ("full dual mono mode", also called "full L/R mode");
- a total number of bits, e.g. $b_{MS}$, which would needed be for encoding the whitened mid-side representation for all spectral bands ("full M/S mode", also called); and
- (in some examples, also) a total number of bits, e.g. $b_{BW}$, which would be needed for encoding the whitened separate-channel representation 124 of one or more spectral bands and for encoding the whitened mid-side representation 154 of one or more spectral bands (which would also imply encoding an information signaling whether the whitened separate-channel representation or the whitened mid-side information is encoded) ("band-wise M/S mode").

By evaluating these estimations and/or determinations (e.g., by comparison of $b_{LR}$, $b_{MS}$, and $b_{BW}$), it is possible to decide the most advantageous mode (e.g., preference may be given to the mode implying the least number of bits among full dual mono mode, full M/S mode, and band-wise M/S mode).

Optionally, for each quantized channel required, a number of bits for arithmetic coding may be estimated, for example, as for example described in "Bit consumption estimation" in [9]. Estimated number of bits for "full dual mono" ($b_{L,R}$) may be, for example, equal to the sum of the bits required for the Right and the Left channel. Estimated number of bits for "full M/S" ($b_{MS}$) may be, for example, equal to the sum of the bits required for the Mid and the Side channel if the prediction is not used. Estimated number of bits for "full M/S" ($b_{MS}$) may be, for example, equal to the sum of the bits required for the Downmix and the Residual channel if the prediction is used.

In an example of the "band-wise M/S mode", for each band i with borders $lb_i$ and $ub_i$, (this can be indicated with the typical symbology for an interval, i.e.: $[lb_i, ub_i]$) the block 160 may check how many bits ($b_{bwLR}{}^i$) would be used for coding the quantized signal (in the band) in "L/R mode" (which is the same of the "full dual mono mode") and how many bits ($b_{bwMS}{}^i$) would be needed in "M/S mode". For example, the number of required bits for arithmetic coding may be estimated as described in [9]. For example, the total number of bits required for coding the spectrum in the "band-wise M/S" mode ($b_{BW}$) (in which for each band it is decided whether to use the signal representation 124 or 154) may be understood as being equal to the sum of $\min(b_{bwLR}^i, b_{bwMS}^i)$:

$$b_{BW} = n\text{Bands} + \sum_{i=0}^{nBands-1} \min(b_{bwLR}^i, b_{bwMS}^i)$$

where min(. . . , . . . ) outputs the minimum among the arguments. The "band-wise M/S mode" needs, for example, additional nBands bits for signaling in each band whether L/R or M/S coding is used. Contrary to the "band-wise M/S mode", the "full dual mono mode" and the "full M/S mode" don't need additional bits for signaling, as it is already known for each band whether the signal representation 124 or 154 is chosen.

Figure 5:
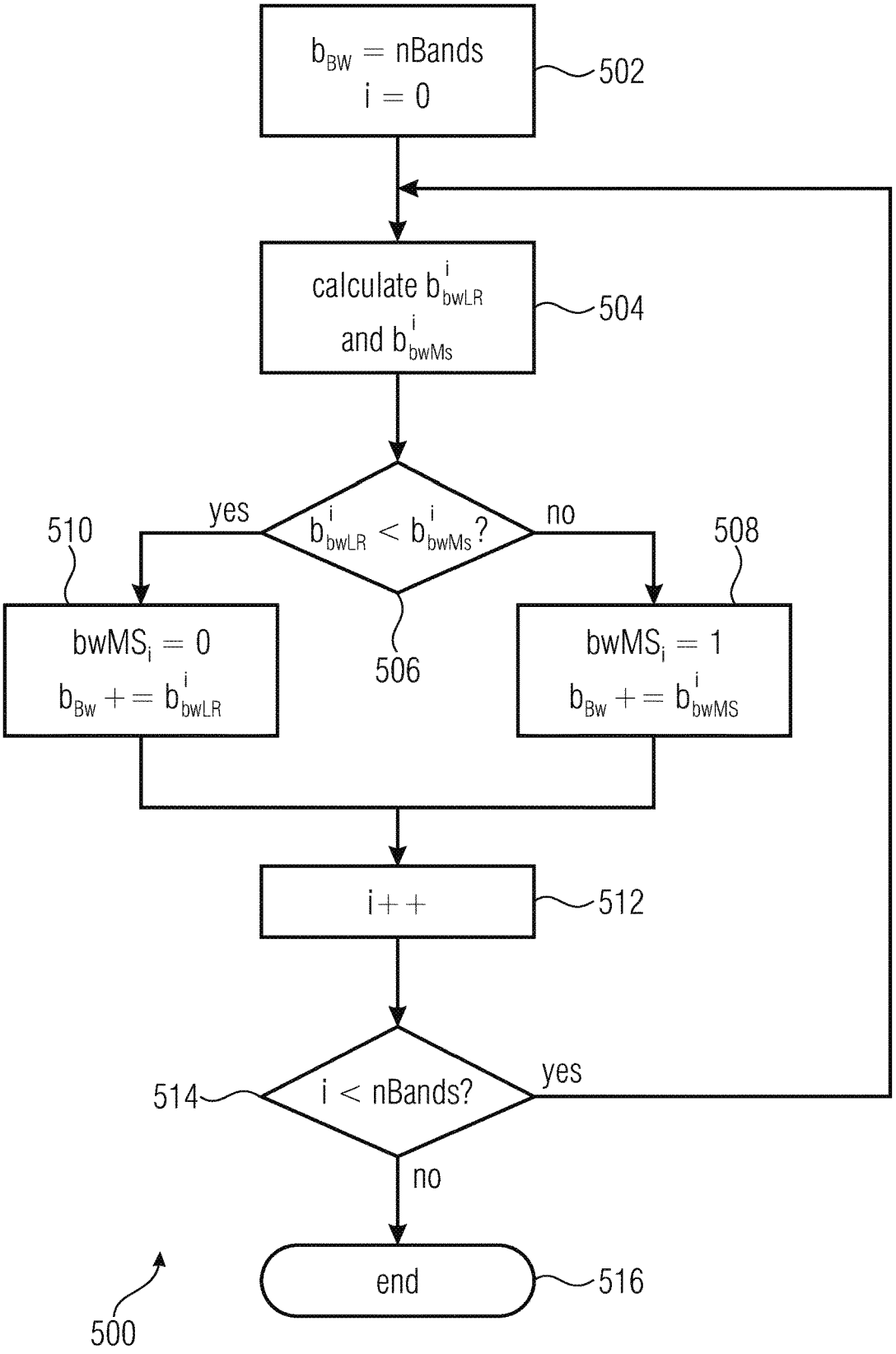
FIGS. 5 and 6 show methods used at the encoder.

A procedure 500 for calculating the total number of bits required for coding the spectrum in the "band-wise M/S" $b_{BW}$ is depicted, for example, in FIG. 5 This process 500 is used for "band-wise M/S mode" (i.e. when for each band i it is determined whether to use the L/R signal representation 124 or the M/S signal representation 154).

To reduce the complexity, for example, arithmetic coder context for coding the spectrum up to band i−1 is saved and reused in the band i (see, for example, [6]).

At step 502, initializations may be performed (e.g., band i=0 is chosen; and $b_{BW}$ is given the value nBands).

At step 504, the needed bits for "L/R mode" ($b_{bwLR}^i$) and "M/R mode" ($b_{bwMS}^i$) may be estimated and/or determined (e.g., by in dependence on the signal representations 124 and 154, respectively) for the band i.

At step 506, the specific band i, the number of bits $b_{bwLR}^i$ (needed for encoding the L/R signal representation 124 onto the bitstream 174) is compared with the number of bits $b_{bwMS}^i$ (which are needed for encoding the M/S signal representation 154 onto the bitstream 174).

If, at step 506, it is verified that the number of bits $b_{bwLR}^i$ (for encoding L/R signal representation 124) is less than the number of bits $b_{bwMS}^i$ (for encoding the M/S signal representation 154), then $b_{BW}$ is updated, at step 510, by adding $b_{bwLR}^i$. Else, if it is verified that $b_{bwLR}^i$ is larger than $b_{bwMS}^i$, then $b_{BW}$ is updated, at step 508, by adding $b_{bwMS}^i$. Even if not shown in FIG. 5, in case $b_{bwLR}^i = b_{bwMS}^i$, any of steps 510 and 508 may be chosen.

At step 512, a new band i ++is chosen (e.g., the value i may be updated to take the which previously was i+1; for example, if, before step 512, it was i=5, at step 512 it becomes i=6).

At step 514, it is verified whether all the bands have been chosen. If the bands remain to be processed (i.e. "YES" at 514), then the procedure iterates back to step 504. If at step 514 it is verified that no bands are left to be processed, then the procedure stops at step 516.

At the end of the procedure 500, the value $b_{BW}$=nBands+ $\Sigma_{i=0}^{nBands-1} \min(b_{bwLR}^i, b_{bwMS}^i)$ is obtained, thus obtaining the information on the number of bits ($b_{BW}$) needed for providing the signal representation 162 bandwise.

Figure 6:
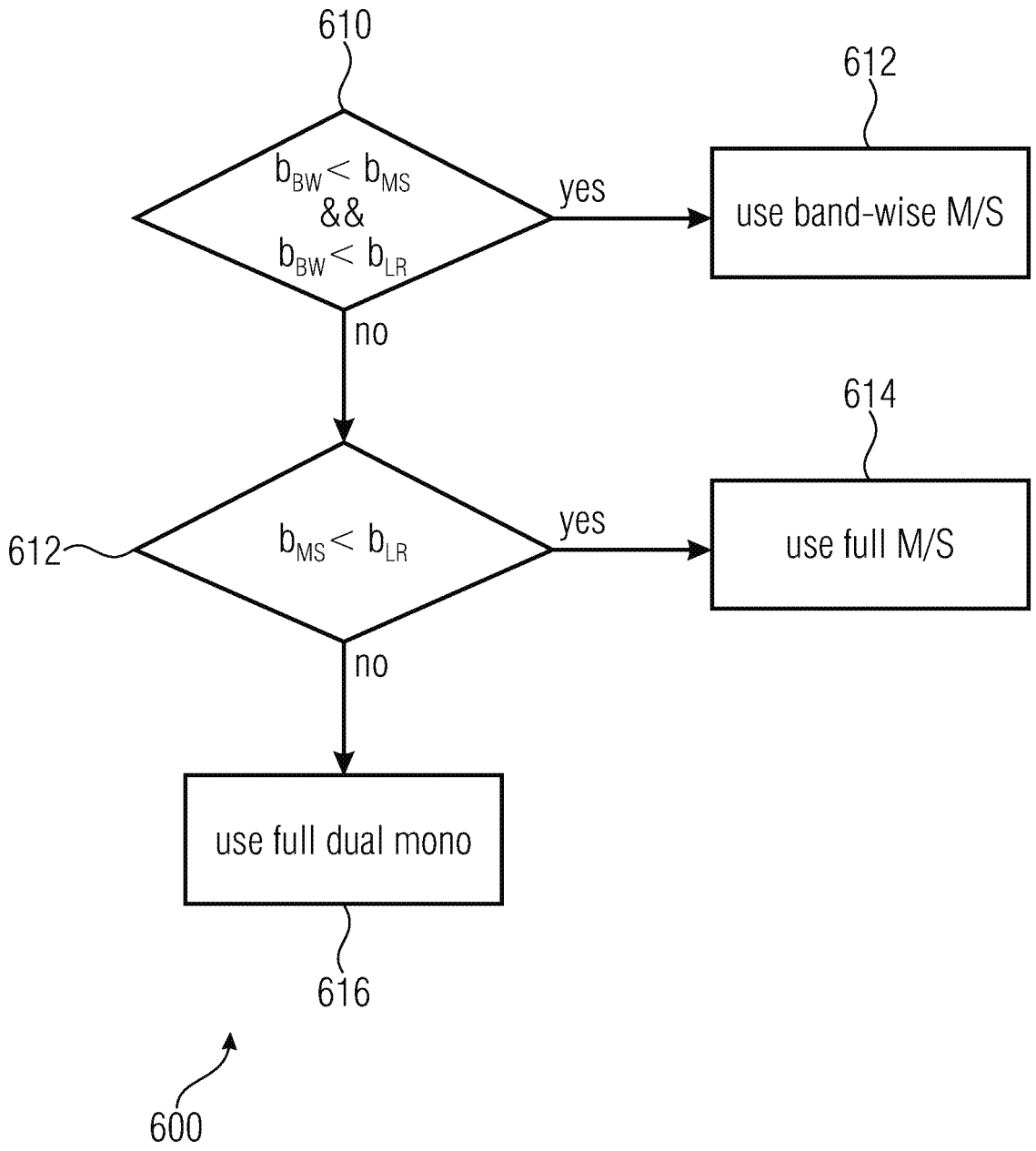

FIG. 6 shows a procedure 600 for actually choosing whether to provide the signal representation of the signal 104 in "full dual mono mode" (also called "full L/R mode"), "full M/S mode", or "bandwise M/S mode".

At step 610, it is verified whether the number of bits $b_{BW}$ for the bandwise "bandwise M/S mode" is less than the number of bits $b_{LR}$ for the "full dual mono mode" and the number of bits $b_{MS}$ for the "bandwise M/S mode". If verified, then the "bandwise M/S mode" is chosen at step 612, and the signal representation 162 (and the bitstream 174, as well) will, for each band, include either the signal representation 124, or the signal representation 154, according to the case.

Otherwise, at step 612 it is verified whether the number of bits $b_{MS}$ for the "full M/S mode" is less than the number of bits $b_{LR}$ for the "full dual mono mode". If verified, then the "full M/S mode" is chosen at step 614, and the signal representation 162 (and the bitstream 174) will, for all bands, include only the signal representation 154. Otherwise, at step 616 the "full dual mono" is chosen, and the signal representation 162 (and the bitstream 174) will, for all bands, include only the signal representation 124.

The comparisons of any of steps 506, 610, 612 may be adapted to keep into consideration the possibilities of having the same number of bits (e.g., "≤" instead of "<" and/or "≥" instead of ">", etc.).

The procedures 500 and 600 may be repeated, for example, for each frame or for a consecutive number of frames.

In other words, if "full dual mono mode" is chosen then the complete spectrum 162 consists, for example, of $MDCT_{L,k}$ and $MDCT_{R,k}$. If "full M/S mode" is chosen then the complete spectrum 162 consists, for example, of $MDCT_{M,k}$ and $MDCT_{S,k}$. If "band-wise M/S" is chosen then some bands of the spectrum consist, for example, of $MDCT_{L,k}$ and $MDCT_{R,k}$ and other bands consist, for example, of $MDCT_{M,k}$ and $MDCT_{S,k}$. All these assumptions may be valid, for example, for one single frame or group of consecutive frames (and may differ from frame to frame or from group-of-frames to group-of frames).

The stereo mode is, for example, coded in the bitstream 174 and signaled as side information 161. In "band-wise M/S" mode also band-wise M/S decision is, for example, coded in the bitstream.

The coefficients of the spectrum 162 in the two channels after the stereo processing may be, for example, denoted as $MDCT_{LM,k}$ and $MDCT_{RS,k}$. $MDCT_{LM,k}$ is equal to $MDCT_{M,k}$ in M/S bands or to $MDCT_{L,k}$ in L/R bands and $MDCT_{RS,k}$ is equal to $MDCT_{S,k}$ in M/S bands or to $MDCT_{R,k}$ in L/R bands, depending, for example, on the stereo mode and band-wise M/S decision. The spectrum comprising or consisting, for example, of $MDCT_{LK,k}$ (e.g. either left or mid) is called jointly coded channel 0 (Joint Chn 0) and the spectrum comprising or consisting, for example, of $MDCT_{RS,k}$ (e.g. either right or side) is called jointly coded channel 1 (Joint Chn 1).

In addition or alternative, at the stereo decision block 160, it is possible to further change the number of bits allocated to the different channels of the whitened signal representation: for example, the multi-channel audio encoder 100 (100*b*) may determine an allocation of bits [e.g. a distribution of bits or a splitting of bits] to two or more channels of the whitened separate-channel representation [e.g. Whitened Left and Whitened Right] and/or to two or more channels of the whitened mid-side representation [e.g. Whitened Mid and Whitened Side, or Downmix]. In particular the encoder may select the bit repartition for the different channels of the selected signal representation (whether the signal representation 124 or the signal representation 154 has been chosen to be the signal representation 162 to be encoded in the bitstream 174).

In particular, the encoder may separate (e.g. independently) from the choice of the selected mode. Hence, in some examples, at block 160 there are two decisions taken independent of each other:

- A first decision (e.g., bandwise decision) whether the signal representation 162 to be encoded will be the L/R signal representation 124 or the MIS representation 154; and
- A second, subsequent decision, directed to choose how many bits to allocate for each of the selected channels of the signal representation 162.

In order to better appreciate the distinctions between the first decision and the second decision, reference can be made to FIG. 7, showing an example of block 160 in the example of FIG. 1*a*. Block 160 is representing including:

- A first decision block 160*a*, which decides whether to encode the L/R representation or M/S representation 154 (e.g. bandwise or for the whole spectrum) and outputs the signal representation 162 (Whitened Joint Channel 0, Whitened Joint Channel 1); and
- A second decision block 160*b*, which decides how to allocate a bit budget among the channels (Whitened Joint Channel 0, Whitened Joint Channel 1) of the signal representation 162.

It will be shown that parameters 161 ("stereo parameters") output by block 160 are signaled as side information in the bitstream 174 by the bitstream writer 172. The side information 161 includes information:

- 161*a* (output by subblock 161*a*), signaling whether (e.g. bandwise or for the whole spectrum), the L/R representation or M/S representation has been chosen to be encoded;
- 161*b* (output by subblock 160*b*), a parameter indicating the bit allocation among the channels (Whitened Joint Channel 0, Whitened Joint Channel 1) of the signal representation 162 ($\widetilde{r_{split}}$).

It will also be shown that the parameters 161. ("stereo parameters") are also input to the entropy coder 168 (see also below).

In order to perform the second decision, at subblock 160*b*, the multi-channel audio encoder 100 may determine numbers of bits needed for a transparent encoding. It particular, the multi-channel audio encoder 100 may allocate portions of an actually available bit budget [e.g. coming from the subtraction totalBitsAvailable-stereoBits] for the encoding in the bitstream 174 of the channels of the whitened signal representation selected (among the signal representations 124 and 154) to be encoded in the bitstream 174. This allocation may be based on the numbers of bits needed for the transparent encoding of the plurality of channels of the whitened signal representation 162 selected to be encoded.

The concept of "transparent coding" is here discussed. The bit budget can change according to the application. In some applications, transparent coding may require 96 kbps per channel may be used in an implementation. Alternatively, it could be possible to use the highest supported bitrate (application-varying). For example, a fine quantization with a fixed (single) quantization step size can be assumed, and it can be determined, how many bits are needed to encode the values resulting from said fine quantization using an entropy coding; the fixed fine quantization may, for example, be chosen such that a hearing impression is "transparent", for example, by choosing the fixed fine quantization such that a quantization noise is below a predetermined hearing threshold; the number of bits needed may vary with the statistics of the quantized values, wherein, for example, the number of bits needed may be particularly small if many of the quantized values are small (close to zero) or if many of the quantized values are similar (because context-based entropy coding is efficient in this case). So far we have assumed fine quantization with fixed quantization step size, but some elaborate psychoacoustics which would give signal dependent bitrate would be even better. Hence, the multi-channel audio encoder 100 may determine a number of bits needed for encoding (e.g. entropy-encoding) values obtained using a predetermined (e.g. sufficiently fine, such that quantization noise is below a hearing threshold) quantization of the channels of the whitened representation selected to be encoded, as the number of bits needed for a transparent encoding. The quantization step size may, for example, be one single value which is fixed, i.e. identical for different frequency bins or frequency ranges, or which may be identical for bins across the complete frequency range.

In examples, the multi-channel audio encoder 100 may, at block 160 (and in particular at subblock 160*b*), allocate portions of the actually available bit budget [totalBitsAvailable−stereoBits] for the encoding of the channels of the whitened representation selected (among 124 and 154) to be encoded in dependence on a ratio [e.g. $r_{split}$] between:

- a number of bits needed for a transparent encoding of a given channel of the whitened representation selected to be encoded [e.g. $\text{Bits}_{JointChn0}$, but in another example it could be $\text{Bits}_{Jointchn1}$]; and
- a number of bits needed for a transparent encoding of all channels of the whitened representation selected to be encoded [e.g. $\text{Bits}_{JointChn0}$ $\text{Bits}_{Jointchn1}$].

For example, the ratio value $r_{split}$ may be $$r_{split} = \frac{\text{Bits}_{JointChn0}}{\text{Bits}_{JointChn0} + \text{Bits}_{JointChn1}}$$

where $\text{Bits}_{JointChn0}$ is a number of bits needed for a transparent encoding of a first channel of a whitened representation selected to be encoded, and $\text{Bits}_{JointChn1}$ is a number of bits needed for a transparent encoding of a second channel of the whitened representation 162 selected (among 124 and 154) to be encoded in the bitstream 174.

In examples, the multi-channel audio encoder may, at block 160 (and in particular at subblock 160*b*), determine a quantized ratio value $\widetilde{ILD}$. Further, the multi-channel audio encoder may, at block 160, determine a number of bits ($\text{bits}_{LM}$) allocated to one of the channels (e.g. the channel 0 in the signal representation 162, having either the channel Whitened Left or Whitened Mid, and therefore indicated with LM) of the whitened representation 162 according to $$\text{bits}_{LM} = \left\lfloor \frac{\widetilde{r_{split}}}{\text{rsplit}_{range}} (\text{totalBitsAvailable} - \text{otherwiseUsedBits}) \right\rfloor$$

$\text{rsplit}_{range}$ is a predetermined value [which may, for example, describe a number of different values which the quantized ratio value can take.

The multi-channel audio encoder 100 may, at block 160 (and in particular at subblock 160*b*), determine a number of bits allocated to another one of the channels (e.g. the channel 1 in the signal representation 162, having either the channel Whitened Right or Whitened Side, and therefore indicated with RS) of the whitened representation 162 according to $$\text{bits}_{RS} = (\text{totalBitsAvailable} - \text{otherwiseUsedBits}) - \text{bits}_{LM}$$

"totalBitsAvailable–otherwiseUsedBits" is a subtraction which describes a number of bits which are available for the encoding of the channels of the whitened representation selected to be encoded [e.g. a total number of bits available minus a number of bits used for side information]. The side information is indicated in FIG. 1*a* with 161 (and in FIG. 7 is specified as 161*b*, to distinguish from the information 161*b* output by subblock 160*a*).

Examples of operations, e.g. for determining the splitting ratio, are here provided.

Two methods for calculating bitrate split ratio may be used:

energy based split ratio and transparency split ratio.

First the energy based split ratio is described. The bitrate split ratio is, for example, calculated using the energies of the stereo processed channels:

$$NRG_{LM} = \sqrt{\sum MDCT_{LM,k}^2}$$

$$NRG_{RS} = \sqrt{\sum MDCT_{RS,k}^2}$$

$$r_{split} = \frac{NRG_{LM}}{NRG_{LM} + NRG_{RS}}$$

The bitrate split ratio may be, for example, uniformly quantized:

$$\widehat{ILD} = \max(1, \min(r\text{split}_{range}-1, \lfloor r\text{split}_{range} \cdot r_{split} + 0.5 \rfloor))$$

$$r\text{split}_{range} = 1 << r\text{split}_{bits}$$

where $r\text{split}_{bits}$ is the number of bits used for coding the bitrate split ratio. The formula $r\text{split}_{range}=1<<r\text{split}_{bits}$ refers to a bitwise shift, i.e. $r\text{split}_{range}=2^{r\text{split}_{bits}}$.

For example, if $$r_{split} < \frac{8}{9} \text{ and } \hat{r}_{split} > \frac{9r\text{split}_{range}}{16}$$

then $\widehat{ILD}$ is decreased for $$\frac{r\text{split}_{range}}{8}.$$

If $$r_{split} > \frac{1}{9} \text{ and } \hat{r}_{split} < \frac{7r\text{split}_{range}}{16}$$

then $\widehat{ILD}$ is increased for $$\frac{r\text{split}_{range}}{8}.$$

$\widehat{ILD}$ is, for example, stored in the bitstream.

The bitrate distribution among channels is, for example:

$$\text{bits}_{LM} = \left\lfloor \frac{\hat{r}_{split}}{r\text{split}_{range}} (\text{totalBitsAvailable} - \text{stereoBits}) \right\rfloor$$

$$\text{bits}_{RS} = (\text{totalBitsAvailable} - \text{stereoBits}) - \text{bits}_{LM}$$

Additionally it is optionally made sure that there are enough bits for the entropy coder in each channel by checking that $\text{bits}_{LM}-\text{sideBits}_{LM}>\text{minBits}$ and $\text{bits}_{RS}-\text{sideBits}_{RS}>\text{minBits}$, where minBits is the minimum number of bits required by the entropy coder. For example, if there is not enough bits for the entropy coder then $\widehat{ILD}$ is increased/decreased by 1 till $\text{bits}_{L,M}-\text{sideBits}_{L,M}>\text{minBits}$ and $\text{bits}_{RS}-\text{sideBits}_{RS}>\text{minBits}$ are fulfilled.

The transparency split ratio is described now. In this method all stereo decisions are based on the assumption that enough bits are available for transparent coding, for example 96 kbps per channel. For example, the number of bits needed for coding Joint Chn 0 and Joint Chn 1 is then estimated. It is estimated using the $G_{trans0}$ and $G_{trans1}$ (which may be collectively indicated with $G_{trans}$) may be used for the quantization and the transparency split ratio is, for example, calculated as:

$$r_{split} = \frac{\text{Bits}_{JointChn0}}{\text{Bits}_{JointChn0} + \text{Bits}_{JointChn1}}$$

$G_{trans}$ is the quantization step size (it is the same among different frequencies, even though there may be different ones among different frames), also called global gain in EVS standard. $\text{Bits}_{JointChn0}$ is "the number of bits needed for coding Joint Chn 0". $\text{Bits}_{JointChn1}$ is "the number of bits needed for coding Joint Chn 1". $\text{Bits}_{Jointchn0}$ and $\text{Bits}_{JointChn1}$ are estimated using a quantization step size $G_{trans}$ (which is different from $G_{est}$ discussed below). $\text{Bits}_{JointChn0}$ and $\text{Bits}_{JointChn1}$ present number of bits needed for coding using an arithmetic coder. (See above, where referring to the fact that the number of bits for arithmetic coding may be estimated, for example, as for example described in "Bit consumption estimation" in [9]").

The coding of $r_{split}$ and the bitrate distribution based on the coded $\widehat{ILD}$ is then, for example, done in the same way as for the energy based split ratio.

Whatever the technique is used, the whitened joint signal representation 162, output by block 160, has an efficient partitioning of the bits.

At optional block 164 a multichannel stereo IGF technique may be implemented. IGF parameters 165 may be signaled as side information in the bitstream 174. The output of block 164 is the signal representation 166 (in case block 164 is not present, it is possible to substitute the signal representation 166 with the signal representation 162). A power spectrum P (magnitude of the MCLT) may be, for example, used for the tonality/noise measures in the quantization and Intelligent Gap Filling (IGF), for example as described in [9].

Subsequently, at block 168, a quantization and/or an entropy encoding and/or noise filling are performed, so as to arrive at the quantized and/or entropy-encoded and/or noise-filled signal representation 170. Quantization, noise filling and the entropy encoding, including the rate-loop, are, for example, as described in [9]. The rate-loop can optionally be optimized using the estimated $G_{est}$. The power spectrum P (magnitude of the MCLT) is, for example, used for the tonality/noise measures in the quantization and Intelligent Gap Filling (IGF), for example as described in [9]. Since, for example, whitened and stereo processed MDCT spectrum is used for the power spectrum, the same whitening and stereo processing has to, in some cases, be done on the MDST spectrum. The same scaling based on the global ILD of the louder channel has to, in some cases, be done for the MDST if it was done for the MDCT. The same prediction has to, in some cases, be done for the MDST if it was done for the MDCT. For the frames where TNS is active, MDST spectrum used for the power spectrum calculation is, for example, estimated from the whitened and stereo processed MDCT spectrum:

$$P_k=\mathrm{MDCT}_k^2+(\mathrm{MDCT}_{k+1}-\mathrm{MDCT}_{k-1})^2.$$

The decision at block 164 may be made band-by-band (e.g. bandwise decision). The decision at block 164 may be made for each frame (or for each sequence of frames), so that different decisions may be taken at block 164 for different consecutive frames or for different consecutive sequences of frames. The effect of these decisions has consequences on the operations of block 168.

In general terms, block 168 is input (as shown in FIG. 1*a*) by parameters 161 output by block 160. In particular, keeping into account FIG. 7, bock 168 is input by:

parameters 161*b* (output by subblock 160*b*), a parameter indicating the bit allocation among the channels (Whitened Joint Channel 0, Whitened Joint Channel 1) of the signal representation 162 ($\widehat{ILD}$ ).

It is also noted that the technique at block 164 may also be performed without some features discussed above.

Some other considerations are here provided regarding examples of the multi-channel audio encoder 100 or 100*b*. As now clear:

the first spectral whitening [whitening] may be performed at block 122, and is applied to the [e.g. non-whitened] separate-channel representation 120 of the multi-channel input audio signal 104 in the frequency domain [e.g. using a scaling of transform domain coefficients, like MDCT or MDST, coefficients, Fourier coefficients, etc.]; and/or the second spectral whitening [whitening] may be performed at block 152 to the [e.g. non-whitened] mid-side representation 142 of the multi-channel input audio signal 104 in the frequency domain [e.g. using a scaling of transform domain coefficients, like MDCT or MDST, coefficients, Fourier coefficients, etc.].

Further, it is possible to make, at block 160, a band-wise decision [e.g. stereo decision] whether to encode the whitened separate-channel representation [e.g. whitened Left, whitened Right] of the multi-channel input audio signal, to obtain the encoded representation of the multi-channel input audio signal, or to encode the whitened mid-side representation [e.g. whitened Mid, whitened Side, or Downmix, Residual] of the multi-channel input audio signal, to obtain the encoded representation of the multi-channel input audio signal, for a plurality of frequency bands. Accordingly, within a single audio frame, the whitened separate-channel representation may result encoded for one or more frequency bands, and the whitened mid-side representation is encoded for one or more other frequency bands.

In addition or alternative, the decision at block 160 [e.g. stereo decision] may be a decision whether to encode the whitened separate-channel representation [e.g. whitened Left, whitened Right] of the multi-channel input audio signal for all frequency bands out of a given range of frequency bands [e.g. for all frequency bands], to obtain the encoded representation of the multi-channel input audio signal, or to encode the whitened mid-side representation [e.g. whitened Mid, whitened Side] of the multi-channel input audio signal for all frequency bands out of the given range of frequency bands, to obtain the encoded representation of the multi-channel input audio signal, or to encode the whitened separate-channel representation [e.g. whitened Left, whitened Right] of the multi-channel input audio signal for one or more frequency bands out of a given range of frequency bands and to encode the whitened mid-side representation [e.g. whitened Mid, whitened Side, or Downmix, Residual] of the multi-channel input audio signal [e.g. with or without prediction] for one or more frequency bands out of the given range of frequency bands, to obtain the encoded representation of the multi-channel input audio signal [e.g. in accordance with a band-wise decision].

Above, reference has been made to $G_{trans}$ and $G_{est}$. It is noted that:

Global gain "$G_{est}$" (at subblock 160*a*) may be estimated on signal consisting of the concatenated Left and Right channels. For example, the gain estimation as described in [9] is used, assuming signal to noise, SNR, gain of 6 dB per sample per bit from the scalar quantization. The estimated gain may, for example, be multiplied with a constant to get an underestimation or an overestimation in the final $G_{est}$. Signals in the Left, Right, Mid, Side, Downmix and Residual channels may be, for example, quantized using $G_{est}$. $G_{est}$ is used for stereo decision at subblock 160*a*.

Global gain (or quantization step) "$G_{trans0}$" (or respectively "$G_{trans1}$") may be estimated by subblock 160*b* on the channel "Whitened Joint Chn 0" (or respectively "Whitened Joint Chn 1") of the signal representation 162 using gain estimation, e.g. as described in [9] assuming signal to noise, SNR, gain of 6 dB per sample per bit from the scalar quantization and assuming bitrate of 96 kbps (or the bitrate assumed for transparent coding). "$G_{trans0}$" (or respectively "$G_{trans1}$") is then used to obtain the required number of bits "$\mathrm{Bits}_{jointChn0}$" (or respectively "$\mathrm{Bits}_{JointChn0}$") for arithmetic coding of "Whitened Joint Chn 0" (or respectively "Whitened Joint Chn 1"), for example, e.g. as described in "Bit consumption estimation" in [9].

In examples to $G_{trans}$ and $G_{est}$ are common for all the bands of the signal representation 162.

Each of $G_{trans}$ and $G_{est}$ (associated to a respective quantization step size) is unique for different bands of the same signal representation (but it may change for different frames).

Encoder 200 (FIG. 2*a*)

FIG. 2*a* shows a general example of multi-channel [e.g. stereo] audio encoder 200 (which may be a particular instantiation of the encoder 200*b* of FIG. 2*b*). Moreover, any of the elements of the encoder 200 may be the same of analogous elements of the encoder 100, and the encoder 200 is here only discussed only where the encoder 200 differs from the encoder 100.

In general terms, the encoder 200 is distinct from the encoder 100 by virtue of the prediction block 250 downstream to the second whitening block 152 and/or upstream to the stereo decision block 160 (an example thereof is provided in FIG. 7). At block 250 a prediction is made and a resulting predictive signal representation 254 may include the channels Downmix and Residual [e.g., Downmix channel $D_{R,k}$ and Residual channel $E_{R,k}$, see below]. The predictive signal representation 254 may, at block 160, compete with the with the separate channel representation 124 for being encoded in the bitstream 174. Hence, everything explained for the encoder 100 of FIG. 1*a* may be valid for the encoder 200 of FIG. 2*a*, keeping in mind that, at block 160 and downstream, the role that the M/S signal representation 154 had in the encoder 100 (at least from the block 160 to the blocks downstream) is taken over by the predictive signal representation 254 in the encoder 200 (and the roles of the Whitened Mid channel and Whitened Side channel are taken over by the Downmix channel and the Residual channel). Different encodings may imply different bit lengths and different parameters to be signaled in the bitstream 174, but the main procedure can easily be maintained.

It is to be noted that optional global ILD processing ("ILD Compensation") and/or optional Complex prediction or optional Real prediction ("Prediction").

If complex prediction or real prediction is used then it may be done, for example, as described in [7], the real prediction meaning, for example, that only $\alpha_{R,k}$ is used and $\alpha_{I,k}=0$. The Downmix channel $D_{R,k}$ is, for example, chosen among $MDCT_{M,k}$ and $MDCT_{S,k}$, for example based on the same criteria as in [7]. If the complex prediction is used $D_{I,k}$ is, for example, estimated using transform R2I as described in [7]. As in [7] the Residual channel may be, for example, obtained using:

$$E_{R,k} = \begin{cases} MDCT_{S,k} - \alpha_{R,k}D_{R,k} - \alpha_{I,k}D_{I,k} & \text{if } D_{R,k} = MDCT_{M,k} \\ MDCT_{M,k} - \alpha_{R,k}D_{R,k} - \alpha_{I,k}D_{I,k} & \text{if } D_{R,k} = MDCT_{S,k} \end{cases}$$

with $\alpha_{I,k}=0$ in case of real prediction is used. Here, k refers to the k-th band (spectral index).

Global gain $G_{est}$ may optionally be estimated on signal consisting of the concatenated Left and Right channels. For example, the gain estimation as described in [9] is used, assuming signal to noise, SNR, gain of 6 dB per sample per bit from the scalar quantization. The estimated gain may, for example, be multiplied with a constant to get an underestimation or an overestimation in the final $G_{est}$. Signals in the Left, Right, Mid, Side, Downmix and Residual channels may be, for example, quantized using $G_{est}$. $G_{est}$ is used for stereo decision.

With such a technique, at the prediction block 250, the predictive signal representation 254 may be obtained (other techniques are possible).

With reference to the stereo decision block 160, the discussion may be taken from the discussion for the encoder 100. In that case, if the complex or the real prediction is used then the M/S mode corresponds, for example, to using the Downmix and the Residual channel. If the complex or the real prediction is used, additional bits are, for example, needed for coding the $\alpha_{R,k}$ and optionally $\alpha_{I,k}$. Moreover, if "full MIS" is chosen then the complete spectrum consists, for example, of $MDCT_{M,k}$ and $MDCT_{S,k}$ or of $D_{R,k}$ and $E_{R,k}$ if the prediction is used. If "band-wise M/S" is chosen then some bands of the spectrum consist, for example, of $MDCT_{L,k}$ and $MDCT_{R,k}$ and other bands consist, for example, of $MDCT_{M,k}$ and $MDCT_{S,k}$ or of $D_{R,k}$ and $E_{R,k}$ if the prediction is used. In "band-wise M/S" mode also band-wise M/S decision is, for example, coded in the bitstream. If the prediction is used then also $a_{R,k}$ and optionally $\alpha_{I,k}$ are, for example, coded in the bitstream 174.

It is noted that considerations set out for the encoder 100 are also valid for the encoder 200 and are therefore here not repeated.

The encoder 200 is a multi-channel [e.g. stereo] audio encoder for providing an encoded representation [e.g. a bitstream] of a multi-channel input audio signal 104. The multi-channel audio encoder may apply a real prediction [wherein, for example, a parameter $\alpha_{R,k}$ is estimated] or a complex prediction [wherein, for example, parameters $\alpha_{R,k}$ and $\alpha_{I,k}$ are estimated] to a whitened mid-side representation of the multi-channel input audio signal, in order to obtain one or more prediction parameters [e.g. $\alpha_{R,k}$ and $\alpha_{I,k}$] and a prediction residual signal [e.g. $E_{R,k}$]. The multi-channel audio encoder 200 may encode [at least] one of the whitened mid signal representation [$MDCT_{M,k}$] and of the whitened side signal representation [$MDCT_{S,k}$], and the one or more prediction parameters [$\alpha_{R,k}$ and also $\alpha_{I,k}$ in the case of complex prediction] and a prediction residual [or prediction residual signal, or prediction residual channel] [e.g. $E_{R,k}$] of the real prediction or of the complex prediction, in order to obtain the encoded representation of the multi-channel input audio signal. The multi-channel audio encoder 200 may make a decision [e.g. stereo decision] which representation, out of a plurality of different representations of the multi-channel input audio signal [e.g. out of two or more of a separate-channel representation, a mid-side-representation in the form of a mid channel and a side channel, and a mid-side representation in the form of a downmix channel and a residual channel and one or more prediction parameters], is encoded, in order to obtain the encoded representation of the multi-channel input audio signal, in dependence on a result of the real prediction or of the complex prediction.

The multi-channel audio encoder may (e.g. at block 160) make a decision [e.g. stereo decision] whether to encode:

- the whitened mid-side representation 124 [e.g. whitened Mid, whitened Side] of the multi-channel input audio signal 104 [e.g. using an encoding of a downmix signal and an encoding of a residual signal and an encoding of one or more prediction parameters] or
- a separate-channel representation (e.g. a whitened separate-channel representation; e.g. whitened Left, whitened Right) 154 of the multi-channel input audio signal 104.

Hence, there is obtained the encoded representation 174 (162) of the multi-channel input audio signal 104, in dependence on a result of the real prediction or of the complex prediction.

In some examples, the multi-channel audio encoder 200 may quantize at least one of the whitened mid signal representation [$MDCT_{M,k}$] and of the whitened side signal representation[$MDCT_{S,k}$] using a single [e.g. fixed] quantization step size. The quantization step size may, for example, be identical for different frequency bins or frequency ranges. In addition or alternative, the multi-channel audio encoder 200 may quantize the prediction residual [or prediction residual channel] [e.g. $E_{R,k}$] of the real prediction (or of the complex prediction) 250 using a single [e.g. fixed] quantization step size [which may, for example, be identical for different frequency bins or frequency ranges, or which may be identical for bins across the complete frequency range].

The multi-channel audio encoder 200 may choose a downmix channel $D_{R,k}$ among a spectral representation $MDCT_{M,k}$ of a mid channel [designated by index M] and a spectral representation $MDCT_{S,k}$ of a side channel [designated by index S]. The multi-channel audio encoder 200 may determine prediction parameters $\alpha_{R,k}$ [for example, to minimize an intensity or an energy of the residual signal $E_{R,k}$]. It may determine the prediction residual [or prediction residual signal, or prediction residual channel] $E_{R,k}$ according to:

$$E_{R,k} = \begin{cases} MDCT_{S,k} - \alpha_{R,k} D_{R,k} & \text{if } D_{R,k} = MDCT_{M,k} \\ MDCT_{M,k} - \alpha_{R,k} D_{R,k} & \text{if } D_{R,k} = MDCT_{S,k} \end{cases};$$

In examples, the multi-channel audio encoder 200 may choose a downmix channel $D_{R,k}$ among a spectral representation $MDCT_{M,k}$ of a mid channel and a spectral representation $MDCT_{S,k}$ of a side channel. The multi-channel audio encoder 200 may determine prediction parameters $\alpha_{R,k}$ and $\alpha_{I,k}$ [for example, to minimize an intensity or an energy of the residual signal $E_{R,k}$]. The multi-channel audio encoder 200 may determine the prediction residual [or prediction residual signal, or prediction residual channel] $E_{R,k}$ according to:

$$E_{R,k} = \begin{cases} MDCT_{S,k} - \alpha_{R,k} D_{R,k} - \alpha_{I,k} D_{I,k} & \text{if } D_{R,k} = MDCT_{M,k} \\ MDCT_{M,k} - \alpha_{R,k} D_{R,k} - \alpha_{I,k} D_{I,k} & \text{if } D_{R,k} = MDCT_{S,k} \end{cases};$$

where k is a spectral index (e.g. a particular band). [there may be more complex derivation of the $D_{I,k}$; e.g. the same as in the original complex prediction].

In examples, the multi-channel audio encoder 200 may apply a spectral whitening [whitening] to the (non-whitened) mid-side representation 142 [e.g. Mid, Side] of the multi-channel input audio signal 104, to obtain the whitened mid-side representation 154 [e.g. Whitened Mid, Whitened Side] of the multi-channel input audio signal 104.

In examples, the multi-channel audio encoder 200 may apply a spectral whitening [whitening] to the (non-whitened) separate-channel representation 112 [e.g. normalized Left, normalized Right] of the multi-channel input audio signal 104, to obtain a whitened separate-channel representation 124 [e.g. whitened Left and whitened Right] of the multi-channel input audio signal 104.

In examples, the multi-channel audio encoder 200 may, e.g. at block 160, make a decision [e.g. stereo decision] whether to encode the whitened separate-channel representation 124 [e.g. whitened Left, whitened Right] of the multi-channel input audio signal 104, to obtain the encoded representation of the multi-channel input audio signal 104, or to encode the whitened mid-side representation [e.g. whitened Mid, whitened Side] of the multi-channel input audio signal 104, to obtain the encoded representation 162 (174) of the multi-channel input audio signal 104, in dependence on the whitened separate-channel representation 124 and in dependence on the whitened mid-side representation 154[e.g. before a quantization of the whitened separate-channel representation and before a quantization of the whitened mid-side representation].

With respect to the encoder 200, 200*b* of FIGS. 2*a* and 2*b*, the ILD compensation block 116 may in some examples not be present for the encoder 100, 100*b*. The signal 112 in FIGS. 2 and 2*b* plays the role of the signal 118 in FIGS. 1*a* and 1*b*.

FIG. 2*a* shows that the prediction parameters (real or complex) are signaled in the bitstream 174 as parameters 449.

The example of FIG. 7 also applies to the encoder 200 or 200*b*, and all the properties are not repeated. Also the discussion regarding $G_{trans}$ and $G_{est}$ is the same and is therefore not repeated here.

Whitening Technique (e.g. at the Encoder 100, 100*b*, 200, or 200*b*)

Examples are here discussed on how whitening may be performed at block 122 and/or 152. The whitening techniques may be as such independent from each other, and it may be that block 122 uses a different technique from that used by block 152. Whitening at at least one of blocks 122 and 152 may occur downstream to the ILD compensation at block 116 and/or to the M/S block 140. Whitening at blocks 122 and 152 may occur upstream to the stereo decision at block 160.

Whitening at block 122 and/or 152 may correspond, for example, to the Frequency domain noise shaping (FDNS) as described in [9] or in [10]. Alternatively, Whitening may correspond, for example, to spectral noise shaping (SNS) as described in [11].

Whitening may make use of separate-channel whitening coefficients [WC Left, WC Right] 136 when implemented for the first whitening block 122 (whitening the separate-channel representation 118 of the signal 104), and/or of mid-side coefficients [WC Mid, WC Side] 139 when implemented for the second whitening block 152 (whitening the M/S representation 142 of the signal 104). In general terms, the mid-side coefficients [WC Mid, WC Side] 139 may be obtained using transformations from the separate-channel whitening coefficients [WC Left, WC Right] 136 at the transform whitening coefficient block 138. The whitening coefficients 136 and/or 139 may be obtained from parameters (e.g. whitening parameters 132, e.g. WP Left and WP Right) which may be based on the FD representation 108 of the input signal 104 (e.g., upstream to the TNS block 110 and/or the ILD compensation block 116). In examples, the whitening coefficients 136 and/or 139 may be obtained from the whitening parameters 132 using a non-linear derivation rule (examples of non-linear derivation rule are provided below and in [10] and [11]). In examples, the coefficients 139 may be obtained from blocks such as blocks 130 and 134 (see below).

In examples, whitening parameters 132 may be associated to separate channels [e.g. left channel and right channel] of the signal representation 108 of the multi-channel input audio signal 108. The parameters 132 may be, for example, Linear Predictive Cording, LPC, parameters, or LSP parameters (Linear Spectral Pairs, used in Linear Predictive Coding; more details in [10]). Hence, the parameters 132 may be understood as parameters which represent a spectral envelope of a channel or of multiple channels of the multi-channel input audio signal 104 (e.g. in its FD representation 108), or parameters which represent an envelope derived from a spectral envelope of the audio signal 104 (e.g. in its FD representation 108), e.g. masking curve. The parameters 132 may be encoded in the bitstream 174 to be used at the decoder e.g. for LPC or LSP decoding.

The encoder 100 may be configured to derive (e.g. obtain) the whitening coefficients 136 and/or 139 from the whitening parameters 132. For example, block 134 may derive whitening coefficients 136, e.g. WC Left, associated with the left channel of the multi-channel input audio signal 108 (or its FD representation 108) from a plurality of whitening parameters 132, e.g. WP Left, associated with the left channel of the multi-channel input audio signal 108 (or its FD representation 108). Analogously, block 134 may derive coefficients 136, e.g. WC Right, associated with the right channel of the multi-channel input audio signal 104 (or its FD representation 108) from the plurality of whitening parameters 132, e.g. WP Right, associated with the right channel of the multi-channel input audio signal 104 (or its FD representation 108).

Whitening coefficients 136 and 139 may be associated with bands and be different between different bands. Whitening coefficients 136 and 139 may be regarded as "scale factors" from the traditional mp3/AAC coding. Whitening coefficients 136 and 139 are derived from block 130. Whitening coefficients 136 and 139 are not encoded in the bitstream 174.

In some examples, at least one whitening parameter 132 influences more than one whitening coefficient 136 or 139. For example, whitening coefficients 136 and/or 139 are obtained from the parameters 132. Coefficients 136 and/or 139 may be obtained, for example, by interpolating different parameters 132.

It may be possible to use Odd Discrete Fourier Transform, ODFT, (e.g. like in [10]) from LPC, or using an interpolator and a linear domain converter.

Block 138 may determine an element-wise minimum, to derive the whitening coefficients 139 [e.g. WC Mid and WC Side] from the whitening coefficients 136 [e.g. WC Left, WC Right]. For example, whitening coefficients (139) WC Mid (t,f) for the mid channel and WC Side(t,f) for the side channel of the signal representation 142 can be obtained from whitening coefficients (136) WC Left(t,f) for the left channel and WC Right(t,f) for the right channel of the signal representation 118 as follows (t being a time index associated to the $t^{th}$ frame and f being a frequency index associated to the $f^{th}$ band or bin of the $t^{th}$ frame):

$$\text{WC Mid}(t,f)=\text{WC Side}(t,f)=\min(\text{WC Left}(t,f), \text{WC Right}(t,f)),$$

where "min(. . . , . . . )" outputs the minimum among the arguments.

In this case WC Mid and WC Side (collectively indicated with 139) are identical with each other, but this is not necessary as there could be some other different derivation where WC Mid is not equal to WC Side.

In examples, channel-specific whitening coefficients 136 may be used for different channels of the separate-channel representation 118, while whitening coefficients 139 are used for the mid signal and the side signal of the mid-side representation 142. The channel-specific whitening coefficients 136 (for separate-channel the signal representation 118) may be different for the different channels. The different channel-specific whitening coefficients 136 may be applied to different channels of the separate-channel representation 118. It is possible to use whitening coefficients [e.g. WC M, WC S] 139 to the mid channel and to the side channel of the mid-side representation 142, to obtain the whitened mid-side representation [e.g. Whitened Mid, Whitened Side] 154. (In some examples the whitening coefficients are common whitening coefficients)

It is also to be noted that the $TNS^{-1}$ can optionally be moved after the Stereo decision block 160 in the encoder and the TNS before the Dewhitening in the decoder; TNS would then, for example, operate on the Whitened Joint Chn 0/1.

In examples, at least one of the first and the second whitening blocks 122 and 152 may be understood as operating in such a way that its output (respectively 124 and 154) is a flattened version of the spectral envelope of their input signals (respectively 118 and 142). For example, bins with higher values, or bands having (e.g. in average) bins with higher values, may be downscaled (e.g. by a coefficient less than 1), and/or bins with smaller values, or bands having (e.g. in average) bins with smaller values, may be upscaled (e.g. by a coefficient greater than 1). In examples, scaling coefficients (e.g. downscaling and/or upscaling coefficients) may be associated with the whitening coefficients 136 and/or 139. The whitening parameters 132 (which will be advantageously signaled in the bitstream 174) will provide information on the whitening coefficients 136 and/or 139, so that the decoder will reconstruct the whitening coefficients 136 and/or 139 and perform a dewhitening operation analogous (e.g., reciprocal) to the whitening operations at 122 or 154. The parameters may be, for example, LPC parameters or LSP parameters.

For example, e.g. when taking into account the technique disclosed in [10], LPC coefficients (parameters 132) may be obtained as MDCT gains (or MDST gains) from the FD version 108 of the input signal 104. The inverse of the MDCT gains (or other values associated thereto) may be used for whitening at blocks 122 and 152, e.g. after having obtained an ODFT.

In addition or alternative (e.g. when taking into account the technique disclosed in [11]), the whitening parameters (e.g. scaling factors) 132 as output by whitening parameters generation block 130 may be in a reduced number with respect to the number of the coefficients 136 and/or 139 needed for whitening. For example, the whitening parameters 132 may result downsampled with respect to the scaling parameters obtainable from the signal version 108. Notwithstanding, information is not sensibly lost: block 134 may perform an upsampling (e.g., interpolating or somehow guessing the values of the lacking coefficients), so as to provide the first and second whitening blocks 122 and 152 with the correct amount of scaling coefficients. Notably, the decoder obtains the downsampled number of whitening parameters 132, but it will apply the same upsampling technique for obtaining the whitening coefficients, so that the whitening blocks, at the decoder and at the decoder, operate coherently.

In several examples, therefore, a single whitening parameter 132 may be understood as being more important than a single whitening coefficient 136 and/or 139, and the single whitening parameter 132 may influence the whitening more than the single whitening coefficient 136 and/or 139.

Bitstream 174

A bitstream 174 (e.g. generated by the encoder 100, 100*b*, 200, 200*b*) may include, for example a main signal representation 170 (e.g., the one output by block 168) and side information (e.g. parameters). The side information may include at least one of the following (in case they have been generated):

- Windowing parameters (not shown in the figures, as being well-known), which are generated at block 106;
- TNS parameters 114 (e.g., generated by the TNS block 110 in association with the non-whitened signal representation 112);
- parameters 120 (e.g., generated by the ILD compensation block 110 in association with the non-whitened signal representation 118), which may include information or a parameter (e.g. stereo parameter) or a value (e.g. ILD, e.g. in the form $\overline{ILD}$ ), which describe a relationship, e.g. a ratio, between intensities, e.g. energies, of two or more channels of the input audio representation 112 (or 108) of the input signal 104;
- whitening parameters 132 (e.g., as generated at block 130), which may be for examples LPC, and which are associated to (e.g. derived from and/or representing)

the spectral envelope of the signal 104 (while it may be avoided to include the whitening coefficients 136 and/or 139 in the bitstream);

IGF parameter(s) 165;

stereo information 161 (e.g., "band-wise M/S" vs. "full M/S mode" vs. "full L/R mode") or other information regarding the decision performed at block 160 and including:

parameters 161*a* associated to a first decision (e.g. performed by subblock 160*a*) regarding which signal representation, between the signal representations 125 and 154, has been chosen to be encoded in the bitstream 174, e.g. bandwise or for all the bands; and parameters 161*b* associated to a second decision (e.g. performed by subblock 160*b*) regarding the number of bits chosen for each channel of the chosen representation 162 (e.g., it may include information regarding the allocation of bits between the channels, such as the bitrate split ratio, e.g. $\widehat{ILD}$, and/or other information like $bits_{RS}$ or $bits_{LM}$);

in case, prediction parameters 449.

As discussed above, the bitstream 174 may be encoded as MDCT, MDST, or other lapped transforms, or non-lapped transforms. In examples, the signal is divided into multiple bands (see above). In examples, each band may either encoded in L/R, or M/S, so that wither all the bands of a frame are encoded in the same mode, or some bands are encoded in encoded in L/R and some other bands are encoded in M/S (e.g. following the decision at block 160). As explain above, instead of M/S a D/E mode (downmix/residual) may be used (e.g. when encoder 200 or 200*b* is used).

Other parameters may be signaled.

Decoder 300

FIG. 3*a* shows a general example of multi-channel [e.g. stereo] audio decoder 300 (which may be a particular instantiation of the decoder 300*b* of FIG. 3*b*).

The decoder 300 may comprise a bitstream parser 372, which may read a bitstream 174 (e.g. as encoded by the encoder 100, 100*b*, 200, or 200*b* and/or as described above). The bitstream 174 may include a signal representation 370 (e.g. spectrum of the jointly coded channels) and side information (e.g. at least one of parameters 114, 120, 132, 161, 165, windowing parameters, etc.). The signal representation 370 may be analogous to the signal representation 170 output by block 168 at the encoder.

At block 368, an entropy decoding and/or noise filling and/or dequantization is performed. The decoding process starts, for example, with at least one of decoding, inverse quantization ($Q^{-1}$) of the spectrum 370 (170) of the jointly coded channels, which may be followed by the noise filling, for example as in [9] (other noise-filling techniques may notwithstanding be implemented). The number of bits allocated to each channel is, for example, determined based on the window length, the stereo mode (e.g. 161, and in particular 161*a*) and/or the bitrate split ratio (e.g. 161, and in particular 161*a*, for example expressed by $\widehat{ILD}$) coded in the bitstream. The window length may be signaled, as a windowing parameter, in the bitstream 174 and may be provide to block 306 (windowing parameter are not shown in the figures for the sake of simplicity). The number of bits allocated to each channel has to, in some cases, be known before fully decoding the bitstream 174 (or 370).

Block 368 may output a whitened signal representation 366, which is a whitened joint representation (e.g. having channels Whitened Joint Chn 0 and Whitened Joint Chn1). The joint whitened signal representation 366 may be understood as analogous to the whitened joint signal representation 166 at the encoder.

When foreseen, the whitened signal representation 366 may be input to a stereo IGF block 364, which may be the block exerting the inverse function of the stereo IGF block 164 at the encoder.

In the optional intelligent gap filling (IGF) block 364, lines quantized to zero in a certain range of the spectrum, called the target tile may be filled with processed content from a different range of the spectrum, called the source tile. Due to the band-wise stereo processing, the stereo representation (i.e. either L/R or M/S or D/E) might differ for the source and the target tile. To ensure good quality, if the signal representation of the source tile may be different from the signal representation of the target tile, the source tile is optionally processed to transform it to the signal representation of the target tile prior to the gap filling in the decoder. For example, this procedure is already described in [12]. The IGF itself may, contrary to [9] be, for example, applied in the whitened spectral domain instead of the original spectral domain.

In general, the multi-channel audio decoder 300 may be configured (e.g. at block 364) to apply a gap filling [IGF]. The gap filling may, for example, fill spectral lines quantized to zero in a target range of a spectrum with content from a different range of the spectrum, which is a source range (or source tile). The content of the source range may be adapted to the content of the target range (target tile) to a whitened representation (e.g. 366) of the multi-channel audio signal 104 [before applying a de-whitening]. In addition or alternative, noise insertion may also be implemented.

Subsequently, the whitened joint signal representation 362 may be subjected to a dewhitening (e.g. spectral whitening), e.g. at block 322. The dewhitening may be understood as performing the inverse function of the whitening at the encoder. While, at the encoder, the whitening blocks 152 and 122 have flattened the spectral envelope of the encoded signal representations 118 and 142, at the decoder the dewhitening block 322 retransform the signal representation 362 to present a spectral envelope which is the same (or at least similar) to the spectral envelope of the original audio signal 104. In order to do so, parameters 132 (encoded in the bitstream 174 as side information) are used (see below) at blocks 334 and 338. In examples the dewhitening block 322 is not input with parameters 161, hence increasing the compatibility with pre-existing dewhitening blocks.

Here, the dewhitening block 322 is represented as one single block, since its input 362 is the whitened joint signal representation 362: contrary to the situation at the encoder, the decoder has no necessity dewhitening two different signal representations, as there is no decision to be made.

Notably, the decoder knows, from the side information 161, whether the whitened joint signal representation 362 is actually a separate channel representation (e.g. like 124) or a M/S representation (e.g. like 154), and knows it for each band.

Moreover, the decoder may reconstruct, at block 334, the whitening coefficients 136 (here indicated with 336), which may correspond to the L/R whitening coefficients 136 obtained by the encoder (but not signaled in the bitstream 174). At block 338, the decoder may reconstruct, if needed, the M/S whitening coefficients 139. Following the choice made by the encoder (e.g., at block 160), block 338 will provide either reconstructed L/R whitening coefficients 336 (as provided by block 334), or reconstructed M/S whitening coefficients (reconstructed by block 338), or a mixture thereof (according to the bandwise choice). The mixture of reconstructed L/R whitening coefficients and reconstructed M/S whitening coefficients provides reconstructed L/R whitening coefficients and reconstructed M/S whitening coefficients band-by-band. The provision of either the reconstructed L/R whitening coefficients 136, or the reconstructed M/S whitening coefficients 139, or the bandwise mixture of reconstructed L/R whitening coefficients 136 and reconstructed M/S whitening coefficients is indicated with numeral 339 in FIG. 3*a*. The operations of block 338 are therefore controlled by the side information 161 (here indicated with 161'). For a specific band, the choice whether to use reconstructed L/R whitening coefficients or reconstructed M/S whitening coefficients is made based on the choice of the decision block 160 and on the side information 161 (which indicates which kind of signal representation has been encoded for each band). The whitening coefficients 339 are notwithstanding obtained from the whitening parameters 132 signaled in the bitstream 174 through the operations of blocks 334 and 338.

The output of block 322 may be a signal representation 323. Notably, the signal representation 323 is either in the separate-channel domain (and similar to the signal representation 118 at the encoder) or in the M/S domain (and similar to the signal representation 142 at the encoder), or a bandwise mixture of a representation in the separate-channel domain and a representation in the M/S domain (in this last case, the signal representation 323 is to be understood as a bandwise mixture of the signal representations 118 and 142 at the encoder). However, the signal representation 323 is represented with one single signal representation by virtue of the fact that only one signal representation is chosen at time and band.

At block 340 an inverse stereo processing may be performed, so as to obtain a separate-channel representation 318 (dual mono). Based on the information obtained from the parameters 161 encoded in the bitstream 174, it is therefore possible to reconstruct a signal representation (318) similar to the separate-channel representation 118 at the encoder.

At block 340, the conversion from M/S to dual mono may be obtained using a linear transformation, such as $$MDCT_{L,k} = 1/\sqrt{2}\,(MDCT_{LM,k} + MDCT_{RS,k})$$

and/or $$MDCT_{R,k} = 1/\sqrt{2}\,(MDCT_{LM,k} - MDCT_{RS,k}),$$

so that the channels $MDCT_{L,k}$ and $MDCT_{L,k}$ of the signal representation 318 (for the k-th band or bin) are a linear combination of the joint channels $MDCT_{LM,k}$ and $MDCT_{RS,k}$ of the signal representation 323 (e.g. for the same k-th band or bin). If the joint channels $MDCT_{LK,k}$ and $MDCT_{RS,k}$ of the signal representation 323 are already in the dual mono domain, then there is not necessity of performing a conversion (banal conversion, i.e. $MDCT_{L,k}=MDCT_{LM,k}$, and $MDCT_{R,k}=MDCT_{RS,k}$).

Therefore, the decoder 300, 300*b* or 400 may:

derive a mid-side representation of the multi-channel audio signal [e.g. Whitened Joint Chn 0 and Whitened Joint Chn1] from the encoded representation [e.g. using a decoding and an inverse quantization $Q^{-1}$ and optionally a noise filling, and optionally using a multi-channel IGF or stereo IGF];

apply a spectral de-whitening [dewhitening] to the [encoder-sided whitened] mid-side representation [e.g. Whitened Joint Chn 0, Whitened Joint Chn 1] of the multi-channel audio signal, to obtain a dewhitened mid-side representation [e.g. Joint Chn 0, Joint Chn 1] of the multi-channel input audio signal;

derive a separate-channel representation of the multi-channel audio signal on the basis of the dewhitened mid-side representation of the multi-channel audio signal [e.g. using an "Inverse Stereo Processing"].

The decoder 300, 300*b* or 400 may obtain a plurality of whitening parameters 132 [e.g. frequency-domain whitening parameters, which may be understood as "dewhitening parameters", despite being the same of the "whitening parameters" 132 encode in the bitstream 174][e.g. WP Left, WP right] [wherein, for example, the whitening parameters may be associated with separate channels, e.g. a left channel and a right channel, of the multi-channel audio signal] [e.g. LPC parameters, or LSP parameters] [e.g. parameters which represent a spectral envelope of a channel or of multiple channels of the multi-channel audio signal] [wherein, for example, there may be a plurality of whitening parameters, e.g. WP left, associated with a first, e.g. left, channel of the multi-channel input audio signal, and wherein there may be a plurality of whitening parameters, e.g. WP right, associated with a second, e.g. right, channel of the multi-channel input audio signal]. The decoder may derive a plurality of whitening coefficients [e.g. a plurality of whitening coefficients associated with individual channels of the multi-channel audio signals; e.g. WC Left, WC right] from the whitening parameters [e.g. from coded whitening parameters] [for example, to derive a plurality of whitening coefficients, e.g. WC Left, associated with a first, e.g. left, channel of the multi-channel audio signal from a plurality of whitening parameters, e.g. WP Left, associated with the first channel of the multi-channel audio signal, and to derive a plurality of whitening coefficients, e.g. WC Right, associated with a second, e.g. right, channel of the multi-channel audio signal from a plurality of whitening parameters, e.g. WP Right, associated with the second channel of the multi-channel input audio signal] [e.g. such that at least one whitening parameter influences more than one whitening coefficient, and such that at least one whitening coefficient is derived from more than one whitening parameter] [e.g. using ODFT from LPC, or using an interpolator and a linear domain converter].

The decoder 300, 300*b* or 400 may derive whitening coefficients associated with signals of the mid-side representation [e.g. WC Mid and WC Side] from whitening coefficients [e.g. WC Left, WC Right] associated with individual channels of the multi-channel audio signal.

The multi-channel audio decoder 300, 300*b* or 400 may derive the whitening coefficients associated with signals of the mid-side representation [e.g. WC Mid and WC Side] from the whitening coefficients [e.g. WC Left, WC Right] associated with individual channels of the multi-channel audio signal using a non-linear derivation rule (e.g. analogous to the non-linear derivation rule applied by the encoder).

In general terms, block 334 of the decoder may perform the same technique used by block 134 of the encoder for obtaining the whitening coefficients 136 (here indicated with 336) from the whitening parameters 132. On the other side, block 338 of the decoder is not really equivalent to block 138, as the coefficients 339 may be a bandwise mixture of the coefficients 134 and 139. These techniques are here not repeated, as they are already explained above. Anyway, whitening coefficients WC Mid(t,f) for the mid channel and WC Side(t,f) for the side channel can be obtained on the basis of whitening coefficients WC Left(t,f) for the left channel and WC Right(t,f) for the right channel as follows (wherein t is a time index and f is a frequency index): WC Mid(t,f)=WC Side(t,f)=min(WC Left(t,f), WC Right(t,f)). In this case WC Mid and WC Side are identical, but this is not necessary as there could be some other better derivation where WC Mid is not equal to WC Side.

The multi-channel audio decoder 300, 300*b* or 400 may determine an element-wise minimum, to derive the whitening coefficients associated with signals of the mid-side representation [e.g. WC Mid and WC Side] from the whitening coefficients [e.g. WC Left, WC Right] associated with individual channels of the multi-channel audio signal.

Other additional or alternative decoder's aspects (which may actually also be obtained from the above-discussed aspects of the encoder) are presented.

The decoder may control a decoding and/or a determination of whitening parameters and/or a determination of whitening coefficients and/or a prediction and/or a derivation of a separate-channel representation of the multi-channel audio signal on the basis of the dewhitened mid-side representation of the multi-channel audio signal in dependence on one or more parameters which are included in the encoded representation [e.g. "Stereo Parameters"].

The decoder may apply the spectral de-whitening [dewhitening] to the [encoder-sided whitened] mid-side representation [e.g. Whitened Joint Chn 0, Whitened Joint Chn 1] of the multi-channel audio signal in a frequency domain [e.g. using a scaling of transform domain coefficients, like MDCT coefficients or Fourier coefficients], to obtain a dewhitened mid-side representation [e.g. Joint Chn 0, Joint Chn 1] of the multi-channel input audio signal.

The decoder may make a band-wise decision [e.g. stereo decision] whether to decode a whitened separate-channel representation [e.g. whitened Left, whitened Right, represented by Whitened Joint Chn 0 and Whitened Joint Chn 1] of the multi-channel audio signal, to obtain the decoded representation of the multi-channel input audio signal, or to decode the whitened mid-side representation [e.g. whitened Mid, whitened Side, or Downmix, Residual, represented by Whitened Joint Chn 0 and Whitened Joint Chn 1] of the multi-channel audio signal, to obtain the decoded representation of the multi-channel audio signal, for a plurality of frequency bands. For example, this may be within a single audio frame, a whitened separate-channel representation is decoded for one or more frequency bands, and a whitened mid-side representation is decoded for one or more other frequency bands]["mixed L/R and M/S spectral bands within a frame"].

The decoder may make a decision [e.g. stereo decision] whether

- to decode the whitened separate-channel representation [e.g. whitened Left, whitened Right, represented by Whitened Joint Chn 0 and Whitened Joint Chn 1] of the multi-channel audio signal for all frequency bands out of a given range of frequency bands [e.g. for all frequency bands], to obtain the decoded representation of the multi-channel input audio signal, or
- to decode the whitened mid-side representation [e.g. whitened Mid, whitened Side, represented by Whitened Joint Chn 0 and Whitened Joint Chn 1] of the multi-channel audio signal for all frequency bands out of the given range of frequency bands, to obtain the decoded representation of the multi-channel input audio signal, or
- to decode the whitened separate-channel representation [e.g. whitened Left, whitened Right, represented by Whitened Joint Chn 0 and Whitened Joint Chn 1] of the multi-channel input audio signal for one or more frequency bands out of a given range of frequency bands and to decode the whitened mid-side representation [e.g. whitened Mid, whitened Side, or Downmix, Residual, represented by Whitened Joint Chn 0 and Whitened Joint Chn 1] of the multi-channel audio signal [e.g. with or without prediction] for one or more frequency bands out of the given range of frequency bands, to obtain the decoded representation of the multi-channel input audio signal [e.g. in accordance with a band-wise decision, which may be made on the basis of a side information included in a bitstream].

At block 340 an ILD compensation may be performed (e.g. inverse to the function performed at block 116 at the encoder). In particular, the multi-channel audio decoder may apply an inter-channel level difference compensation [e.g. ILD compensation] to two or more channels of the dewhitened separate-channel representation 323 of the multi-channel audio signal 104. Accordingly, a level-compensated representation of channels is obtained [e.g. Denormalized Left and Denormalized Right]. For example, if the ILD compensation is used then if $\text{ratio}_{ILD}>1$ then the right channel is scaled with $\text{ratio}_{ILD}$, otherwise the left channel is scaled with $$\frac{1}{\text{ratio}_{ILD}}.$$

The $\text{ration}_{ILD}$ may be signalled in the side information 161 or may be obtained from other side information. For each case where division by 0 could happen, a small epsilon, for example, may be added to the denominator.

Subsequently, an optional TNS block 310 may output a signal representation 308.

Subsequently, at block 306, a conversion from FD to TD may be operated onto the signal representation 318 or 308, so as to obtain a TD signal representation 304, which may therefore be used for feeding a loudspeaker.

Features of the decoder may be supplemented by those discussed for the encoder (e.g., regarding, the frames, the lapped transformations, etc.).

It is noted that the decoder 300 may apply the spectral de-whitening (at block 322) to the whitened signal representation (366, or 362, or 451) obtained from the encoded signal representation (370) using one single quantization step size. The single quantization step size is unique for different bands of the same signal representation (but it may change for different frames).

Decoder 400

Figure 4:
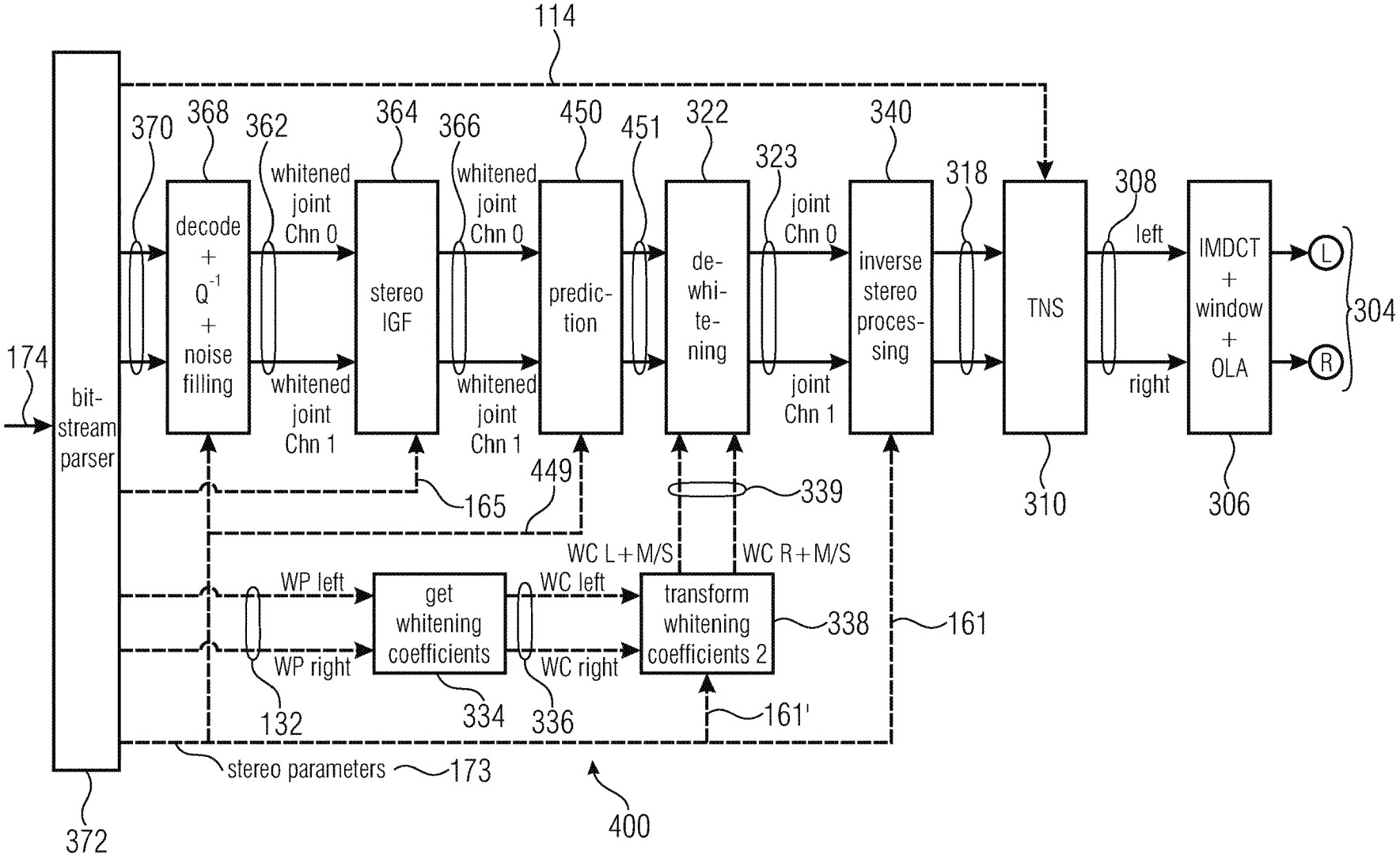

The predictive decoder 400 of FIG. 4 is the decoder for the bitstream 174 when encoded by the encoder 200 or 200*b*. Here, a prediction block 450 is used if the complex or the real prediction is used, then the M/S channels are, for example, e.g. restored in the Prediction block in the same way as described in [7]. The prediction block 450 may be fed with prediction parameters 449 (real α or complex α, see also above) and may provide a whitened signal representation 451 (which may be either in the mid side domain or in the separate channel domain, according to the choice made at the decoder).

The multi-channel audio decoder may obtain [at least] one of a whitened mid signal representation 362 or 366

[$MDCT_{M,k}$; e.g. represented by Whitened Joint Chn 0] and of a whitened side signal representation 362 or 366 [$MDCT_{S,k}$; e.g. represented by Whitened Joint Chn 0], and one or more prediction parameters [$\alpha_{R,k}$ and also $\alpha_{I,k}$ in the case of complex prediction] and a prediction residual [or prediction residual signal, or prediction residual channel] [e.g. $E_{R,k}$; e.g. represented by Whitened Joint Chn 1] of a real prediction or of the complex prediction 451 [e.g. on the basis of the encoded representation]. The multi-channel audio decoder may apply a real prediction [for example, a parameter $\alpha_{R,k}$ may be applied] or a complex prediction [for example, complex parameters $\alpha_{R,k}$ and $\alpha_{I,k}$ may be applied], in order to determine:

a whitened side signal representation 451 [e.g. in case that the whitened mid signal representation is directly decodable from the encoded representation, and available as an input signal] or a whitened mid signal representation [e.g. in case that the whitened side signal representation is directly decodable from the encoded representation, and available as an input signal to the prediction]

The determination is based on the obtained one of the whitened mid signal representation and the whitened side signal representation, on the basis of the prediction residual and on the basis of the prediction parameter.

The multi-channel audio decoder may apply a spectral de-whitening [dewhitening] (at block 322) to the [encoder-sided whitened] mid-side representation [e.g. Whitened Joint Chn 0, Whitened Joint Chn 1] of the multi-channel audio signal obtained using the real prediction or using the complex prediction, to obtain the dewhitened mid-side representation [e.g. Joint Chn 0, Joint Chn 1] of the multi-channel input audio signal.

Methods

Even though the examples above are prevalently discussed in terms of apparatus, it is important to note that those examples also refer to methods (e.g. decoder apparatus corresponding to a decoding method, and encoder apparatus corresponding to an encoding method). Each encoder block and each decoder block may therefore refer to a method step.

An example of a method (illustrated by FIGS. 1*a* or 1*b*) is a method for providing an encoded representation 174 [e.g. a bitstream] of a multi-channel input audio signal 104 [e.g. of a pair channels of the multi-channel input audio signal]. The method may comprise:

at step 122, applying a spectral whitening [whitening] to a separate-channel representation 118 [e.g. normalized Left, normalized Right; e.g. to a pair of channels] of the multi-channel input audio signal 104, to obtain a whitened separate-channel representation 124 [e.g. whitened Left and whitened Right] of the multi-channel input audio signal 104;

at step 152, applying a spectral whitening [whitening] to a [non-whitened] mid-side representation 142 [e.g. Mid, Side] of the multi-channel input audio signal 104 [e.g. to a mid-side representation of a pair of channels of the multi-channel input audio signal], to obtain a whitened mid-side representation 154 [e.g. Whitened Mid, Whitened Side] of the multi-channel input audio signal 104;

at step 160, making a decision [e.g. stereo decision] whether to encode:

the whitened separate-channel representation 118 [e.g. whitened Left, whitened Right] of the multi-channel input audio signal 104, to obtain the encoded representation 162 of the multi-channel input audio signal 104, or to encode the whitened mid-side representation 154 [e.g. whitened Mid, whitened Side] of the multi-channel input audio signal 104, to obtain the encoded representation of the multi-channel input audio signal 104, in dependence on the whitened separate-channel representation 118 and in dependence on the whitened mid-side representation 154 [e.g. before a quantization of the whitened separate-channel representation and before a quantization of the whitened mid-side representation].

Another example of a method (an embodiment of which is illustrated by FIG. 2*a* or 2*b*) is a method for providing an encoded representation 174 [e.g. a bitstream] of a multi-channel input audio signal 104 [e.g. of a pair channels of the multi-channel input audio signal]. The method may comprise:

at step 250, applying a real prediction [wherein, for example, a parameter $\alpha_{R,k}$ is estimated] or a complex prediction [wherein, for example, parameters $\alpha_{R,k}$ and $\alpha_{I,k}$ are estimated] to a whitened mid-side representation 154 of the multi-channel input audio signal, in order to obtain one or more prediction parameters 254 [e.g. $\alpha_{R,k}$ and $\alpha_{I,k}$] and a prediction residual signal [e.g. $E_{R,k}$];

encoding [at least] one of the whitened mid signal representation [$MDCT_{M,k}$] and of the whitened side signal representation[$MDCT_{S,k}$], and the one or more prediction parameters [$\alpha_{R,k}$ and also $\alpha_{I,k}$ in the case of complex prediction] and a prediction residual [or prediction residual signal, or prediction residual channel] [e.g. $E_{R,k}$] of the real prediction or of the complex prediction, in order to obtain the encoded representation of the multi-channel input audio signal;

at step 160, making a decision [e.g. stereo decision] which representation, out of a plurality of different representations of the multi-channel input audio signal [e.g. out of two or more of a separate-channel representation 124, a mid-side-representation 154 in the form of a mid channel and a side channel, and a mid-side representation 254 in the form of a downmix channel and a residual channel and one or more prediction parameters], is encoded, in order to obtain the encoded representation of the multi-channel input audio signal, in dependence on a result of the real prediction or of the complex prediction.

In accordance to an example, a method for providing an encoded representation [e.g. a bitstream] of a multi-channel input audio signal may comprise:

determining numbers of bits needed for a transparent encoding [e.g., 96 kbps per channel may be used in an implementation; alternatively, one could use here the highest supported bitrate] of a plurality of channels [e.g. of a whitened representation selected] to be encoded [e.g. $Bits_{JointChn0}$, $Bits_{JointChn1}$], and allocating portions of an actually available bit budget [totalBitsAvailable−stereoBits] for the encoding of the channels [e.g. of the whitened representation selected] to be encoded on the basis of the numbers of bits needed for a transparent encoding of the plurality of channels of the whitened representation selected to be encoded.

In accordance to an example, a method for providing a decoded representation 318, 308, or 304 [e.g. a time-domain signal 304 or a waveform] of a multi-channel audio signal 104 on the basis of an encoded representation 174, comprises:

at step 368 or 364, deriving a mid-side signal representation 362 or 366 (if encoded in the bitstream 174) of the multi-channel audio signal 104 [e.g. the mid-side representation 362 or 366 being encoded in channels Whitened Joint Chn 0 and Whitened Joint Chn1] from the encoded representation [e.g. using a decoding and an inverse quantization $Q^{-1}$ and optionally a noise filling, and optionally using a multi-channel IGF or stereo IGF];

at step 322, applying a spectral de-whitening [dewhitening] to the [encoder-sided whitened] mid-side representation 362, 366, or 451 [e.g. Whitened Joint Chn 0, Whitened Joint Chn 1] of the multi-channel audio signal 104, to obtain a dewhitened mid-side representation [e.g. Joint Chn 0, Joint Chn 1] of the multi-channel input audio signal;

at step 340, deriving a separate-channel representation 318 of the multi-channel audio signal 104 on the basis of the dewhitened mid-side representation 323 of the multi-channel audio signal 104 [e.g. using an "Inverse Stereo Processing"].

It is noted that the signal representation as obtained from the bitstream 174 may be in the separate-channel mode, and in this case an appropriate dewhitening may be applied.

OTHER CHARACTERIZATIONS OF THE DRAWINGS

Some further characterizations of the figures, which may be valid for some examples, are here provided:

FIG. 1*a*: Encoder (embodiment) (Window+MDCT,TNS−1, ILD Compensation, Stereo IGF, Quantization+Entropy Coding, Bitstream Writer are all optional).

FIG. 2*a*: Encoder with prediction (embodiment) (Window+MDCT, TNS−1, ILD Compensation, Stereo IGF, Quantization+Entropy Coding, Bitstream Writer are all optional).

FIG. 3*a*: Decoder (embodiment).

FIG. 4 Decoder with prediction (embodiment).

FIG. 5 Calculating bitrate for band-wise M/S decision (example).

FIG. 6 Stereo mode decision (example).

A PARTICULAR EXAMPLE

Windowing, MDCT, MDST and OLA are done, for example, as described in [9]. MDCT and MDST form Modulated Complex Lapped Transform (MCLT); performing separately MDCT and MDST is equivalent to performing MCLT; In the figures above, MDCT may, for example, be replaced with MCLT in the encoder; if TNS is active, for example, just the MDCT part of the MCLT is used for the $TNS^{-1}$. processing and MDST is discarded; if TNS is inactive, for example, only MDCT is Quantized and Coded in the "Q+Entropy Coding".

Temporal Noise Shaping (TNS) is, for example, done similar as described in [9]. The $TNS^{-1}$ can optionally be moved after the Stereo decision in the encoder and the TNS before the Dewhitening in the decoder; TNS would then, for example, operate on the Whitened Joint Chn 0/1.

Whitening and Dewhitening correspond, for example, to the Frequency domain noise shaping (FDNS) as described in [9] or in [10]. Alternatively Whitening and Dewhitening correspond, for example, to SNS as described in [11]. The whitening parameters (WP Left, WP Right) may, for example, be calculated from the signal before or after $TNS^{-1}$, alternatively if FDNS is used they also may, for example, be calculated from the time domain signal. If MCLT is used and TNS is inactive the whitening parameters (WP Left, WP Right) may, for example, be calculated from the MCLT spectrum. In frames where the TNS is active, the MDST is, for example, estimated from the MDCT. Whitening coefficients (WC Left and WC Right) are, for example, derived from the whitening parameters in both encoder and decoder; for example they are derived using ODFT from the LPC as described in [9] or an interpolator and a linear domain converter as described in [11]. WC Left and WC Right are, for example, used for Whitening left and right channels in the encoder. For example, Elementwise minimum is used to find Whitening coefficients for the mid and side channels (WC M/S).

Stereo processing, for example, consists of (or comprises):

optional global ILD processing ("ILD Compensation") and/or optional Complex prediction or optional Real prediction ("Prediction")

M/S processing

"Stereo decision" with bitrate distribution among channels

If global ILD processing is used then single global ILD is calculated, for example, as $$NRG_L = \sqrt{\sum MDCT_{L,k}^2}$$

$$NRG_R = \sqrt{\sum MDCT_{R,k}^2}$$

$$ILD = \frac{NRG_L}{NRG_L + NRG_R}$$

where $MDCT_{L,k}$ is the k-th coefficient of the MDCT spectrum in the left channel and $MDCT_{R,k}$ is the k-th coefficient of the MDCT spectrum in the right channel. The global ILD is, for example, uniformly quantized:

$$\widehat{ILD} = \max(1, \min(ILD_{range} - 1, \lfloor ILD_{range} \cdot ILD + 0.5 \rfloor))$$

$$ILD_{range} = 1 \ll \mathrm{ILD}_{bits}$$

where $\mathrm{ILD}_{bits}$ is, for example, the number of bits used for coding the global ILD. $\widehat{ILD}$ is, for example, stored in the bitstream.

Energy ratio of channels is then, for example:

$$\mathrm{ratio}_{ILD} = \frac{ILD_{range}}{\widehat{ILD}} - 1 \approx \frac{NRG_R}{NRG_L}$$

If $\mathrm{ratio}_{ILD} > 1$ then, for example, the right channel is scaled with $$\frac{1}{\mathrm{ratio}_{ILD}},$$

otherwise, for example, the left channel is scaled with $\mathrm{ratio}_{ILD}$. This effectively means that the louder channel is scaled.

The spectrum is optionally divided into bands and, optionally, for each band it is decided if M/S processing should be done. For all bands where M/S is used, $MDCT_{L,k}$ and $MDCT_{R,k}$ are, for example, replaced with $$MDCT_{M,k} = 1/\sqrt{2}\,(MDCT_{L,k} + MDCT_{R,k}) \text{ and}$$

$$MDCT_{S,k} = 1/\sqrt{2}\,(MDCT_{L,k} - MDCT_{R,k}).$$

If the spectrum is not divided into bands, we consider, for example, the whole spectrum as a single band.

If complex prediction or real prediction is used then it is done, for example, as described in [7], the real prediction meaning, for example, that only $\alpha_{R,k}$ is used and $\alpha_{I,k}=0$. The Downmix channel $D_{R,k}$ is, for example, chosen among $MDCT_{M,k}$ and $MDCT_{S,k}$, for example based on the same criteria as in [7]. If the complex prediction is used $D_{I,k}$ is, for example, estimated using transform R2I as described in [7]. As in [7] the Residual channel is, for example, obtained using:

$$E_{R,k} = \begin{cases} MDCT_{S,k} - \alpha_{R,k}D_{R,k} - \alpha_{I,k}D_{I,k} & \text{if } D_{R,k} = MDCT_{M,k} \\ MDCT_{M,k} - \alpha_{R,k}D_{R,k} - \alpha_{I,k}D_{I,k} & \text{if } D_{R,k} = MDCT_{S,k} \end{cases}$$

with $\alpha_{I,k}=0$ if the real prediction is used.

Global gain $G_{est}$ is optionally estimated on signal consisting of the concatenated Left and Right channels. For example, the gain estimation as described in [9] is used, assuming SNR gain of 6 dB per sample per bit from the scalar quantization. The estimated gain may, for example, be multiplied with a constant to get an underestimation or an overestimation in the final $G_{est}$. Signals in the Left, Right, Mid, Side, Downmix and Residual channels are, for example, quantized using $G_{est}$.

Optionally, for each quantized channel required number of bits for arithmetic coding is estimated, for example, as described in "Bit consumption estimation" in [9]. Estimated number of bits for "full dual mono" ($b_{LR}$) is, for example, equal to the sum of the bits required for the Right and the Left channel. Estimated number of bits for "full M/S" ($b_{MS}$) is, for example, equal to the sum of the bits required for the Mid and the Side channel if the prediction is not used. Estimated number of bits for "full M/S" ($b_{MS}$) is, for example, equal to the sum of the bits required for the Downmix and the Residual channel if the prediction is used.

For example, for each band i with borders $[lb_i, ub_i]$, it is checked how many bits would be used for coding the quantized signal (in the band) in the L/R ($b_{bWLR}{}^i$) and in the M/S ($b_{bWMS}{}^i$) mode. If the complex or the real prediction is used then the M/S mode corresponds, for example, to using the Downmix and the Residual channel. For example, the mode with fewer bits is chosen for the band. For example, the number of required bits for arithmetic coding is estimated as described in [9]. For example, the total number of bits required for coding the spectrum in the "band-wise M/S" mode ($b_{BW}$) is equal to the sum of $\min(b_{bwLR}{}^i, b_{bwMS}{}^i)$:

$$b_{BW} = n\text{Bands} + \sum_{i=0}^{nBands-1} \min(b^i_{bwLR}, b^i_{bwMS})$$

The "band-wise M/S" mode needs, for example, additional nBands bits for signaling in each band whether L/R or M/S coding is used. If the complex or the real prediction is used, additional bits are, for example, needed for coding the $\alpha_{R,k}$ and optionally $\alpha_{I,k}$. For example, the "full dual mono" and the "full M/S" don't need additional bits for signaling.

The process for calculating $b_{BW}$ is depicted, for example, in FIG. 5. To reduce the complexity, for example, arithmetic coder context for coding the spectrum up to band i−1 is saved and reused in the band i.

If "full dual mono" is chosen then the complete spectrum consists, for example, of $MDCT_{L,k}$ and $MDCT_{R,k}$. If "full M/S" is chosen then the complete spectrum consists, for example, of $MDCT_{M,k}$ and $MDCT_{S,k}$ or of $D_{R,k}$ and $E_{R,k}$ if the prediction is used. If "band-wise M/S" is chosen then some bands of the spectrum consist, for example, of $MDCT_{L,k}$ and $MDCT_{R,k}$ and other bands consist, for example, of $MDCT_{M,k}$ and $MDCT_{S,k}$ or of $D_{R,k}$ and $E_{R,k}$ if the prediction is used.

The stereo mode is, for example, coded in the bitstream. In "band-wise M/S" mode also band-wise M/S decision is, for example, coded in the bitstream. If the prediction is used then also $\alpha_{R,k}$ and optionally $\alpha_{I,k}$ are, for example, coded in the bitstream.

The coefficients of the spectrum in the two channels after the stereo processing are, for example, denoted as $MDCT_{LM,k}$ and $MDCT_{RS,k}$. $MDCT_{LM,k}$ is equal to $MDCT_{M,k}$ or to $D_{R,k}$ in M/S bands or to $MDCT_{L,k}$ in L/R bands and $MDCT_{RS,k}$ is equal to $MDCT_{S,k}$ or to $E_{R,k}$ in M/S bands or to $MDCT_{R,k}$ in L/R bands, depending, for example, on the stereo mode and band-wise M/S decision. The spectrum consisting, for example, of $MDCT_{LM,k}$ is called jointly coded channel 0 (Joint Chn 0) and the spectrum consisting, for example, of $MDCT_{RS,k}$ is called jointly coded channel 1 (Joint Chn 1).

For example, two methods for calculating bitrate split ratio may be used: energy based split ratio and transparency split ratio. First the energy based split ratio is described.

The bitrate split ratio is, for example, calculated using the energies of the stereo processed channels:

$$NRG_{LM} = \sqrt{\sum MDCT^2_{LM,k}}$$

$$NRG_{RS} = \sqrt{\sum MDCT^2_{RS,k}}$$

$$r_{split} = \frac{NRG_{LM}}{NRG_{LM} + NRG_{RS}}$$

The bitrate split ratio is, for example, uniformly quantized:

$$\widehat{ILD} = \max(1, \min(r\text{split}_{range}-1, [r\text{split}_{range} \cdot r_{split} + 0.5]))$$

$$r\text{split}_{range} = 1 << r\text{split}_{bits}$$

where $r\text{split}_{bits}$ is the number of bits used for coding the bitrate split ratio. For example, if $$r_{split} < \frac{8}{9}$$

and $$\widehat{r_{split}} > \frac{9r\text{split}_{range}}{16}$$

then $\widehat{ILD}$ is decreased for $$\frac{r\text{split}_{range}}{8}.$$

If $$r_{split} > \frac{1}{9}$$

and $$\bar{r}_{split} < \frac{7r\text{split}_{range}}{16}$$

then $\widehat{ILD}$ is increased for $$\frac{r\text{split}_{range}}{8}.$$

$\widehat{ILD}$ is, for example, stored in the bitstream.

The bitrate distribution among channels is, for example:

$$\text{bits}_{LM} = \left\lfloor \frac{\bar{r}_{split}}{r\text{split}_{range}}(\text{totalBitsAvailable} - \text{stereoBits}) \right\rfloor$$

$$\text{bits}_{RS} = (\text{totalBitsAvailable} - \text{stereoBits}) - \text{bits}_{LM}$$

Additionally it is optionally made sure that there are enough bits for the entropy coder in each channel by checking that $\text{bits}_{LM}-\text{sideBits}_{LM}>\text{minBits}$ and $\text{bits}_{RS}-\text{sideBits}_{RS}>\text{minBits}$, where minBits is the minimum number of bits required by the entropy coder. For example, if there is not enough bits for the entropy coder then $\widehat{ILD}$ is increased/decreased by 1 till $\text{bits}_{LM}-\text{sideBits}_{LM}>\text{minBits}$ and $\text{bits}_{RS}-\text{sideBits}_{RS}>\text{minBits}$ are fulfilled.

The transparency split ratio is described now. In this method all stereo decisions are based on the assumption that enough bits are available for transparent coding, for example 96 kbps per channel. For example, the number of bits needed for coding Joint Chn 0 and Joint Chn 1 is then estimated. It is estimated using the $G_{est}$ for the quantization and the transparency split ratio is, for example, calculated as:

$$r_{split} = \frac{\text{Bits}_{JointChn0}}{\text{Bits}_{JointChn0} + \text{Bits}_{JointChn1}}$$

The coding of $r_{split}$ and the bitrate distribution based on the coded $\widehat{ILD}$ is then, for example, done in the same way as for the energy based split ratio.

Quantization, noise filling and the entropy encoding, including the rate-loop, are, for example, as described in [9]. The rate-loop can optionally be optimized using the estimated $G_{est}$. The power spectrum P (magnitude of the MCLT) is, for example, used for the tonality/noise measures in the quantization and Intelligent Gap Filling (IGF), for example as described in [9]. Since, for example, whitened and stereo processed MDCT spectrum is used for the power spectrum, the same whitening and stereo processing has to, in some cases, be done on the MDST spectrum. The same scaling based on the global ILD of the louder channel has to, in some cases, be done for the MDST if it was done for the MDCT. The same prediction has to, in some cases, be done for the MDST if it was done for the MDCT. For the frames where TNS is active, MDST spectrum used for the power spectrum calculation is, for example, estimated from the whitened and stereo processed MDCT spectrum: $P_k=\text{MDCT}_k^2+(\text{MDCT}_{k+1}-\text{MDCT}_{k-1})^2$.

The decoding process starts, for example, with decoding and inverse quantization of the spectrum of the jointly coded channels, followed by the noise filling, for example as in [9]. The number of bits allocated to each channel is, for example, determined based on the window length, the stereo mode and the bitrate split ratio coded in the bitstream. The number of bits allocated to each channel has to, in some cases, be known before fully decoding the bitstream.

In the optional intelligent gap filling (IGF) block, lines quantized to zero in a certain range of the spectrum, called the target tile are filled with processed content from a different range of the spectrum, called the source tile. Due to the band-wise stereo processing, the stereo representation (i.e. either L/R or M/S or D/E) might differ for the source and the target tile. To ensure good quality, if the representation of the source tile is different from the representation of the target tile, the source tile is optionally processed to transform it to the representation of the target file prior to the gap filling in the decoder. For example, this procedure is already described in [12]. The IGF itself is, contrary to [9], may, for example, be applied in the whitened spectral domain instead of the original spectral domain.

If the complex or the real prediction is used, then the M/S channels are, for example, restored in the Prediction block in the same way as described in [7].

Based on the stereo decision decoded from the bitstream, the Whitening coefficients (WC Left and WC Right) are, for example, modified so that, for example, in bands where M/S or D/E channels are used, minimum between WC Left and WC Right is used.

Based on the stereo mode and (band-wise) M/S decision, left and right channel are, for example, constructed from the jointly coded channels:

$$MDCT_{L,k} = \frac{1}{\sqrt{2}}(MDCT_{L,M,k} + MDCT_{RS,k}) \text{ and}$$

$$MDCT_{R,k} = \frac{1}{\sqrt{2}}(MDCT_{LM,k} - MDCT_{RS,k}).$$

For example, if the ILD compensation is used then if $\text{ratio}_{ILD}>1$ then the right channel is scaled with $\text{ratio}_{ILD}$, otherwise the left channel is scaled with $$\frac{1}{\text{ratio}_{ILD}}.$$

The ILD compensation is, for example, within the "Inverse Stereo Processing".

For each case where division by 0 could happen, a small epsilon is, for example, added to the denominator.

Some Advantages of Some Embodiments FDNS with the rate-loop, for example, as described in [9] combined with the spectral envelope warping, for example, as described in [10] or , for example, SNS with the rate-loop, for example, as described in [11] provide simple yet very effective way separating perceptual shaping of quantization noise and rate-loop. On one side the method provides, for example, a way for adapting the complex or the real prediction [7] to the system with the separated perceptual noise shaping and the rate-loop. On the other side the method provides, for example, a way for using the perceptual criteria for noise shaping in the mid and side channels from [8] in the system with the separated perceptual noise shaping and the rate-loop.

Some Aspects of the Examples Above

Embodiments according to the present invention may comprise one or more of the features, functionalities and details mentioned in the following. However, these embodiments may optionally be supplemented by and of the features, functionalities and details disclosed herein, both individually and taken in combination. Also, the features, functionalities and details mentioned in the following may optionally be introduced into any of the other embodiments disclosed herein, both individually and taken in combination.

1. Encoder aspects/encoder embodiments/encoder features:
   - Whitening coefficients for Mid and Side are derived from the WC Left and the WC Right, where WC Left is derived from the coded WP Left and WC Right is derived from the coded WP Right and 1 WP influences more than 1 WC and at least 1 WC is derived from more than 1 WP. The derived whitening coefficients are used for whitening the Mid and Side channels
   - Whitening coefficients for Mid and Side are derived from the WC Left and the WC Right and Stereo decision is done on the whitened channels (before the quantization of the channels).
   - Whitening is done on the Mid and Side, followed by the stereo decision
   - Complex/real prediction on the whitened signal, followed the quantization using single quantization step size per channel
   - ILD Compensation before Whitening and Whitening before the Stereo Decision
   - WC Left and WC Right steer Whitening of both L/R and M/S signal, where WC Left is derived from the coded WP Left and WC Right is derived from the coded WP Right and 1 WP influences more than 1 WC and at least one WC is derived from more than 1 WP
   - Bitrate distribution between channels is derived from the number of the available bits for coding the whitened channels and the expected number of bits for transparently coding the channels and transmitted via the bitstream
2. Decoder aspects/decoder embodiments/decoder features:
   - Whitening coefficients are derived from the stereo decision and the WC Left and the WC Right (where WC Left is derived from the coded WP Left and WC Right is derived from the coded WP Right and 1 WP influences more than 1 WC and at least 1 WC is derived from more than 1 WP). The derived whitening coefficients are used for dewhitening the jointly coded channels Complex/real prediction on the whitened signal, followed by Dewhitening followed by Inverse Stereo Processing ILD compensation (within Inverse Stereo Processing) is done on the dewhitened signal (followed by the IMDCT)

Stereo parameters steer Decode+Transform whitening coefficients+Inverse

Stereo Processing

Remarks:

Above, different inventive embodiments and aspects have been described. Also, further embodiments will be defined by the enclosed claims.

It should be noted that any embodiments as defined by the claims can be supplemented by any of the details (features and functionalities) described in the description.

Also, the embodiments described in the description can be used individually, and can also be supplemented by any of the included in the claims.

Also, it should be noted that individual aspects described herein can be used individually or in combination. Thus, details can be added to each of said individual aspects without adding details to another one of said aspects.

It should also be noted that the present disclosure describes, explicitly or implicitly, features usable in an audio encoder (apparatus configured for providing an encoded representation of an input audio signal) and in an audio decoder (apparatus configured for providing a decoded representation of an audio signal on the basis of an encoded representation). Thus, any of the features described herein can be used in the context of an audio encoder and in the context of an audio decoder.

Moreover, features and functionalities disclosed herein relating to a method can also be used in an apparatus (configured to perform such functionality). Furthermore, any features and functionalities disclosed herein with respect to an apparatus can also be used in a corresponding method. In other words, the methods disclosed herein can optionally be supplemented by any of the features and functionalities and details described with respect to the apparatuses.

Also, any of the features and functionalities described herein can be implemented in hardware or in software, or using a combination of hardware and software, as will be described in the section "implementation alternatives".

Also, it should be noted that the processing described herein may be performed, for example (but not necessarily), per frequency band or per frequency bin or for different frequency regions.

Text in brackets (e.g. square brackets) includes variants, optional aspects, or additional embodiments.

Implementation Alternatives:

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine-readable carrier.

Other embodiments comprise the computer program for performing one of the methods described herein, stored on a machine-readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

The apparatus described herein may be implemented using a hardware apparatus, or using a computer, or using a combination of a hardware apparatus and a computer.

The apparatus described herein, or any components of the apparatus described herein, may be implemented at least partially in hardware and/or in software.

The methods described herein may be performed using a hardware apparatus, or using a computer, or using a combination of a hardware apparatus and a computer.

The methods described herein, or any components of the apparatus described herein, may be performed at least partially by hardware and/or by software.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

BIBLIOGRAPHY

[1] J. D. Johnston and A. J. Ferreira, "Sum-difference stereo transform coding," in *Proc. ICASSP,* 1992.

[2] ISO/IEC 11172-3, Information technology—Coding of moving pictures and associated audio for digital storage media at up to about 1,5 Mbit/s—Part 3: Audio, 1993.

[3] ISO/IEC 13818-7, Information technology—Generic coding of moving pictures and associated audio information—Part 7: Advanced Audio Coding (AAC), 2003.

[4] H. Purnhagen, P. Carlsson, L. Villemoes, J. Robilliard, M. Neusinger, C. Helmrich, J. Hilpert, N. Rettelbach, S. Disch and B. Edler, "Audio encoder, audio decoder and related methods for processing multi-channel audio signals using complex prediction". U.S. Pat. No. 8,655,670 B2, Feb. 18, 2014.

[5] Valin, G. Maxwell, T. B. Terriberry and K. Vos, "High-Quality, Low-Delay Music Coding in the Opus Codec," in *Proc. AES* 135th Convention, New York, 2013.

[6] G. Markovic, E. Ravelli, M. Schnell, S. Dohla, W. Jägers, M. Dietz, C. Helmrich, E. Fotopoulou, M. Multrus, S. Bayer, G. Fuchs and J. Herre, "APPARATUS AND METHOD FOR MDCT M/S STEREO WITH GLOBAL ILD WITH IMPROVED MID/SIDE DECISION". WO Patent WO2017EP51177, Jan. 20, 2017.

[7] C. Helmrich, P. Carlsson, S. Disch, B. Edler, J. Hilpert, M. Neusinger, H. Purnhagen, N. Rettelbach, J. Robilliard and L. Villemoes, "Efficient Transform Coding Of Two-channel Audio Signals By Means Of Complex-valued Stereo Prediction," in *Acoustics, Speech and Signal Processing* (*ICASSP*), 2011 IEEE International Conference on, Prague, 2011.

[8] J. Herre, E. Eberlein and K. Brandenburg, "Combined Stereo Coding," in 93*rd AES Convention*, San Francisco, 1992.

[9] 3GPP TS 26.445, *Codec for Enhanced Voice Services* (*EVS*); *Detailed algorithmic description*. The version for is 16.0.0. [9] and cab be downloaded at: https://portal.3gpp.org/desktopmodules/Specifications/SpecificationDetails.aspx?specificationId=1467

[10] G. Markovic, G. Fuchs, N. Rettelbach, C. Helmrich and B. Schubert, "Linear prediction based coding scheme using spectral domain noise shaping". EU Patent 2676266 B1, Feb. 14, 2011.

[11] E. Ravelli, M. Schnell, C. Benndorf, M. Lutzky and M. Dietz, "Apparatus and method for encoding and decoding an audio signal using downsampling or interpolation of scale parameters". WO Patent WO 2019091904 A1, Nov. 5, 2018.

[12] S. Disch, F. Nagel, R. Geiger, B. N. Thoshkahna, K. Schmidt, S. Bayer, C. Neukam, B. Edler and C. Helmrich, "Audio Encoder, Audio Decoder and Related Methods Using Two-Channel Processing Within an Intelligent Gap Filling Framework". International Patent PCT/EP2014/065106 Jul. 15, 2014.

[13] C. R. Helmrich, A. Niedermeier, S. Bayer and B. Edler, "Low-complexity semi-parametric joint-stereo audio transform coding," in *Signal Processing Conference* (*EUSIPCO*), 2015 23*rd European,* 2015.

[14] R. G. van der Waal and R. N. Veldhuis, "Subband Coding of Stereophonic Digital Audio Signals," in *ICASSP*, Toronto, 1991.

The invention claimed is:

1. A multi-channel audio encoder for providing an encoded representation of a multi-channel input audio signal, wherein the multi-channel audio encoder includes a first whitening block that configured to apply a spectral whitening to a separate-channel representation of the multi-channel input audio signal to output a whitened separate-channel representation of the multi-channel input audio signal;

wherein the multi-channel audio encoder includes a second whitening block configured to apply a spectral whitening to a mid-side representation of the multi-channel input audio signal, to output a whitened mid-side representation of the multi-channel input audio signal, wherein the encoder is configured to derive the mid-side representation from a non-spectrally-whitened version of the separate-channel representation;

wherein the multi-channel audio encoder includes a stereo decision block configured to make a decision whether to encode the whitened separate-channel representation of the multi-channel input audio signal, to output the encoded representation of the multi-channel input audio signal, or to encode the whitened mid-side representation of the multi-channel input audio signal, to output the encoded representation of the multi-channel input audio signal, in dependence on the whitened separate-channel representation and in dependence on the whitened mid-side representation.

2. The multi-channel audio encoder according to claim 1, wherein the multi-channel audio encoder is configured to acquire a plurality of whitening parameters.

3. The multi-channel audio encoder according to claim 2, wherein the multi-channel audio encoder is configured to derive a plurality of whitening coefficients from the whitening parameters.

4. The multi-channel audio encoder according to claim 1, wherein the multi-channel audio encoder is configured to derive whitening coefficients associated with signals of the mid-side representation from whitening coefficients associated with individual channels of the multi-channel input audio signal.

5. The multi-channel audio encoder according to claim 4, wherein the multi-channel audio encoder is configured to derive the whitening coefficients associated with signals of the mid-side representation from the whitening coefficients associated with individual channels of the multi-channel input audio signal using a non-linear derivation rule.

6. The multi-channel audio encoder according to claim 4, wherein the multi-channel audio encoder is configured to determine an element-wise minimum, to derive the whitening coefficients associated with signals of the mid-side representation from the whitening coefficients associated with individual channels of the multi-channel input audio signal.

7. The multi-channel audio encoder according to claim 1, wherein the multi-channel audio encoder is configured to apply an inter-channel level difference compensation to two or more channels of the multi-channel input audio signal, in order to acquire level-compensated channels, and wherein the multi-channel audio encoder is configured to use the level-compensated channels as the separate-channel representation of the multi-channel input audio signal.

8. The multi-channel audio encoder according to claim 1, wherein the first whitening block is configured to apply channel-specific whitening coefficients to different channels of the separate-channel representation of the multi-channel input audio signal-, in order to output the whitened separate-channel representation, and wherein the second whitening block is configured to apply whitening coefficients to a mid signal and to a side signal, in order to output the whitened mid-side representation.

9. A multi-channel audio decoder for providing a decoded representation of a multi-channel audio signal on the basis of a bitstream including an encoded representation of the multi-channel audio signal and side information, wherein the multi-channel audio decoder includes a dewhitening block configured to derive a joint-signal representation of the multi-channel audio signal from the encoded representation, wherein the joint-signal representation of the multi-channel audio signal is selected between a mid-side representation of the multi-channel audio signal and a separate-channel representation of the multi-channel audio signal, wherein the dewhitening block is configured to determine, from stereo information included in the side information, whether the joint-signal representation of the multi-channel audio signal is the mid-side representation of the multi-channel audio signal or the separate-channel representation of the multi-channel audio signal;

wherein the dewhitening block is configured to apply a spectral de-whitening to the joint-signal representation of the multi-channel audio signal, to acquire a dewhitened representation of the multi-channel input audio signal;

wherein the multi-channel audio decoder is configured, in case the representation of the multi-channel audio signal is the mid-side representation of the multi-channel audio signal, to derive the separate-channel representation of the multi-channel audio signal on the basis of the dewhitened mid-side representation of the multi-channel audio signal.

10. The multi-channel audio encoder according to claim 9, wherein the multi-channel audio encoder is configured to acquire a plurality of whitening parameters, wherein the multi-channel audo decoder is configured to derive a plurality of whitening co-efficients from the whitening parameters, and wherein the multi-channel audio encoder is configured to derive whitening coefficients associated with signals of the mid-side representation from whitening coefficients associated with individual channels of the multi-channel audio signal.

11. The multi-channel audio decoder according to claim 10, wherein the multi-channel audio decoder is configured to derive the whitening coefficients associated with signals of the mid-side representation from the whitening coefficients associated with individual channels of the multi-channel audio signal using a non-linear derivation rule.

12. The multi-channel audio decoder according to claim 10, wherein the multi-channel audio decoder is configured to determine an element-wise minimum, to derive the whitening coefficients associated with signals of the mid-side representation from the whitening coefficients associated with individual channels of the multi-channel audio signal.

13. The multi-channel audio decoder according to claim 9, wherein the multi-channel audio decoder is configured to apply an inter-channel level difference compensation to two or more channels of a dewhitened separate-channel representation of the multi-channel audio signal, in order to acquire a level-compensated representation of channels.

14. The multi-channel audio decoder according to claim 9, wherein the multi-channel audio decoder is configured to apply an Intelligent Gap Filling.

15. A method for providing an encoded representation of a multi-channel input audio signal, wherein the method comprises:

applying a spectral whitening to a separate-channel representation of the multi-channel input audio signal, to output a whitened separate-channel representation of the multi-channel input audio signal;

applying a spectral whitening to a mid-side representation of the multi-channel input audio signal, to output a whitened mid-side representation of the multi-channel input audio signal;

making a decision whether to encode the whitened separate-channel representation of the multi-channel input audio signal, to output the encoded representation of the multi-channel input audio signal, or to encode the whitened mid-side representation of the multi-channel input audio signal, to output the encoded representation of the multi-channel input audio signal, in dependence on the whitened separate-channel representation and in dependence on the whitened mid-side representation.

16. A method for providing a decoded representation of a multi-channel audio signal on the basis of a bitstream including an encoded representation of the multi-channel audio signal and side information, wherein the method comprises:

deriving, from the encoded representation, a joint-signal representation of the multi-channel audio signal, either a mid-side representation of the multi-channel audio signal or a separate-channel representation of the multi-channel audio signal, wherein, from stereo information included in the side information, it is determined whether the joint-signal representation of the multi-channel audio signal is the mid-side representation of the multi-channel audio signal or the separate-channel representation of the multi-channel audio signal;

applying a spectral de-whitening to the joint-signal representation of the multi-channel audio signal, to acquire a dewhitened joint-signal representation of the multi-channel input audio signal;

in case the joint-signal representation of the multi-channel input audio signal is the mid-side representation of the multi-channel audio signal, deriving the separate-channel representation of the multi-channel audio signal on the basis of the dewhitened mid-side representation of the multi-channel audio signal.

17. A non-transitory digital storage medium having a computer program stored thereon to perform the method for providing an encoded representation of a multi-channel input audio signal, wherein the method comprises:

applying a spectral whitening to a separate-channel representation of the multi-channel input audio signal, to output a whitened separate-channel representation of the multi-channel input audio signal;

applying a spectral whitening to a mid-side representation of the multi-channel input audio signal, to output a whitened mid-side representation of the multi-channel input audio signal;

making a decision whether to encode the whitened separate-channel representation of the multi-channel input audio signal, to output the encoded representation of the multi-channel input audio signal, or to encode the whitened mid-side representation of the multi-channel input audio signal, to output the encoded representation of the multi-channel input audio signal, in dependence on the whitened separate-channel representation and in dependence on the whitened mid-side representation, when said computer program is run by a computer.

18. A non-transitory digital storage medium having a computer program stored thereon to perform the method for providing a decoded representation of a multi-channel audio signal on the basis of a bitstream including an encoded representation of the multi-channel audio signal and side information, deriving, from the encoded representation, a joint-signal representation of the multi-channel audio signal, either a mid-side representation of the multi-channel audio signal or a separate-channel representation of the multi-channel audio signal, wherein, from stereo information included in the side information, it is determined whether the joint-signal representation of the multi-channel audio signal is the mid-side representation of the multi-channel audio signal or the separate-channel representation of the multi-channel audio signal;

applying a spectral de-whitening to the joint-signal representation of the multi-channel audio signal, to acquire a dewhitened joint-signal representation of the multi-channel input audio signal;

in case the joint-signal representation of the multi-channel input audio signal is the mid-side representation of the multi-channel audio signal, deriving a separate-channel representation of the multi-channel audio signal on the basis of the dewhitened mid-side representation of the multi-channel audio signal, when said computer program is run by a computer.

* * * * *